US006088302A

United States Patent [19]

Nakajima et al.

[11] Patent Number: 6,088,302

[45] Date of Patent: Jul. 11, 2000

[54] ELECTRONIC TIMEPIECE

[75] Inventors: Kenichi Nakajima; Takayuki Satodate; Akihiro Matouge; Akihiko Inada; Mitsuru Ishii; Yoshio Koyama; Shigeo Suzuki; Masayuki Kawata; Yuko Sasaki; Eriko Takakuwa, all of Chiba, Japan

[73] Assignee: Seiko Instruments Inc., Japan

[21] Appl. No.: 09/065,987

[22] Filed: Apr. 24, 1998

[30] Foreign Application Priority Data

| | | | |
|---|---|---|---|
| Apr. 25, 1997 | [JP] | Japan | 9-109446 |
| Apr. 25, 1997 | [JP] | Japan | 9-109455 |
| Jan. 26, 1998 | [JP] | Japan | 10-016701 |
| Mar. 31, 1998 | [JP] | Japan | 10-086710 |

[51] Int. Cl.[7] ..... G04B 21/02

[52] U.S. Cl. ..... 368/35; 368/28; 368/37

[58] Field of Search ..... 368/21–27, 75, 368/76, 80, 28, 31–40

[56] References Cited

U.S. PATENT DOCUMENTS

| | | | |
|---|---|---|---|
| 3,855,781 | 12/1974 | Chihara et al. | 58/4 A |
| 4,271,494 | 6/1981 | Miyazaki | 368/34 |
| 4,522,506 | 6/1985 | Owa | 368/75 |
| 4,674,889 | 6/1987 | Klaus | 368/28 |
| 5,357,489 | 10/1994 | Luthier | 368/37 |
| 5,699,321 | 12/1997 | Vaucher | 368/28 |

FOREIGN PATENT DOCUMENTS

| | | |
|---|---|---|
| 759584A1 | 2/1997 | European Pat. Off. . |
| 1557667 | 1/1969 | France . |
| 3813935A1 | 11/1989 | Germany . |

OTHER PUBLICATIONS

Patent Abstracts of Japan, vol. 009, No. 181 (E–331) Jul. 26, 1985.

Patent Abstracts of Japan, vol. 005, No. 118 (P–073) Jul. 30, 1981.

*Primary Examiner*—Bernard Roskoski
*Attorney, Agent, or Firm*—Adams & Wilks

[57] ABSTRACT

To provide an electronic timepiece enabling reliable detection of a state of rotation of an indication wheel such as a date dial.

An ultrasonic motor 1130 has an ultrasonic rotor pinion 1134*b*. A date dial 1120 is disposed on a main plate 1102 in such a way as to rotate relative thereto. The ultrasonic rotor pinion 1134*b* is meshed with an intermediate date driving gear wheel 1142*a*. A date driving wheel 1150 is rotatably disposed on the main plate 1102. A date driving gear wheel 1150*b* is meshed with an intermediate date driving pinion 1142*b*. A date driving gear portion 1150*b* is meshed with a dial gear portion 1120*a*. A contact point spring 1160 is disposed on a spring guiding portion 1150*d*. The contact point spring 1160 rotates integrally with the date driving wheel 1150 through the rotation of the date driving wheel 1150. The state of rotation of the date driving wheel 1150 can be detected by contact of the contact point spring 1160 with the contact point pattern 1174.

12 Claims, 50 Drawing Sheets

ELECTRONIC TIMEPIECE

BACKGROUND OF THE INVENTION

1. Field of the Invention

The present invention relates to an electronic timepiece having a transmission wheel rotation position detecting unit which detects the position in the rotation direction of a transmission wheel of the electronic timepiece contained in a wheel train thereof such as an obverse wheel train or calendar wheel train.

2. Description of the Prior Art

In a conventional electronic timepiece, as illustrated in FIG. 38, a part of an obverse wheel train 930, e.g., a 24-hour contact point 932 for detecting a rotational position of the obverse wheel train 930 is provided on an hour wheel. When the 24-hour contact point 932 detects the position corresponding to the time of twelve o'clock at night, according to a detection signal output from the 24-hour contact point 932 a circuit block 934 rotates a date driving motor 936. Due to the rotation of the date driving motor 936, a date dial 912 is rotated through a reduction wheel train 938. This makes it possible to change the display of the date.

In the above-described conventional electronic timepiece, in a region near to an outer-peripheral portion of a gear portion of the hour wheel there was provided a conduction pin. And, it was arranged that when the hour wheel rotated, the conduction pin moved a contact point spring so as to cause this contact point to contact with a contact point pattern of the circuit block, and that, when the hour wheel further rotated, the conduction pin was moved away from the contact point spring with the result that the contact point spring was moved away from the contact point pattern of the circuit block. Namely, the contact point spring corresponds to the 24-hour contact point 932 and it was arranged that when the contact point spring contacted with the contact point pattern of the circuit block, the position corresponding to the time of twelve o'clock at night was detected.

Also, in a structure wherein the date driving wheel was rotated through the rotation of the intermediate date driving wheel by the rotation of the date driving motor and the date dial was rotated by the rotation of the date driving wheel, the tooth configuration of the respective gears of the intermediate date driving wheel, date driving wheel and date dial was constituted by a circular arc tooth configuration that includes one or more circular arc portions.

Accordingly, when an external force such as an impact had been applied to the date dial, the rotation of the date dial was stopped by only the index torque of the date driving motor.

However, in the conventional electronic timepiece, there were the problems which follow.

(1) Since the contact point spring was formed of material which was easy to flex, the portion of the contact point spring which contacted with the contact point pattern was difficult to position.

(2) In order to dispose the contact point spring having a sufficient spring length, a significantly large space was needed in the electronic timepiece. (3) When the portion of the contact point spring which contacts with the contact point pattern is disposed at a position which is farther away from the contact point pattern than necessary, even when the hour wheel rotates, the contact point spring cannot be contacted with the contact point pattern of the circuit block by the conduction pin, with the result that time display or calendar display becomes unable to be accurately made.

(4) When the portion of the contact point spring which contacts with the contact point pattern is disposed at a position which is nearer to the contact point pattern than necessary, when the hour wheel has rotated, the pressure of the contact point spring applied to the conduction pin becomes high, with the result that there is the likelihood that any inconvenience will occur in the operation of the electronic timepiece or the electronic timepiece will inconveniently stop.

(5) The structure of the hour wheel becomes complicated with the result that it becomes necessary to use the contact point spring having a sufficient spring length.

(6) In the conventional calendar equipped electronic timepiece provided at a part of the obverse wheel train with the 24-hour contact point for detecting the rotation position of the obverse wheel train, since a number of wheel trains were disposed between the obverse wheel train and the date dial, it was difficult to achieve an accurate positional coincidence of the date dial due to the backlashes between two adjacent ones of the respective wheel trains.

(7) It was difficult to enhance the precision with which the position in the rotation direction of the hour wheel was detected.

(8) There was the possibility that when an external force such as an impact had been applied to the electronic timepiece, the indication wheel or date dial would rotate. In order to prevent the resulting positional displacement of the date dial, it was needed to increase the index torque of the motor (the stationary force: the torque that resists the rotation when at rest). However, when increasing the index torque of the motor, it resulted that the electric power needed when driving the motor also became increased and as a result the battery life of the electronic timepiece was decreased.

SUMMARY OF THE INVENTION

In view of the above, an object of the present invention is to provide an electronic timepiece having a transmission wheel rotation position detecting unit which, in order to solve the above-described conventional problems, detects accurately the position in the rotation direction of the transmission wheel.

Also, another object of the present invention is to provide a small sized electronic timepiece having a transmission wheel rotation position detecting unit.

Further, still another object of the present invention is to provide a small sized and thin type electronic timepiece having a transmission wheel rotation position detecting unit. And, Further, a further object of the present invention is to provide an electronic timepiece having a transmission wheel rotation position detecting unit whose contact point has a high durability performance.

Also, a yet further object of the present invention is to provide an electronic timepiece which is equipped with a small-sized simplified date driving mechanism and indication wheel detecting mechanism.

Also, a yet further object of the present invention is to provide an electronic timepiece in which even when an external force such as an impact has been applied to the electronic timepiece there is no possibility that the indication wheel or date dial will rotate.

In order to solve the problems, the present invention has been constructed such that an electronic timepiece according thereto comprises a transmission wheel rotating according to the rotation of a wheel train contained in the electronic timepiece, a contact point spring fixed to the transmission wheel and rotating integrally with the transmission wheel and having a conductivity, a detection pattern which is provided on a printed circuit board and, when the contact point spring rotates, can contact with the contact point spring, and a control circuit which inputs a rotational position detection signal for detecting a circumferential position of the rotation of the transmission wheel which, when the contact point spring has contacted with the detection pattern, is output from the detection pattern.

By this construction, the transmission wheel rotation position can be detected using small-sized and simple parts.

Also, in the electronic timepiece according to the present invention, preferably, the detection pattern includes two detection patterns which, when the contact point spring rotates, can simultaneously contact with the contact point spring, and the control circuit which is a control circuit which inputs rotational position detection signals each for detecting the circumferential position of the rotation of the transmission wheel which, when the two detection patterns have been conducted to each other by the contact point spring, are respectively output from the two detection patterns.

By this construction, the rotation position of the transmission wheel can be reliably detected.

Also, in the electronic timepiece according to the present invention, preferably, the detection pattern includes two detection patterns which, when the contact point spring rotates, can simultaneously contact with the contact point spring and nonfunctional patterns provided respectively between the two detection patterns and having no function of detection, and the control circuit which is a control circuit which inputs rotational position detection signals each for detecting the circumferential position of the rotation of the transmission wheel which, when the two detection patterns have been conducted to each other by the contact point spring, are respectively output from the two detection patterns.

By this construction, the durability of the pattern of the printed circuit board can be enhanced.

Further, the present invention has been constructed such that an electronic timepiece according thereto comprises a transmission wheel rotating according to the rotation of a wheel train contained in the electronic timepiece, a contact point spring fixed to the transmission wheel and rotating integrally with the transmission wheel and having a conductivity, and a first detection pattern and second detection pattern which are provided on a printed circuit board and, when the contact point spring rotates, can contact with the contact point spring, whereby it is arranged that the contact point spring and the first detection pattern and second detection pattern can take a first detection state causing only the first detection pattern to generate a rotational position detection signal for detecting a circumferential position of the rotation of the transmission wheel, a second detection state causing only the second detection pattern to generate a rotational position detection signal for detecting a circumferental position of the rotation of the transmission wheel, and a third detection stage causing both the first and the second detection pattern to simultaneously generate rotational position detection signals each for detecting a circumferental position of the rotation of the transmission wheel, and further comprises a control circuit for determining a case where the third detection state has occurred immediately after the first detection state has been detected and a case where the third detection state has occurred immediately after the second detection state has been detected by distinguishing between these two cases.

Also, in the electronic timepiece according to the present invention, preferably, the control circuit is so arranged that when the third detection state has occurred immediately after the first detection state has been detected the control circuit may determine the rotation direction of the transmission wheel as a forward rotation and, when the third detection state has occurred immediately after the second detection state has been detected, may determine the rotation direction of the transmission wheel as a reverse rotation.

Further, in the electronic timepiece according to the present invention, preferably, the printed circuit board further comprises a VDD pattern connected to one potential of a power source, and the contact point spring has three terminal contact point portions which can contact with the first detection pattern, the second detection pattern and the VDD pattern, whereby it is arranged that the contact point spring, first detection pattern and second detection pattern can take a first detection state where, in a state where at least one terminal contact point portion is in contact with the VDD pattern, the other terminal contact point portions are in contact with only the first detection pattern, a second detection state where, in a state where at least one terminal contact point portion is in contact with the VDD pattern, the other terminal contact point portions are in contact with only the second detection pattern, and a third detection state where, in a state where at least one terminal contact point portion is in contact with the VDD pattern, the other terminal contact point portions are in contact with the first detection pattern and second detection pattern, and the control circuit is so arranged that when the third detection state has occurred immediately after the first detection state has been detected the control circuit may determine the rotation direction of the transmission wheel as a forward rotation and, when the third detection state has occurred immediately after the second detection state has been detected, may determine the rotation direction of the transmission wheel as a reverse rotation.

By this construction, the rotation direction of the transmission wheel can be accurately determined.

Also, the present invention has been constructed such that an electronic timepiece according thereto, the electronic timepiece having a function of displaying a date, comprises a time signal generating circuit for generating a time signal by counting data regarding a time, a time indication motor driving circuit which outputs a time indication motor driving signal for rotating a time indication motor, a time indication motor which rotates according to a time indication signal output from the time indication motor driving circuit, a time indication wheel train which rotates according to the rotation of the time indication motor, a time data display member which displays time data according to the rotation of the time indication wheel train, a date signal generating circuit which generates a date signal by counting data regarding a date, a date indication motor driving circuit which outputs a date indication motor driving signal for rotating a date indication motor according to the date signal output from the date signal generating circuit, a date indication motor which rotates according to a date indication signal output from the date indication motor driving circuit, a date indication wheel train which rotates according to the rotation of the date indication motor, a date data display member which displays date data according to the rotation of the date indication wheel train, a date drive start detecting contact point member which detects the point in time at which date drive is started according to the rotation of the time indication wheel train, a date drive termination detecting contact point member which detects the point in time at which date drive is terminated according to the rotation of the date indication wheel train, and a date drive control circuit which controls the operation of the date indication driving circuit outputting the date indication motor driving signal by inputting a signal regarding the start of the date drive which is output from the date drive start detecting contact point member and by inputting a signal regarding the termination of the date drive which is output from the date drive termination detecting contact point member.

By this construction, it is possible to realize a calendar equipped electronic timepiece enabling reliable display of a date.

In the electronic timepiece according to the present invention, preferably, the date indication motor is constituted by an ultrasonic motor.

Also, in the electronic timepiece according to the present invention, preferably, the date drive start detecting contact point member is provided on a 24-hour wheel rotating according to the rotation of a hour wheel, and the date drive termination detecting contact point member is provided on a date driving wheel rotating according to the rotation of the date indication motor.

Further, the present invention has been constructed such that an electronic timepiece according thereto, the electronic timepiece having a function of displaying a date, comprises a time signal generating circuit which generates a date signal by counting data regarding a date, an ultrasonic motor driving circuit which outputs an ultrasonic motor driving signal for driving an ultrasonic motor according to a date signal output from the time signal generating circuit, the ultrasonic motor having an ultrasonic stator having a piezoelectric element bonded thereto and having an ultrasonic rotor which, upon input of the ultrasonic motor driving signal by the piezoelectric element, is friction driven by the oscillatory waves generating in the ultrasonic wave stator due to the expansion and contraction of the piezoelectric element, a calendar wheel train which rotates due to the rotation of the ultrasonic rotor, a date finger which rotates due to the rotation of the calendar wheel train, a date dial which rotates due to the rotation of the date finger and thereby indicates a date, a transmission wheel which rotates due to the rotation of the ultrasonic rotor, a transmission wheel rotating due to the rotation of the ultrasonic rotor, a contact point spring fixed to the transmission wheel and rotating integrally with the transmission wheel and having a conductivity, a detection pattern which is provided on a printed circuit board and, when the contact point spring rotates, can contact with the contact point spring, and a control circuit which inputs a rotational position detection signal for detecting a circumferential position of the rotation of the transmission wheel which, when the contact point spring has contacted with the detection pattern, is output from the detection pattern.

Also, the present invention has been constructed such that an electronic timepiece according thereto, the electronic timepiece having a function of displaying a date, comprises a time signal generating circuit which generates a date signal by counting data regarding a date, an ultrasonic motor driving circuit which outputs an ultrasonic motor driving signal for operating an ultrasonic motor according to a date signal output from the time signal generating circuit, the ultrasonic motor having an ultrasonic stator having a piezoelectric element bonded thereto and having an ultrasonic rotor which, upon input of the ultrasonic motor driving signal by the piezoelectric element, is friction driven by the oscillatory waves generating in the ultrasonic wave stator due to the expansion and contraction of the piezoelectric element, a calendar wheel train which rotates due to the rotation of the ultrasonic rotor and which has a date finger, a date dial which rotates due to the rotation of the date finger and thereby indicates a date, a transmission wheel which is contained in the calendar wheel train and which rotates due to the rotation of the ultrasonic rotor, a contact point spring fixed to the transmission wheel and rotating integrally with the transmission wheel and having a conductivity, a detection pattern which is provided on a printed circuit board and, when the contact point spring rotates, can contact with the contact point spring, and a control circuit which inputs a rotational position detection signal for detecting a circumferential position of the rotation of the transmission wheel which, when the contact point spring has contacted with the detection pattern, is output from the detection pattern.

Further, the present invention has been constructed such that an electronic timepiece according thereto, the electronic timepiece having an indication wheel, comprises a motor for rotating the indication wheel, a rotating member for rotating the indication wheel according to the rotation of the motor, rotation detecting means for generating a signal regarding a state of rotation of the indication wheel according to the rotation of the rotating member, and motor driving means for controlling the rotation of the motor according to a rotation signal generated from the rotation detecting means.

In the electronic timepiece according to the present invention, the rotating member includes an intermediate date driving wheel which rotates according to the rotation of the motor and a date driving wheel which rotates according to the rotation of the intermediate date driving wheel. With regard to this rotating member, the intermediate date driving wheel may be one, or two or more, in number.

The indication wheel is a member which indicates data regarding a time or calendar, and, for example, is a date dial or day indicator.

In the electronic timepiece according to the present invention, preferably, the rotation detecting means includes a contact point spring provided on the rotating member and a plurality of contact point patterns for detecting a state of rotation of the rotating member by contacting with the contact point spring.

By making such construction, it is possible to reliably detect the rotation of the indication wheel. Also, a rotation detecting mechanism of such indication wheel is small in size.

Further, in the electronic timepiece according to the present invention, preferably, it is arranged that the motor is an ultrasonic motor and the motor driving means outputs a drive signal for driving the ultrasonic motor.

When such construction is made, there is no need to provide a number of reduction wheel trains and therefore it is possible to realize a small-sized electronic timepiece equipped with the indication wheel.

Also, the motor may be a step motor or an electromagnetic motor.

Also, in the electronic timepiece according to the present invention, preferably, the indication wheel or date dial has internal teeth which correspond in number to the indication contents and is equipped with a date jumper for regulating the position in the rotation direction of the indication wheel or date dial by engagement thereof with the internal teeth, the rotating member is equipped with four date finger portions for rotating the indication wheel or date dial, it is arranged that the date jumper regulates the position in the rotation direction of the indication wheel or date dial so that one internal tooth of the indication wheel or date dial may be located on a straight line passing through a rotation center of the indication wheel or date dial and a rotation center of the rotating member, and two of the four date finger portions are positioned, in a state where the ultrasonic motor or motor is being stopped, so as to be located symmetrically about the straight line as a symmetry axis.

And, in the electronic timepiece according to the present invention, preferably, it is arranged that when having been rotated, the date finger can rotate the indication wheel or date dial and, even when having rotated the indication wheel or date dial, the date finger cannot be rotated.

Also, in the electronic timepiece according to the present invention, preferably, it is arranged that through the intermeshing between the internal teeth of the date dial and the date finger as well as through the index torque of the ultrasonic motor or motor the date finger cannot be rotated even when the date dial is rotated.

Further, in the electronic timepiece according to the present invention, preferably, the date finger has lock tooth configurations at its forward end portions.

By making such construction, it is possible to realize an electronic timepiece which enables the decrease in index torque of the ultrasonic motor or motor and enables the effective stop of the rotation of the indication wheel or date dial due to an impact.

DETAILED DESCRIPTION OF THE PREFERRED EMBODIMENTS

(1) First Embodiment

Figure 1:
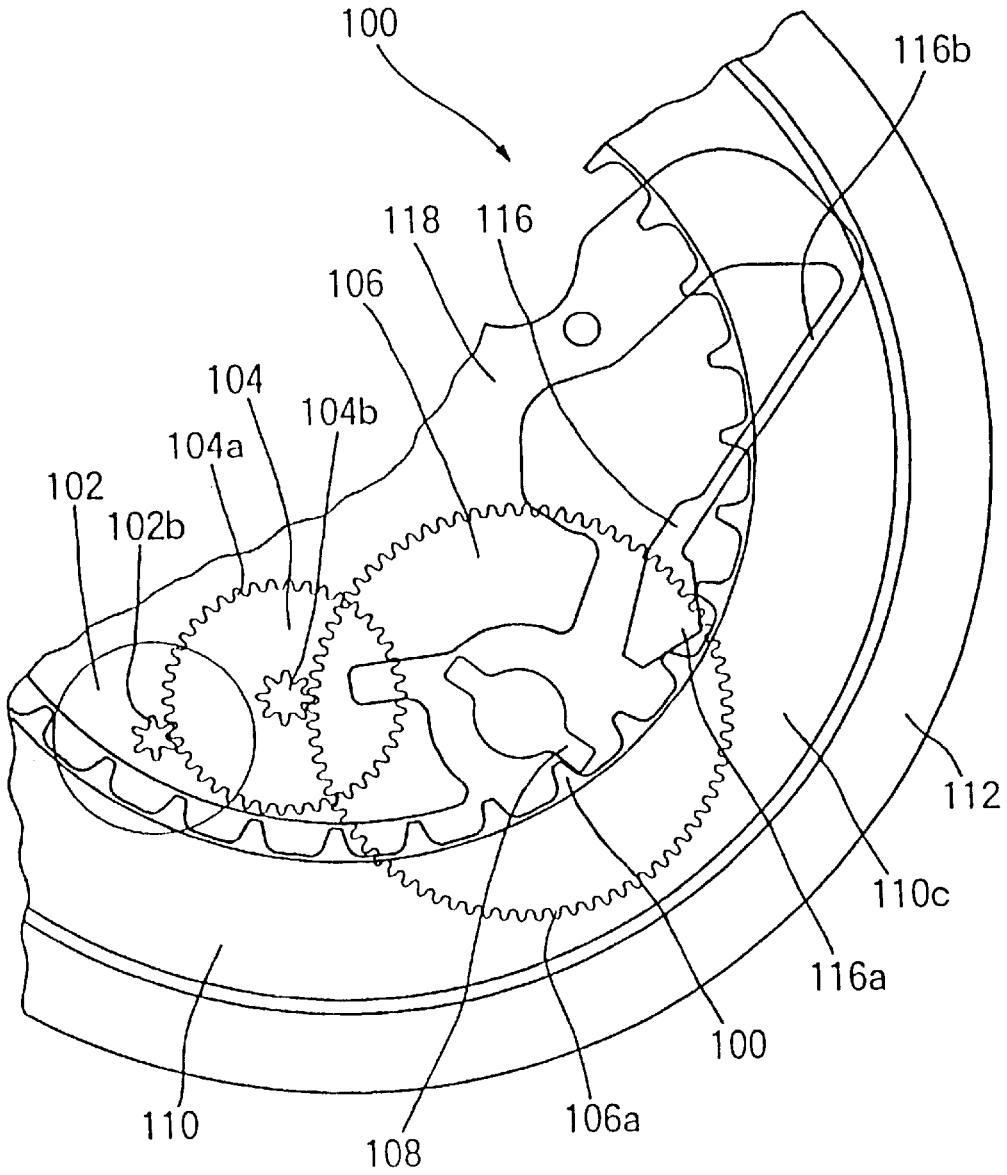
FIG. 1 is a schematic plan view (opened-up view) illustrating a calendar mechanism portion of a first embodiment of an electronic timepiece according to the present invention.
Figure 2:
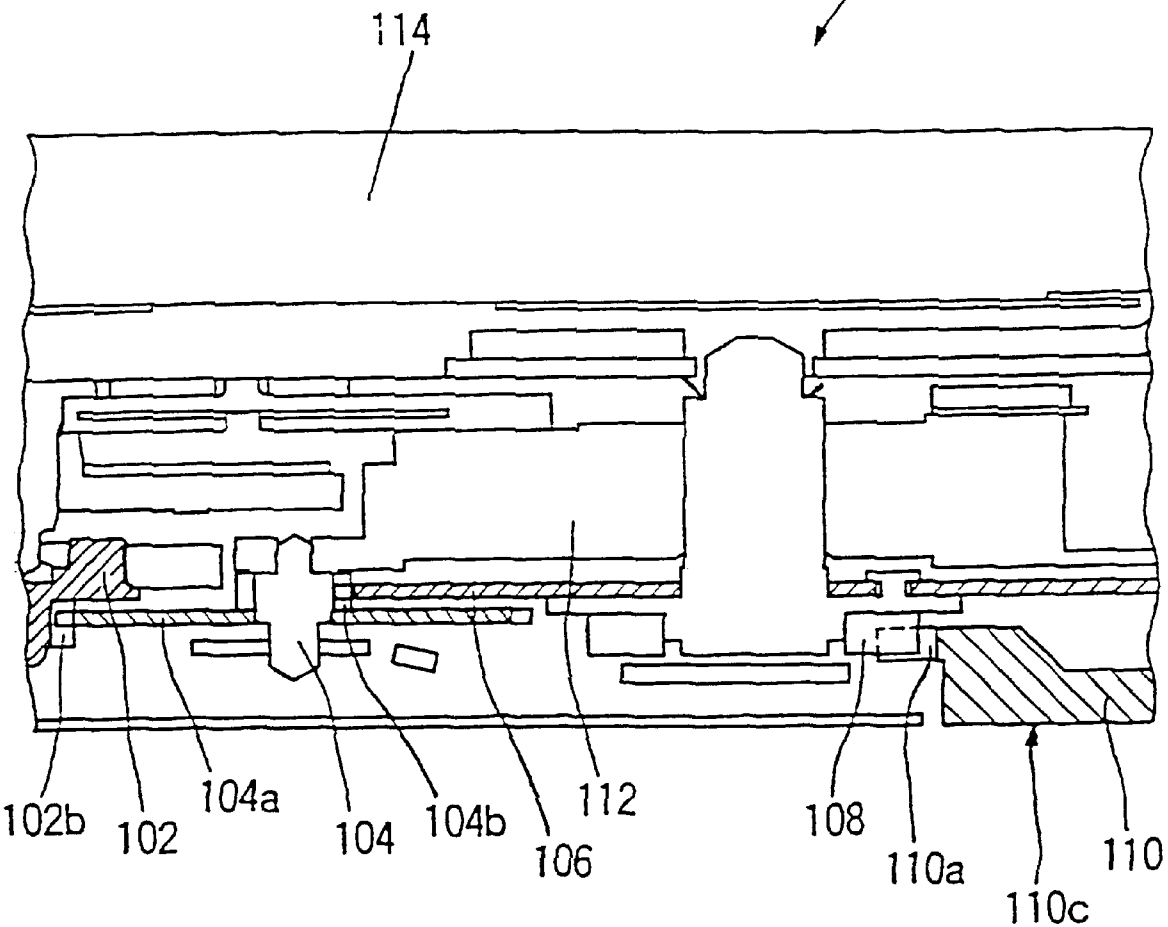
FIG. 2 is a schematic sectional view illustrating the calendar mechanism portion of the first embodiment of the electronic timepiece according to the present invention.

In FIGS. 1 and 2, an ultrasonic motor of a calendar equipped electronic timepiece 100 according to a first embodiment of the present invention includes an ultrasonic rotor 102. An ultrasonic rotor pinion 102*b* of the ultrasonic rotor 102 is meshed with an intermediate date driving gear wheel 104*a* of an intermediate date driving wheel 104. An intermediate date driving pinion 104*b* of an intermediate date driving wheel 104 is meshed with a date driving gear wheel 106a of a date driving wheel 106.

A date finger 108 is provided on the date driving wheel 106 and is rotated through the rotation of the date driving wheel 106 simultaneously therewith. The date finger 108, as illustrated in FIG. 1, may be provided two in number, or one, or three or more, in number.

A date dial 110 having thirty one date dial teeth 110*a* is rotatably incorporated into a main plate 112. Numerical values from '1' to '31' (not illustrated) are provided on an indication surface 110c of the date dial 110. A battery 114 is incorporated on a side opposite to that on which the date dial 110 is mounted.

A date jumper 116 is formed integrally with a date dial holder 118. A regulating portion 116*a* of the date jumper 116 regulates date dial teeth 110*a*. The date jumper 116 has a date jumper spring 116*b*.

Figure 3:
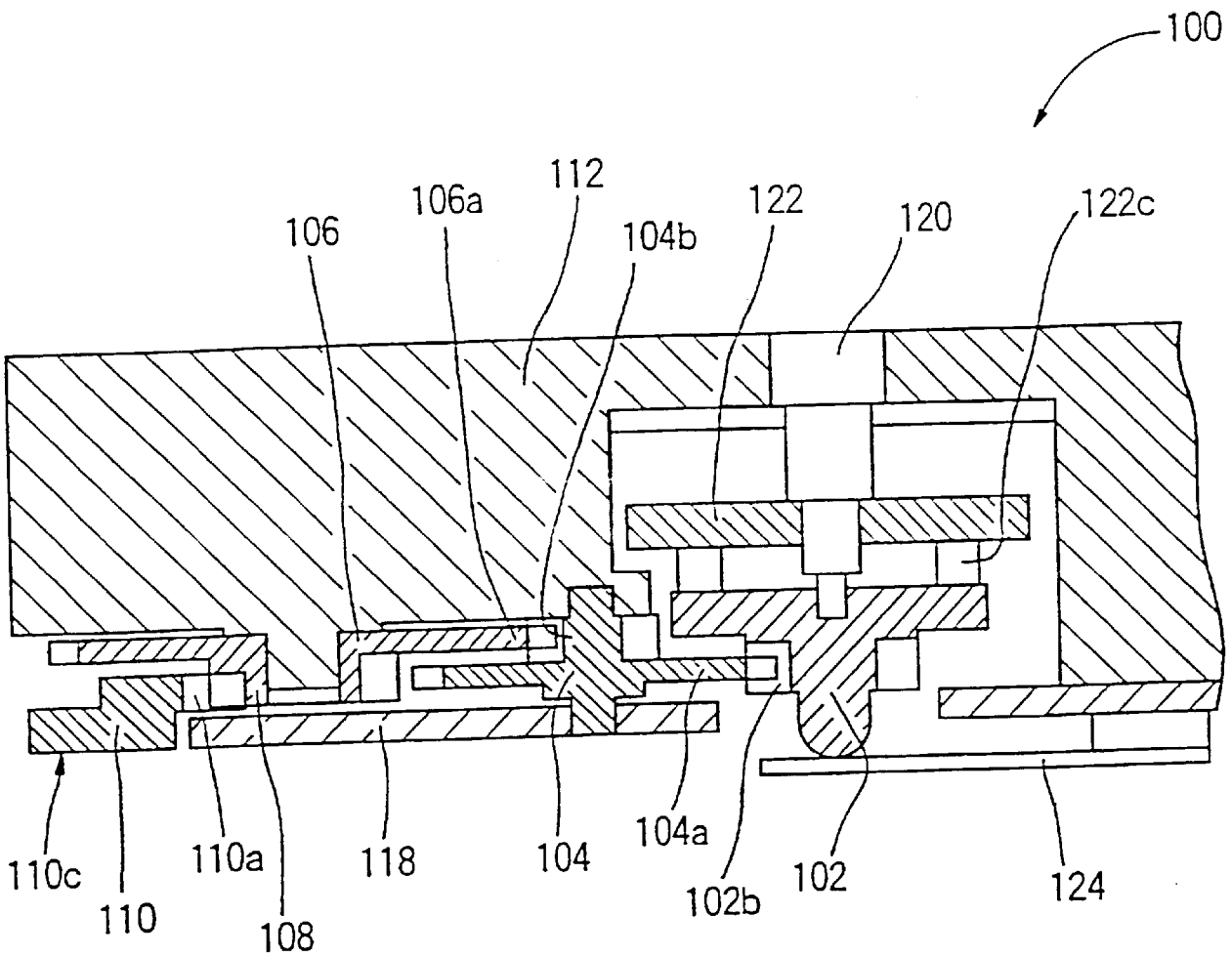
FIG. 3 is a schematic sectional view illustrating the calendar mechanism portion having a modified structure of the first embodiment of the electronic timepiece according to the present invention.

In another structure illustrated in FIG. 3, an ultrasonic rotor axle 120 is fixed to the main plate 112.

An ultrasonic stator 122 is fixed to an ultrasonic rotor axle 120. A piezoelectric element (not illustrated) is secured to the ultrasonic stator 122. An ultrasonic rotor 102 is rotatably mounted on the ultrasonic rotor axle 120 and is in contact with displacement enlarging comb teeth 122*c* of the ultrasonic stator 122. An ultrasonic pressurizing spring 124 presses the ultrasonic rotor 102 so as to apply an elastic force to the displacement enlarging comb teeth 122*c*.

The intermediate date driving wheel 104 is rotatably incorporated between the main plate 112 and the date dial holder 118. The ultrasonic rotor pinion 102*b* of the ultrasonic rotor 102 is meshed with the intermediate date driving gear wheel 104*a* of the intermediate date driving wheel 104. The date driving wheel 106 is rotatably incorporated into the main plate 112. The intermediate date driving pinion 104*b* of the intermediate date driving wheel 104 is meshed with the date driving gear wheel 106*a* of the date driving wheel 106.

The date finger 108 is provided on the date driving wheel 106 and rotates due to the rotation of the date driving wheel 106 simultaneously therewith. The date dial 110 having the thirty one date dial teeth 110*a* is rotatably incorporated into the main plate 112. Numerical values from '1' to '31' (not illustrated) are provided on the indication surface 110c of the date dial 110.

Next, the operation of the calendar equipped electronic timepiece 100 according to the present invention will be explained.

Figure 4:
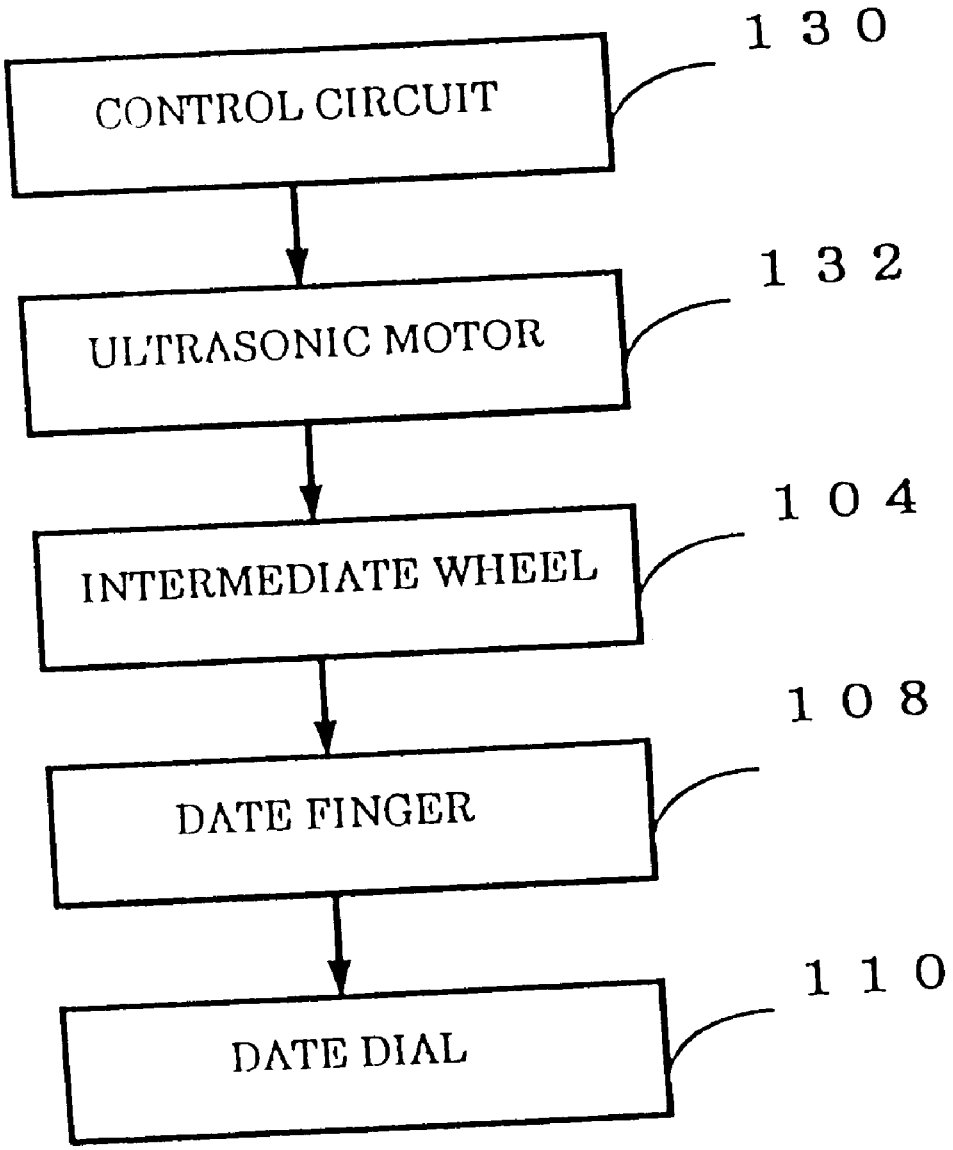
FIG. 4 is a schematic block diagram illustrating the calendar mechanism portion of the first embodiment of the electronic timepiece according to the present invention.

Referring to FIG. 4, a control circuit 130 has a time signal generating circuit for generating a date signal by counting data regarding a time and a date, and, further, has an ultrasonic motor driving circuit which outputs an ultrasonic motor driving signal for rotating the ultrasonic motor according to a date signal output from the time signal generating circuit.

Figure 35:
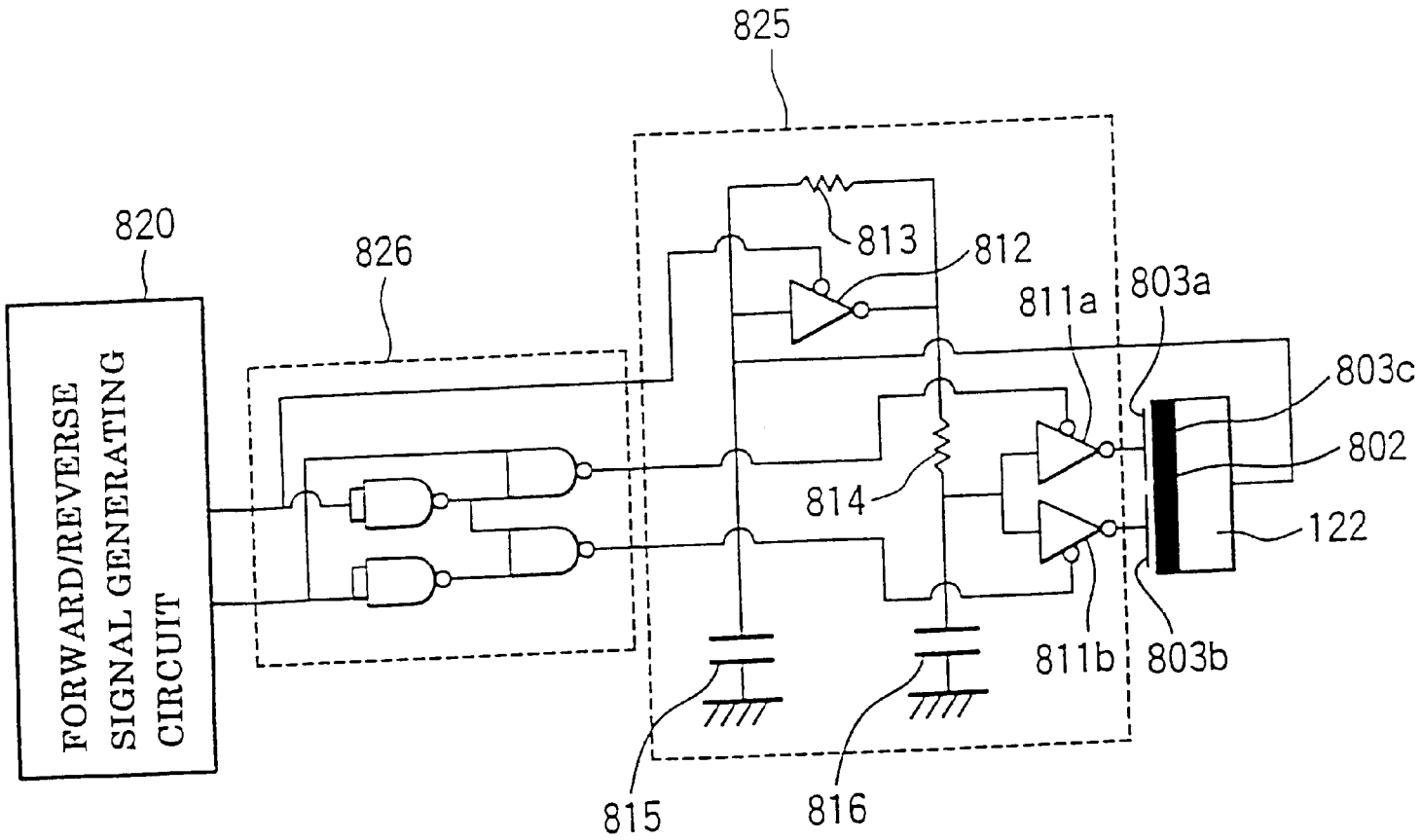
FIG. 35 is a block diagram illustrating the construction of a drive circuit for an ultrasonic motor of the electronic timepiece according to the present invention.

Referring to FIG. 35, to one surface of the ultrasonic stator 122 constituting a vibrating member of the ultrasonic motor there is bonded a piezoelectric element 802 having formed thereon two sets of electrode groups 803*a* and 803*b* each comprising a plurality of electrodes. An oscillation drive circuit 825 is connected to the electrode groups,803*a* and 803*b* of the piezoelectric element 802. An inverter 812 serves as an inverting power amplifier for inversely amplifying an electric signal which is excitation data from the electrode 803*c* or ultrasonic stator 122 formed on the opposite surface to the surface of the piezoelectric element 802 on which the electrode groups 803*a* and 803*b*. A resistor 813 is connected in parallel to the inverter 812 and stabilizes the operating point of the inverter 812.

An output terminal of the inverter 812 is connected to input terminals of two buffers 811*a* and 811*b* through a resistor 814. Respective output terminals of the two buffers 811*a* and 811*b* are connected to the electrode groups 803*a* and 803*b* of the piezoelectric element 802, respectively. A capacitor 815 is connected at one end to the input terminal of the inverter 812 and a capacitor 816 is connected at one end to the output terminal of the inverter 812 through the resistor 814. The respective other ends of the capacitors 815 and 816 are grounded, whereby phase adjustment within the oscillation drive circuit 825 is performed.

Each of the inverter 812 and buffers 811*a* and 811*b* has a control terminal as well as the input and output terminals and therefore is of a tri-state structure enabling the output terminal thereof to be brought to a high impedance state according to a signal to be input to this control terminal.

Forward/reverse signal generating means 820 outputs to a switching circuit 826 a forward/reverse signal for setting the rotation direction of the ultrasonic motor. The output terminal of the switching circuit 826 is connected to the output terminal of each of the tri-state buffers 811*a* and 811*b* and tri-state inverter 812 of the oscillation drive circuit 825. The switching circuit 826 causes one of the tri-state buffers 811*a* and 811*b* to function as an ordinary buffer and disables the other thereof by bringing the output terminal thereof into a high impedance state.

The ultrasonic stator 122 is driven by the tristate buffer functioning as an ordinary buffer, selected according to the output signal of the switching circuit 826. The ultrasonic stator 122 is driven only by the tristate buffer permitted to function as an ordinary buffer by the switching circuit 826 and, when the tri-state buffer permitted to function as an ordinary buffer by the switching circuit 826 is exchanged, the rotation direction of the ultrasonic motor is reversed.

The tri-state inverter can be brought into a state where the output terminal thereof has a high impedance by the output signal from the switching circuit 826 output according to the output from the forward/reverse generating means 820 and, when the tristate inverter is disabled thereby, the both tri-state buffers 811*a* and 811*b* are disabled to thereby enable the ultrasonic motor to stop.

Figure 36:
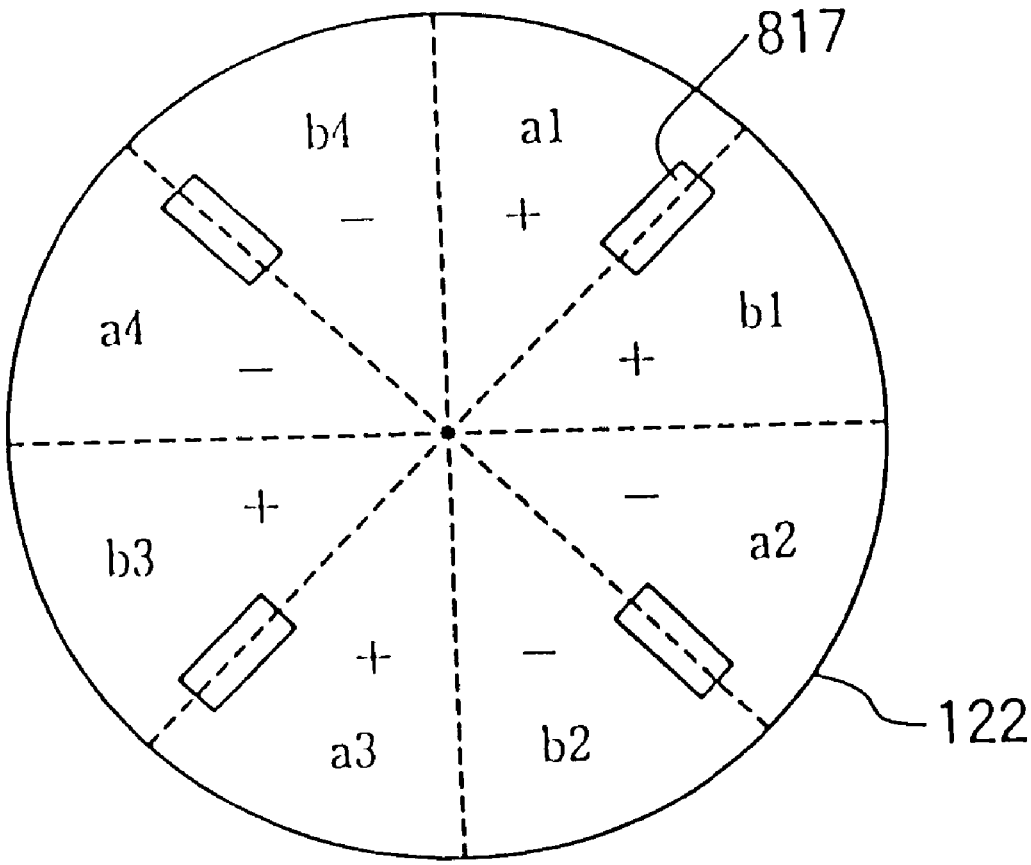
FIG. 36 is a plan view illustrating an ultrasonic stator of an ultrasonic motor of of the electronic timepiece according to the present invention.
Figure 37:
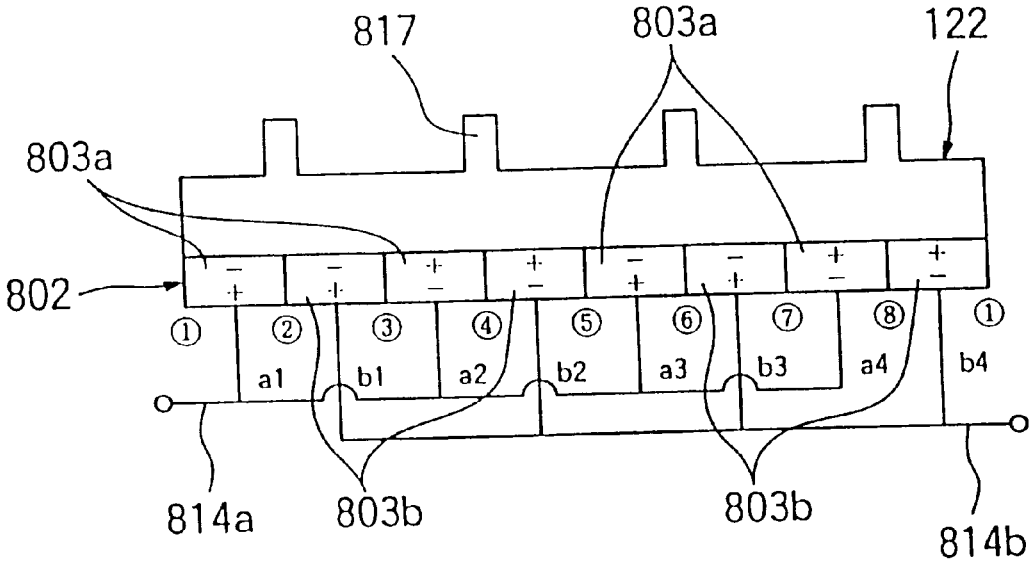
FIG. 37 is a sectional view illustrating the ultrasonic stator of the ultrasonic motor according to the present invention.
Figure 38:
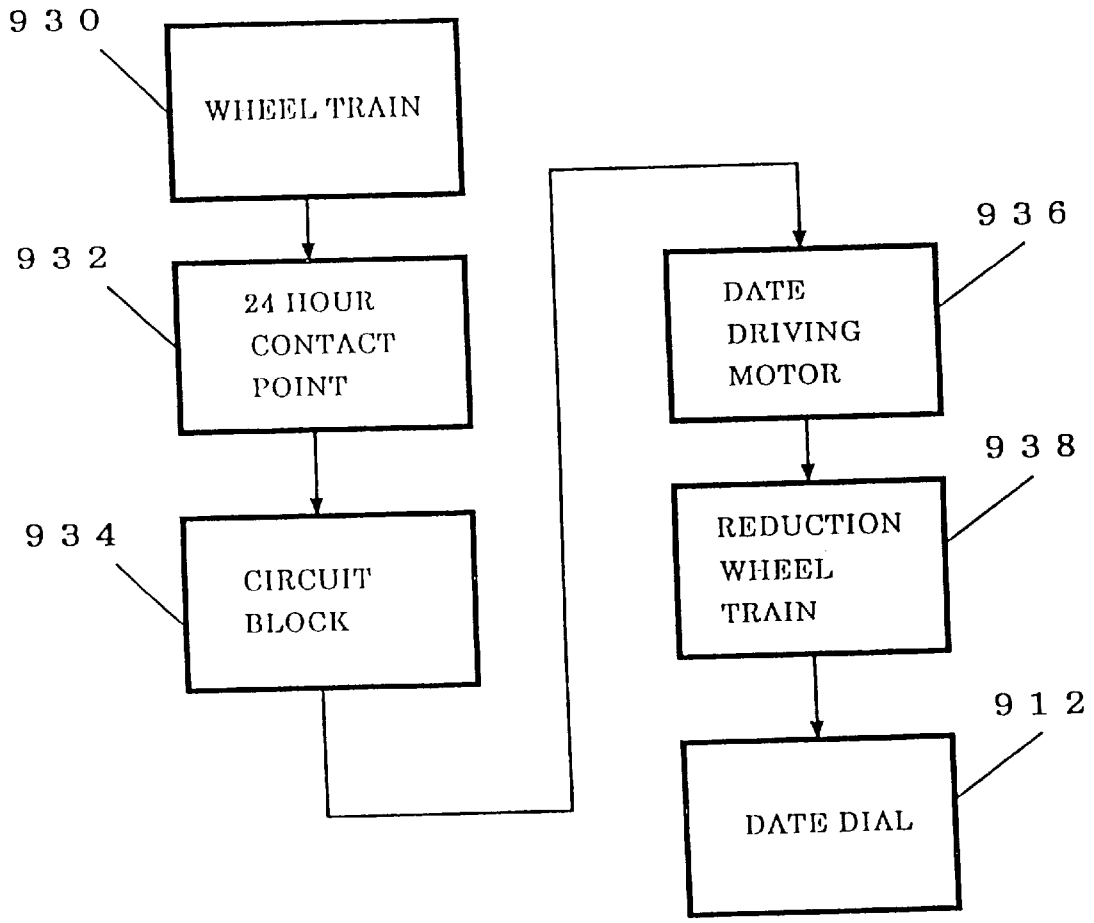
FIG. 38 is a schematic block diagram illustrating the construction of a conventional electronic timepiece.

Referring to FIGS. 36 and 37, the disc-shaped piezoelectric element 802 is bonded to the flat surface of the disshaped ultrasonic stator 122 by adhesion, thin film forming or other means. Ultrasonic waves excite standing waves of two wavelengths in the circumferential direction of the ultrasonic stator 122 to thereby drive the ultrasonic rotor. Eight-segmented electrodes whose number is equal to four times as large as the number of the waves are alternately subjected to polarization treatments (+) and (−) so that every other electrodes form each of the first electrode group 803*a* and the second electrode group 803*b* in the circumferential direction on one flat surface of the piezoelectric element 802 as illustrated in FIGS. 36 and 37.

The first electrode group 803*a* comprises electrodes a1, a2, a3 and a4, and the respective electrodes are short-circuited to one another by first circuit means 814*a*. The second electrode group 803*b* comprises electrodes b1, b2, b3 and b4, and the respective electrodes are short-circuited to one another by second circuit means 814*b*.

In the Figures, (+) and (−) represent the direction of the polarization treatment, and positive electric field and negative electric field are respectively applied to the bonding surface side of the piezoelectric element 802 which is bonded to the ultrasonic stator 122 to perform the respective polarization treatments.

Projections (comb teeth) 817 for enlarging the displacement of the ultrasonic stator and transmitting a motive power from the ultrasonic stator to the ultrasonic rotor are provided on the surface of the ultrasonic stator 122 at the positions adjacent to every other boundary portions of the respective electrodes.

A high-frequency voltage generated by the oscillation drive circuit 825 is applied to either one of the two electrode groups 803*a* and 803*b* to drive the ultrasonic stator 122. The rotation direction of the ultrasonic motor is switched according to which one of the electrode groups the ultrasonic stator 122 is drive by.

Preferably, the ultrasonic motor used in the calendar equipped electronic timepiece according to the present invention is driven by the construction comprising the above-described driving circuit, piezoelectric element and ultrasonic stator. However, it can be also driven by another construction.

Upon its output of the counted result that the time is twelve o'clock at night, the control circuit 130 outputs an ultrasonic motor driving signal to the ultrasonic motor (USM) 132. Namely, the control circuit 130 is so constructed as to output an ultrasonic motor driving signal for rotating the date dial 110 once a day through an angle of 360°/31, i.e. the angle corresponding to a 1/31 rotation.

The control circuit 130 counts the 'year', 'month', 'day' and time. And, when the control circuit 130 outputs the counted result that the time is twelve o'clock at night on an ordinary day, the control circuit outputs an ultrasonic motor driving signal corresponding to the ordinary day to the ultrasonic motor (USM) 132. Namely, the control circuit 130 is so constructed as to output an ultrasonic motor driving signal for rotating the date dial 110 once a day through an angle of 360°/31, i.e. the angle corresponding to a 1/31 rotation.

Upon its output of the counted result that the time is twelve o'clock at night on the first day of March of the year which is not a leap year, e.g. on Mar. 1, 1997, the control circuit 130 outputs an ultrasonic motor driving signal corresponding to the first day of March to the ultrasonic motor (USM) 132. Namely, the control circuit 130 is so constructed as to output an ultrasonic motor driving signal for rotating the date dial 110 through an angle of (360°/31)×4, i.e. the angle corresponding to a 4/31 rotation. Accordingly, the data regarding the 'day' indicated by the date dial 110 changes from the indication '28' corresponding to on the 28th day of February to the indication '1' corresponding to the first day of March without indicating '29', '30' and '31'.

Also, upon its output of the counted result that the time is twelve o'clock at night on the first day of March of the year which is a leap year, e.g. on Mar. 1, 2000, the control circuit 130 outputs an ultrasonic motor driving signal corresponding to the first day of March of the leap year to the ultrasonic motor (USM) 132. Namely, the control circuit 130 is so constructed as to output an ultrasonic motor driving signal for rotating the date dial 110 through an angle of (360°/31)×3, i.e. the angle corresponding to a 3/31 rotation. Accordingly, the data regarding the 'day' indicated by the date dial 110 changes from the indication '29' corresponding to on the 29th day of February to the indication '1' corresponding to the first day of March without indicating '30' and '31'.

Also, upon its output of the counted result that the time is twelve o'clock at night on a day coming next to the end day of an 'even month', i.e. '30th day', for example, the first day of May, the control circuit 130 outputs an ultrasonic motor driving signal corresponding to the first day of May to the ultrasonic motor (USM) 132. Namely, the control circuit 130 is so constructed as to output an ultrasonic motor driving signal for rotating the date dial 110 through an angle of (360°/31)×2, i.e. the angle corresponding to a 2/31 rotation. Accordingly, the data regarding the 'day' indicated by the date dial 110 changes from the indication '30' corresponding to the 30th day of April to the indication '1' corresponding to the first day of May without indicating '31'.

This construction can be similarly applied to the other embodiments of the present invention.

By making such construction, the calendar equipped electronic timepiece of the present invention constitutes a so-called "Auto-Calendar Timepiece" or "Perpetual Calendar Timepiece".

The ultrasonic motor (USM) 132 has the ultrasonic stator having the piezoelectric element bonded thereto and has the ultrasonic rotor which is friction driven by the oscillatory waves that are generated in the ultrasonic stator due to the expansion and contraction of the piezoelectric element through the input of the ultrasonic motor driving signal.

On the surface of the piezoelectric element there are formed at least two sets of the electrode groups each comprising a plurality of electrodes. The control circuit 130 has at least two power amplifiers, the respective output terminals of which are respectively connected to the two sets of electrode groups of the piezoelectric element and individually independently excite and drive the respective electrodes.

The ultrasonic rotor of the ultrasonic motor (USM) 132 rotates upon input of the ultrasonic motor driving signal by the electrode group of the piezoelectric element. Due to the rotation of the ultrasonic rotor, the intermediate wheel, i.e. intermediate date driving wheel 104 rotates. Upon rotation of the intermediate date driving wheel 104, the date finger 108 rotates and causes the date dial 110 to rotate.

It is to be noted that the calendar equipped timepiece of the present invention can be also equipped with a calendar indication wheel for indicating other data regarding a calendar such as, for example, 'year', 'month', 'day of the week', 'six weekdays' or the like.

For example, in the construction having a day of the week dial for indicating a 'day of the week', the day of the week dial (not illustrated) having 28 day of the week teeth (not illustrated) is rotatably incorporated into the main plate 112.

14 kinds of character data are provided on the indication surface of the day of the week dial. Namely, 'Getsu' (as expressed in a Japanese kanji character and indicating Monday - - - added), 'MON'; 'Kah' (as similarly expressed and indicating Tuesday - - - added), 'TUE'; 'Sui' (as similarly expressed and indicating Wednesday - - - added), 'WED'; 'Moku' (as similarly expressed and indicating Thursday - - - added), 'THU'; 'Kin' (as similarly expressed and indicating Friday - - - added), 'FRI'; 'Do' (as similarly expressed and indicating Saturday - - - added), 'SAT'; and 'Nichi' (as similarly expressed and indicating Sunday - - - added), 'SUN'.

The control circuit 130 has a time signal generating circuit for generating a time signal by counting data regarding a time and a day of the week, and, further, has an ultrasonic motor driving circuit which outputs an ultrasonic motor driving signal for rotating the ultrasonic motor according to a day of the week signal output from the time signal generating circuit.

Upon its output of the counted result that the time is twelve o'clock at night, the control circuit 130 outputs an ultrasonic motor driving signal to the ultrasonic motor (USM) 132. Namely, the control circuit 130 is so constructed as to output an ultrasonic motor driving signal for rotating the day of the week dial once a day through an angle of 369°/14, i.e. the angle corresponding to a 1/14 rotation.

Accordingly, if initially setting day of the weeks as expressed in Japanese languages or as expressed in English languages beforehand, the day of the week data can be indicated by the day of the week wheel, as the necessity arises, in Japanese or English languages.

Also, for example, in the construction having a month dial for indicating a 'month', the month dial (not illustrated) having 36 month dial teeth (not illustrated) is rotatably incorporated into the main plate 112. 12 kinds of numerical values from '1' to '12' are sequentially provided three sets on the indication surface of the month dial. Namely, 36 numerical values in total are provided on the indication surface of the month dial in such a way as '1 to 12', '1to 12' and '1 to 12'.

The control circuit 130 has a time signal generating circuit for generating a month signal by counting data regarding a time and a month, and, further, has an ultrasonic motor driving circuit which outputs an ultrasonic motor driving signal for rotating the ultrasonic motor according to a month signal output from the time signal generating circuit.

Upon its output of the counted result that the time is the first day of a relevant month, the control circuit 130 outputs an ultrasonic motor driving signal to the ultrasonic motor (USM) 132. Namely, the control circuit 130 is so constructed as to output an ultrasonic motor driving signal for rotating the month dial once a month through an angle of 360°/36, i.e. the angle corresponding to a 1/36 rotation.

Accordingly, any month can be indicated by the month dial.

Indication of the 'year', 'day of the week' or the like also becomes possible with the use of a similar construction.

(2) Second Embodiment

Figure 5:
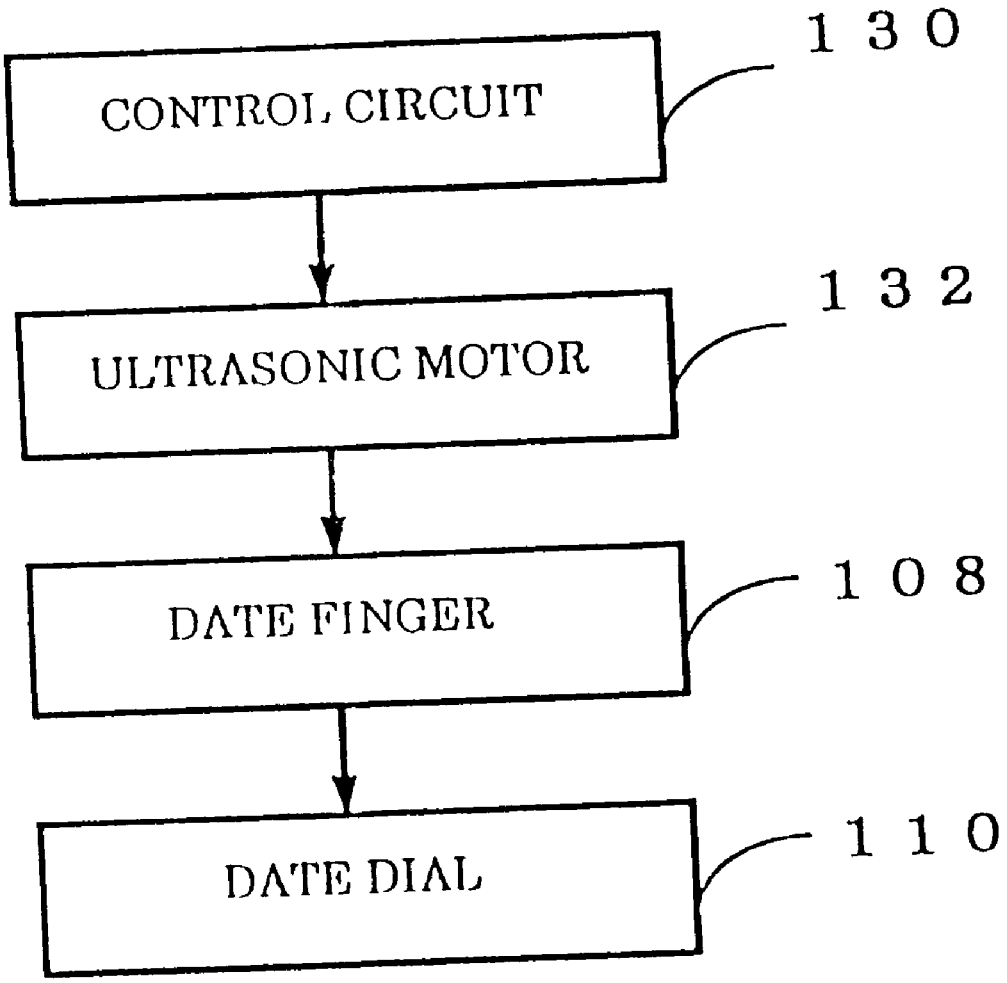
FIG. 5 is a schematic block diagram illustrating the calendar mechanism portion of a second embodiment of the electronic timepiece according to the present invention.
Figure 6:
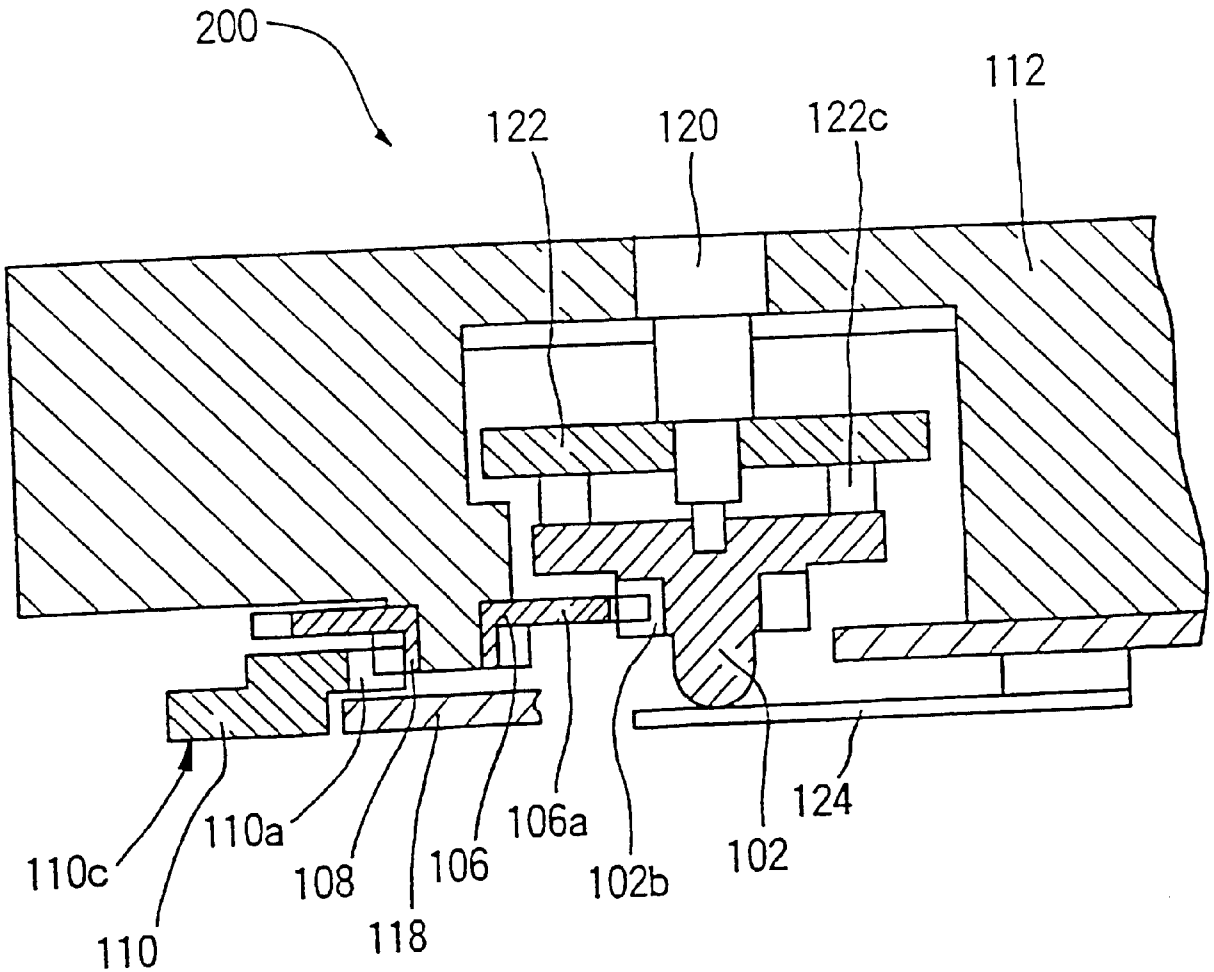
FIG. 6 is a schematic sectional view illustrating the calendar mechanism portion of the second embodiment of the electronic timepiece according to the present invention.

Referring to FIGS. 5 and 6, the structure of the ultrasonic motor of a calendar equipped electronic timepiece according to a second embodiment of the present invention is similar to that of the ultrasonic motor of the calendar equipped electronic timepiece 100 according to the first embodiment of the present invention illustrated in FIG. 3.

The date driving wheel 106 is rotatably incorporated into the main plate 112. The ultrasonic rotor pinion 102*b* of the ultrasonic rotor 102 is meshed with the date driving gear wheel 106*a* of the date driving wheel 106.

The date finger 108 is provided on the date driving wheel 106 and rotates due to the rotation of the date driving wheel 106 simultaneously therewith. The date dial 110 having the thirty one date dial teeth 110*a* is rotatably incorporated into the main plate 112. Numerical values from '1' to '31' (not illustrated) are provided on the indication surface 110c of the date dial 110.

The calendar equipped electronic timepiece 200 is equipped with a date jumper (not illustrated). A regulating portion of the date jumper regulates the date dial teeth 110*a*.

Next, the operation of the calendar equipped electronic timepiece 200 of the present invention will be explained.

Referring to FIG. 5, the control circuit 130 has a time signal generating circuit for generating a date signal by counting data regarding a time and a date, and, further, has an ultrasonic motor driving circuit which outputs an ultrasonic motor driving signal for rotating the ultrasonic motor (USM) 132 according to a date signal output from the time signal generating circuit.

Upon its output of the counted result that the time is twelve o'clock at night, the control circuit 130 outputs an ultrasonic motor driving signal to the ultrasonic motor (USM) 132. Namely, the control circuit 130 is so constructed as to output an ultrasonic motor driving signal for rotating the date dial 110 once a day through an angle of 360°/31, i.e. the angle corresponding to a 1/31 rotation.

The ultrasonic rotor of the ultrasonic motor (USM) 132 rotates upon input of the ultrasonic motor driving signal by the electrode group of the piezoelectric element. Due to the rotation of the ultrasonic rotor, the date finger 108 rotates and causes the date dial 110 to rotate. (3)

(3) Third Embodiment

Figure 7:
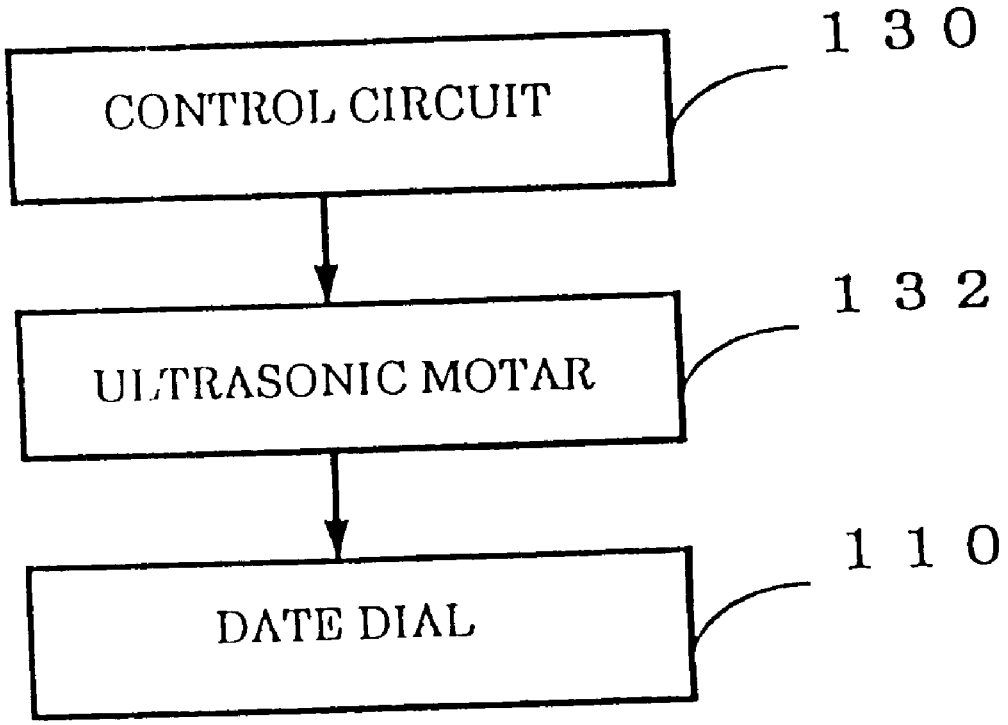
FIG. 7 is a schematic block diagram illustrating the calendar mechanism portion of a third embodiment of the electronic timepiece according to the present invention.
Figure 8:
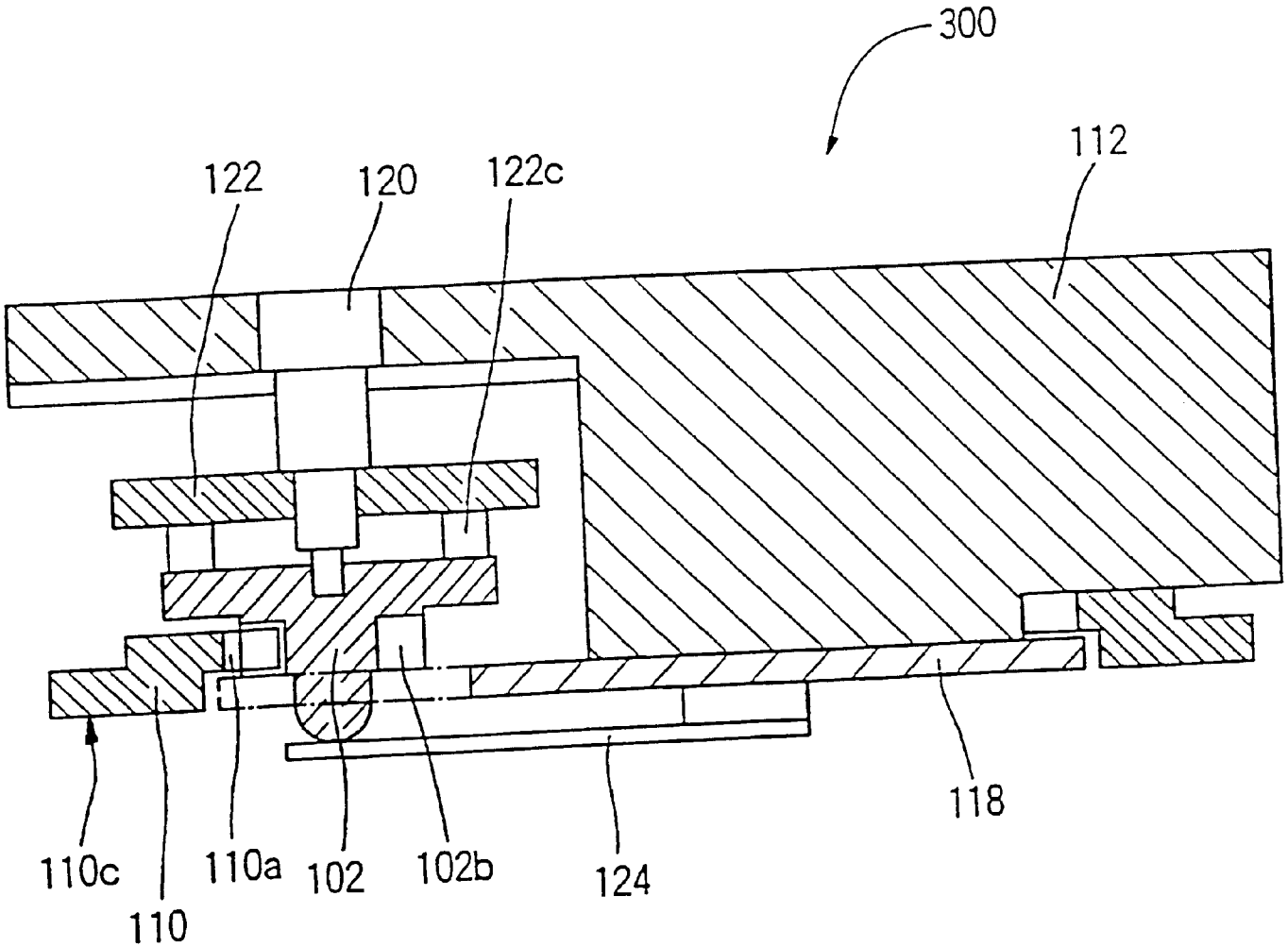
FIG. 8 is a schematic sectional view illustrating the calendar mechanism portion of the third embodiment of the electronic timepiece according to the present invention.

Referring to FIGS. 7 and 8, the structure of the ultrasonic motor of a calendar equipped electronic timepiece 300 according to a third embodiment of the present invention is similar to that of the ultrasonic motor (USM) 132 of the calendar equipped electronic timepiece 100 of the present invention illustrated in FIG. 3.

The date dial 110 is rotatably incorporated into the main plate 112. The ultrasonic rotor pinion 102*b* of the ultrasonic rotor 102 is meshed with the date dial teeth 110*a*. Numerical values from '1' to '31' (not illustrated) are provided on the indication surface 110*c* of the date dial 110.

The calendar equipped electronic timepiece 300 is equipped with a date jumper (not illustrated). A regulating portion of the date jumper regulates the date dial teeth 110*a*.

Next, the operation of the calendar equipped electronic timepiece 300 of the present invention will be explained.

Referring to FIG. 7, the control circuit 130 has a time signal generating circuit for generating a date signal by counting data regarding a time and a date, and, further, has an ultrasonic motor driving circuit which outputs an ultrasonic motor driving signal for rotating the ultrasonic motor (USM) 132 according to a date signal output from the time signal generating circuit.

Upon its output of the counted result that the time is twelve o'clock at night, the control circuit 130 outputs an ultrasonic motor driving signal to the ultrasonic motor (USM) 132. Namely, the control circuit 130 is so constructed as to output an ultrasonic motor driving signal for rotating the date dial 110 once a day through an angle of 360°/31, i.e. the angle corresponding to a 1/31 rotation.

The ultrasonic rotor of the ultrasonic motor (USM) 132 rotates upon input of the ultrasonic motor driving signal by the electrode group of the piezoelectric element. Due to the rotation of the ultrasonic rotor, the date dial 110.

(4) Fourth Embodiment

Figure 9:
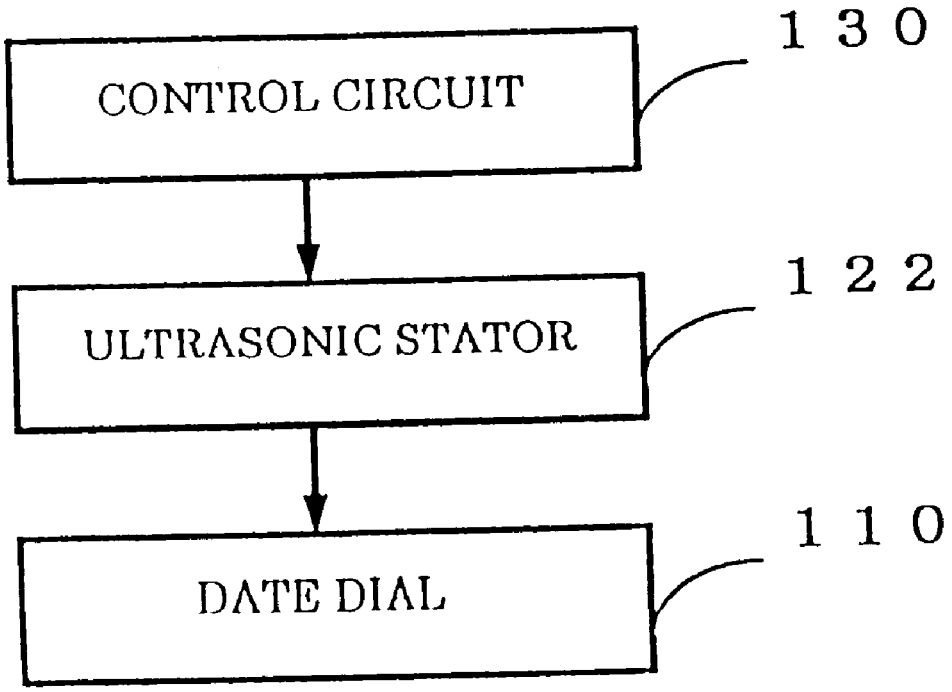
FIG. 9 is a schematic block diagram illustrating the calendar mechanism portion of a fourth embodiment of the electronic timepiece according to the present invention.
Figure 10:
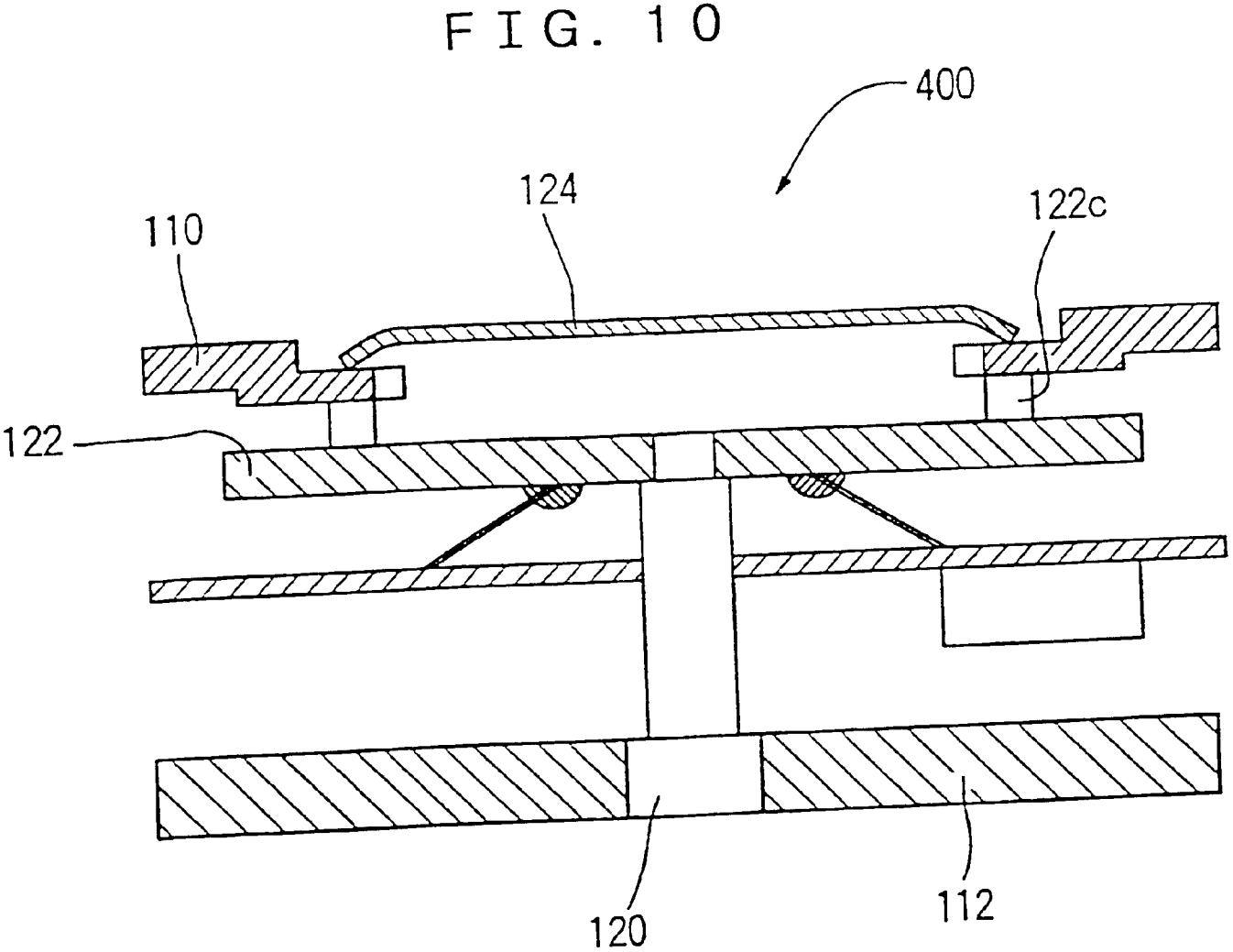
FIG. 10 is a schematic sectional view illustrating the calendar mechanism portion of the fourth embodiment of the electronic timepiece according to the present invention.

In FIGS. 9 and 10, the ultrasonic rotor axle 120 of a calendar equipped electronic timepiece according to a fourth embodiment of the present invention is fixed to the main plate 112. An ultrasonic stator 122 (USM stator) 122 is fixed to the ultrasonic rotor axle 120. A piezoelectric element (not illustrated) is secured to the ultrasonic stator 122. The date dial 110 is in contact with the displacement enlarging comb teeth 122*c* of the ultrasonic stator 122. Namely, the date dial 110 constitutes the ultrasonic rotor 102.

An ultrasonic pressurizing spring 124 presses the date dial 110 so as to apply an elastic force to the displacement enlarging comb teeth 122*c*.

The calendar equipped electronic timepiece 400 is equipped with a date jumper (not illustrated). A regulating portion of the date jumper regulates the date dial teeth 110*a*.

Next, the operation of the calendar equipped electronic timepiece 400 of the present invention will be explained.

Referring to FIG. 9, the control circuit 130 has a time signal generating circuit for generating a date signal by counting data regarding a time and a date, and, further, has an ultrasonic motor driving circuit which outputs an ultrasonic motor driving signal for rotating the ultrasonic motor according to a date signal output from the time signal generating circuit.

Upon its output of the counted result that the time is twelve o'clock at night, the control circuit 130 outputs an ultrasonic motor driving signal to the ultrasonic motor (USM) 132. Namely, the control circuit 130 is so constructed as to output an ultrasonic motor driving signal for rotating the date dial 110 once a day through an angle of 360°/31, i.e. the angle corresponding to a 1/31 rotation.

The ultrasonic motor (USM) has the ultrasonic stator 122 having the piezoelectric element bonded thereto. The date dial 110 is friction driven by the oscillatory waves that are generated in the ultrasonic stator due to the expansion and contraction of the piezoelectric element through its input of the ultrasonic motor driving signal.

(5) Fifth Embodiment

Figure 11:
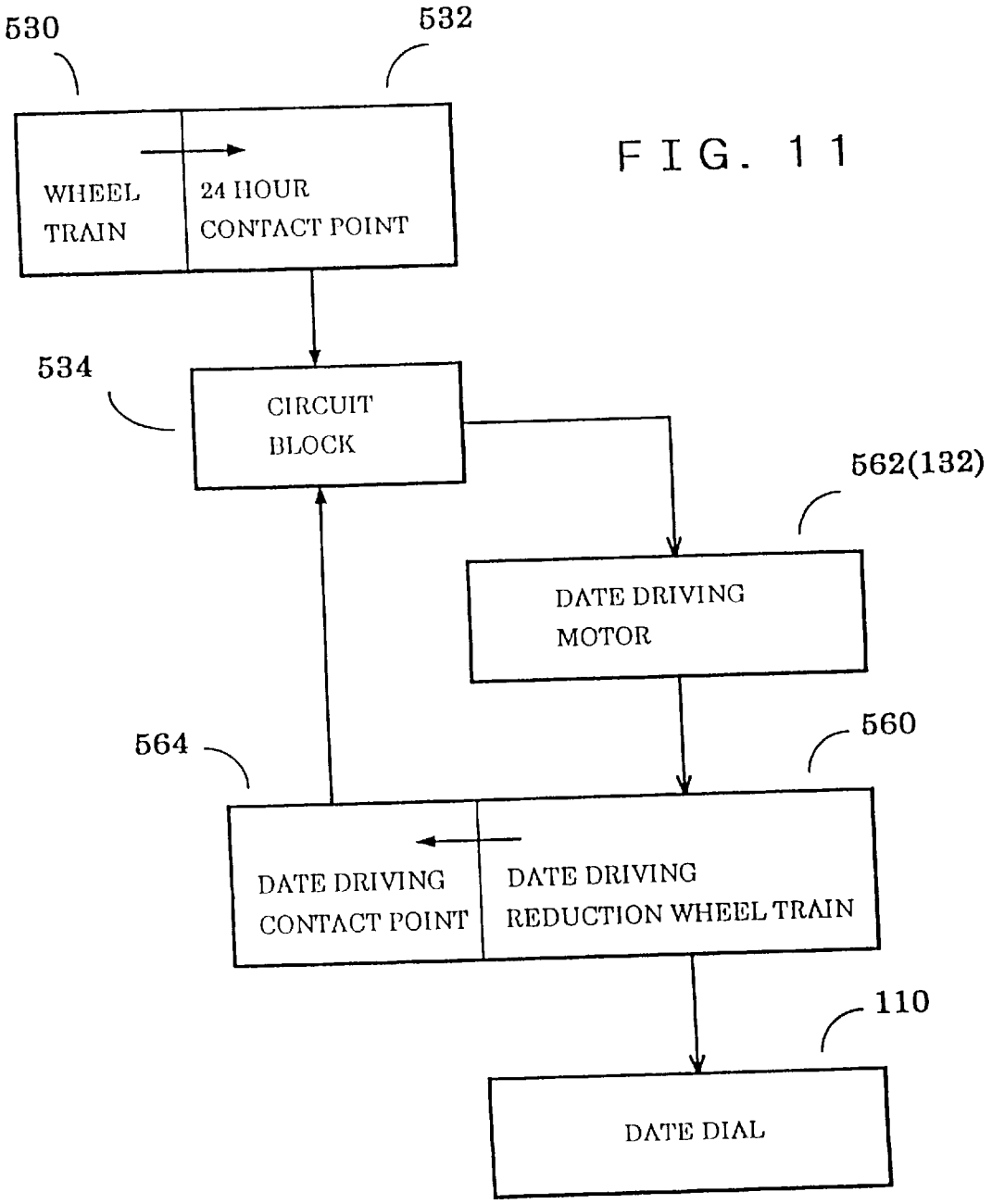
FIG. 11 is a schematic block diagram illustrating the calendar mechanism portion of a fifth embodiment of the electronic timepiece according to the present invention.
Figure 12:
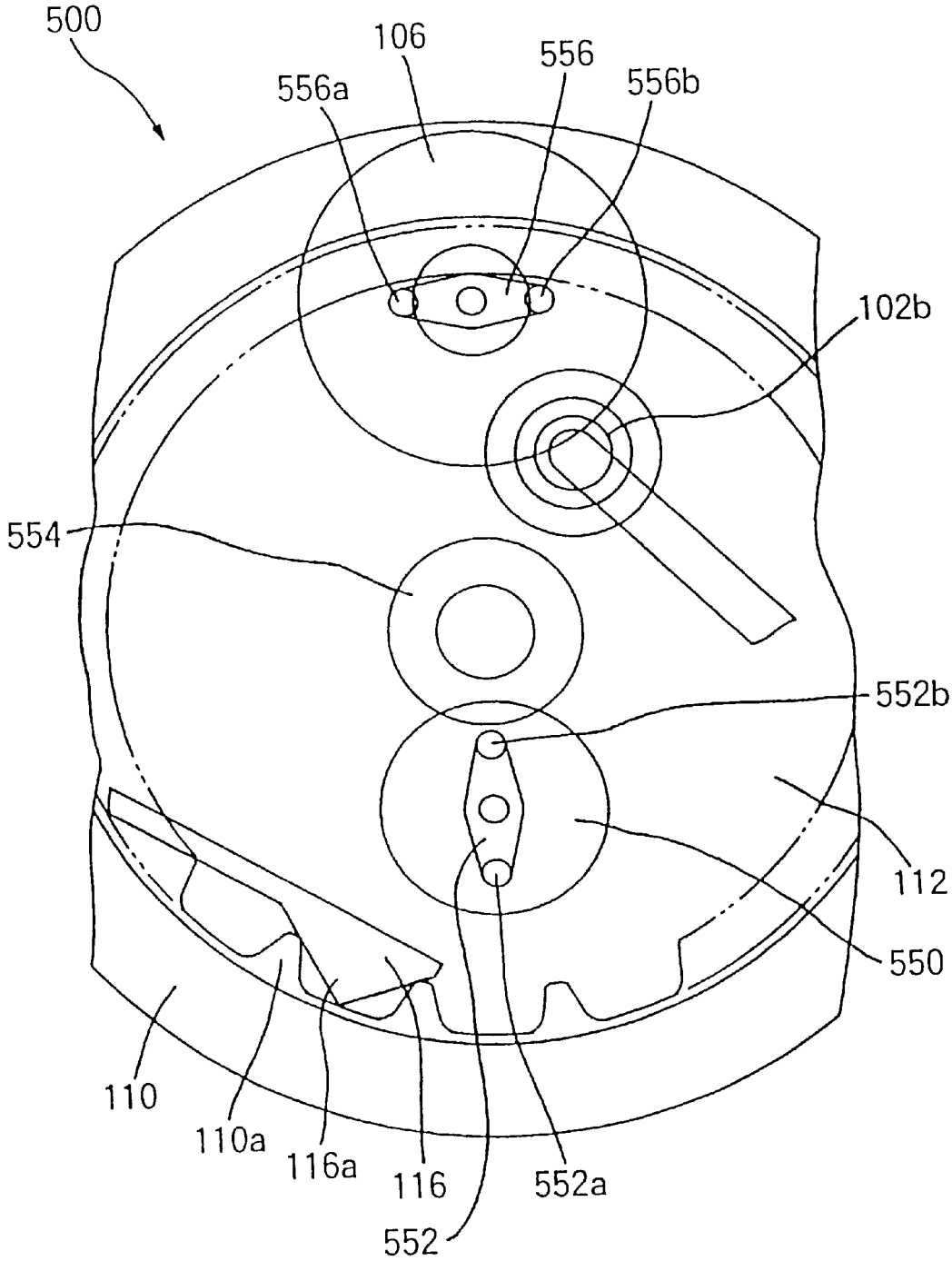
FIG. 12 is a schematic plan view (opened-up view) illustrating the calendar mechanism portion of the fifth embodiment of the electronic timepiece according to the present invention.
Figure 13:
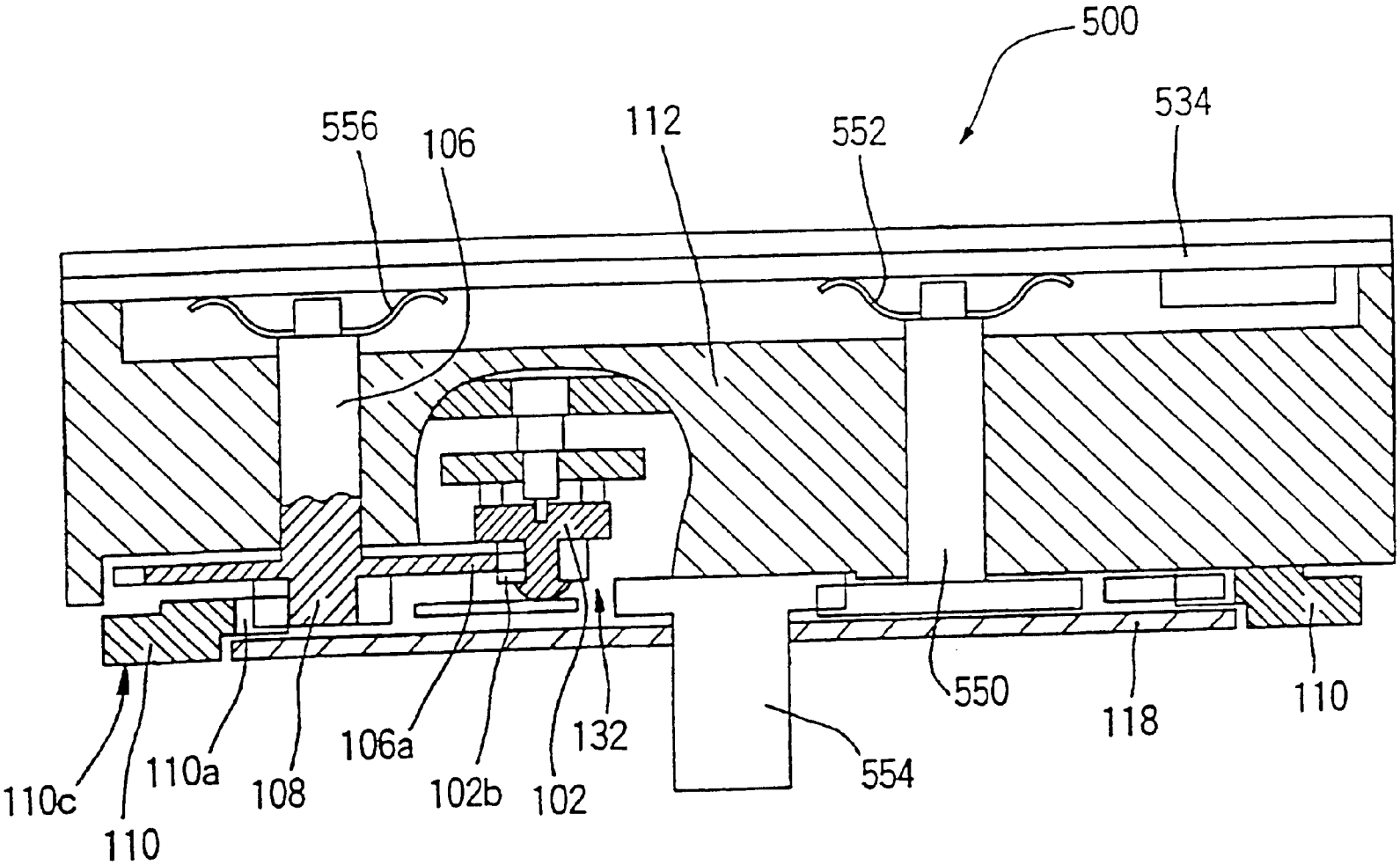
FIG. 13 is a schematic sectional view illustrating the calendar mechanism portion of the fifth embodiment of the electronic timepiece according to the present invention.

Referring to FIGS. 11 to 13, a calendar equipped electronic timepiece 500 according to a fifth embodiment of the present invention is provided, at a part of its obverse wheel train 530, with a 24-hour contact point 532 detecting the rotation position thereof. A 24-hour wheel 550 has a 24-hour contact point spring 552. The 24-hour contact point spring 552 has two 24-hour contact point spring terminals 552a and 552*b*.

A circuit block 534 is provided with a pattern (not illustrated) for use as a 24-hour contact point spring terminal in correspondence with a part of a circumferential portion along the locus on which respective forward end portions of the 24-contact point spring terminals 552a and 552*b* rotate. The 24-hour contact point spring 552 is disposed in such a way that this spring 552 can contact with the pattern (not illustrated) for use as the 24-hour contact point spring terminal of the circuit block 534.

The 24-hour wheel 550 is meshed with an hour wheel 554 and makes one rotation per day. The hour wheel 554 makes one rotation per 12 hours and indicates an "hour" by an hour hand (not illustrated) mounted on the hour wheel 554.

The date driving wheel 106 is rotatably incorporated into the main plate 112. The date driving wheel 106 constitutes a date driving reduction wheel train 560. The ultrasonic rotor pinion 102*b* of the ultrasonic rotor 102 of the ultrasonic motor is meshed with the date driving gear wheel 106*a* of the date driving wheel 106. The ultrasonic motor 132 including the ultrasonic rotor 102 constitutes a date driving motor 562.

The date finger 108 is provided on the date driving wheel 106 and rotates due to the rotation of the date driving wheel 106 simultaneously therewith. The date dial 110 having the thirty one date dial teeth 110*a* is rotatably incorporated into the main plate 112. Numerical values from '1' to '31' (not illustrated) are provided on the indication surface 110*c* of the date dial 110. A date dial holder 118 rotatably supports the date dial 110.

The calendar equipped electronic timepiece 500 is equipped with a date jumper 116. A regulating portion 116*a* of the date jumper 116 regulates the date dial teeth 110*a*.

The date driving wheel 106 has a date driving wheel contact point spring 556. The date driving wheel contact point spring 556 has two date driving wheel contact point spring terminals 556*a* and 556*b*.

The circuit block 534 is provided with a pattern (not illustrated) for use as date driving wheel contact point spring terminals in correspondence with a part of a circumferential portion along the locus on which respective forward end portions of the date driving wheel contact point springs 556*a* and 556*b* rotate. The date driving wheel contact point spring 556 is disposed in such a way that this spring 556 can contact with the pattern (not illustrated) for use as the date driving wheel contact point spring terminal of the circuit block 534. The date driving wheel contact point spring 556 constitutes a date driving contact point 564.

Next, the operation of the calendar equipped electronic timepiece 500 of the present invention will be explained.

When the control circuit outputs its counted result that the time is twelve o'clock at night, the 24-hour contact point spring 552 contacts with a first pattern (not illustrated) of the circuit block 534. At this time, the circuit block 534 rotates the ultrasonic rotor 102 of the ultrasonic motor 132 according to a detection signal output from the 24-hour contact point spring 552. Due to the rotation of the ultrasonic rotor 102, the date driving wheel 106 rotates and the date finger 108 causes the date dial 110 to rotate. As a result of this, it is possible to change the indication of a date.

When the date dial 110 rotates through an angle of 360°/36, i.e. makes a 1/31 rotation, the date driving wheel contact point spring 556 contacts with a second pattern (not illustrated) of the circuit block 534. At this time, according to the detection signal output from the date driving wheel contact point spring 556, the circuit block 534 stops the rotation of the ultrasonic rotor 102 of the ultrasonic motor 132.

Next, the 24-hour contact point spring 552 moves away from the first pattern of the circuit block 534 and the date driving wheel contact point spring 556 moves away from the second pattern of the circuit block 534. This state lasts until the next day comes with the result that the control circuit is brought to a state of its outputting again the counted result that the time is twelve o'clock at night.

It is to be noted that the time at which date drive is started or terminated is not necessarily accurately twelve o'clock at night and may be a time prior to the time of twelve o'clock at night or may be a time after the time of twelve o'clock at night.

By making such construction, date drive can be accurately started at the same point in time everyday and, in addition, the position of the date dial can be maintained accurately. As a result, in the calendar equipped electronic timepiece of the present invention, there is almost no possibility that day indication may be made with the position of a day character on the date dial being shifted to that of another.

(6) Description Of The Detailed Structure Of The Contact Point Part And Its Operation Next, an explanation will be given of a detailed structure of a contact point part of a transmission wheel rotation position detecting unit for detecting the position in the rotation direction of a transmission wheel contained in a wheel train such as an obverse wheel train or calendar wheel train of the electronic timepiece according to the present invention.

(6-1) First Structure Of The Contact Point Part

Figure 21:
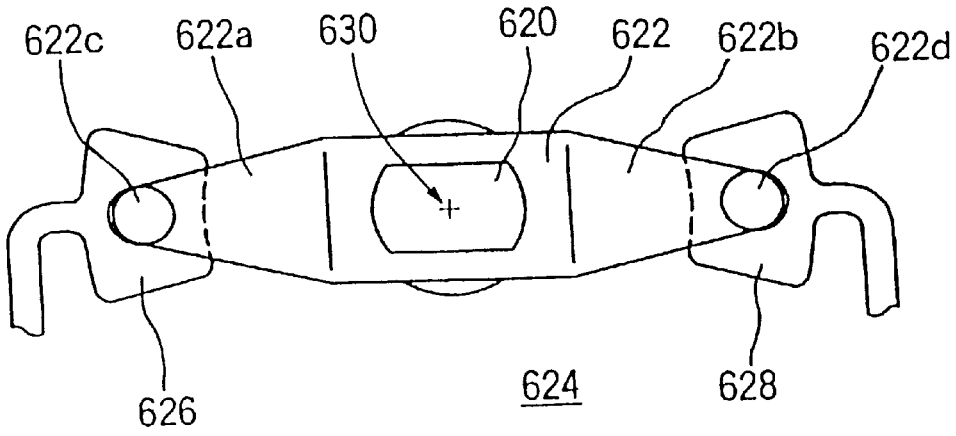
FIG. 21 is a partical plan view illustrating a first structure of a contact point portion of the electronic timepiece according to the present invention.
Figure 22:
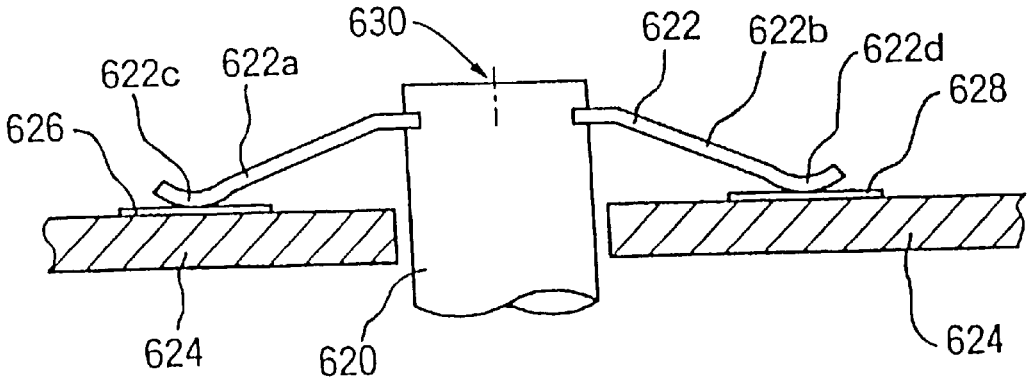
FIG. 22 is a partial sectional view illustrating the first structure of the contact point portion of the electronic timepiece according to the present invention.

Referring to FIGS. 21 and 22, a transmission wheel 620 is rotatably incorporated into the electronic timepiece. The transmission wheel 620 is a part contained in a wheel train such as an obverse wheel train or calendar wheel train of the electronic timepiece. The transmission wheel 620 is, for example, an hour wheel, 24-hour wheel, date driving wheel, intermediate date driving wheel or the like.

A contact point spring 622 is fixed to the transmission wheel 620. The contact point spring 622 is so constructed as to have a conductivity. For example, the contact point spring 622 may be constructed of metal material such as stainless steel or may be one prepared by adhering gold on the surface of the contact point spring 622 by plating.

Two contact point spring terminals 622*a* and 622*b* are provided with respect to the contact point spring 622. A terminal contact point portion 622*c* is provided at a forward end of the contact point spring terminal 622*a* and a terminal contact point portion 622*d* is provided at a forward end of the contact point spring terminal 622*a*.

A printed circuit board 624 is incorporated into the electronic timepiece and an A pattern 626 and a B pattern 628 are provided on the surface of the printed circuit board 624. The A and B patterns 626, 628 are connected to the control circuit (not illustrated). When the A pattern 626 and B pattern 628 have been conducted to each other, a rotational position detection signal is input to the control circuit (not illustrated).

The contact point spring 622 substantially linearly extends passing through the transmission wheel 620 at a center of rotation 630 thereof. The A pattern 626 and B pattern 628 are disposed in such a way as to define an angle of approximately 180° therebetween about the center of rotation 630 of the transmission wheel 620. Accordingly, when the transmission wheel 620 rotates, there occurs a state where the terminal contact point portion 622*c* contacts with the A pattern 626 and the terminal contact point portion 622*d* contacts with the B pattern 628. At this time, a rotational position detecting signal is input to the control circuit (not illustrated). When the transmission wheel 620 further rotates, the terminal contact point portion 622*c* moves away from the A pattern 626 and the terminal contact point portion 622*d* moves away from the B pattern 628. At this time, no rotational position detection signal is generated.

Further, when the transmission wheel 620 rotates, there occurs a state where the terminal contact point portion 622*c* contacts with the B pattern 628 and the terminal contact point portion 622*d* contacts with the A pattern 626. At this time, a rotational position detection signal is again input to the control circuit (not illustrated). When the transmission wheel 620 further rotates, the terminal contact point portion 622*c* moves away from the B pattern 628 and the terminal contact point portion 622*d* moves away from the A pattern 626. At this time, no rotational position detection signal is generated.

Even when the transmission 620 rotates clockwise or counterclockwise, the operation of the contact point part is the same.

In this construction, when the transmission wheel 620 makes one rotation, the rotational position detection signal is input twice to the control circuit (not illustrated). Accordingly, when the construction is of a type wherein the transmission wheel 620 makes one rotation per 24 hours, the rotational position detection signal is input to the control circuit (not illustrated) every 12 hours. When it is needed to count 24 hours as in the case of changing a date indication, the control circuit is constructed such that a counting circuit for counting the frequency at which the rotational position generating signal is generated is provided with respect to the control circuit, whereby when the rotational position detecting signal is input twice thereto, a signal for changing a date indication is output therefrom.

Figure 23:
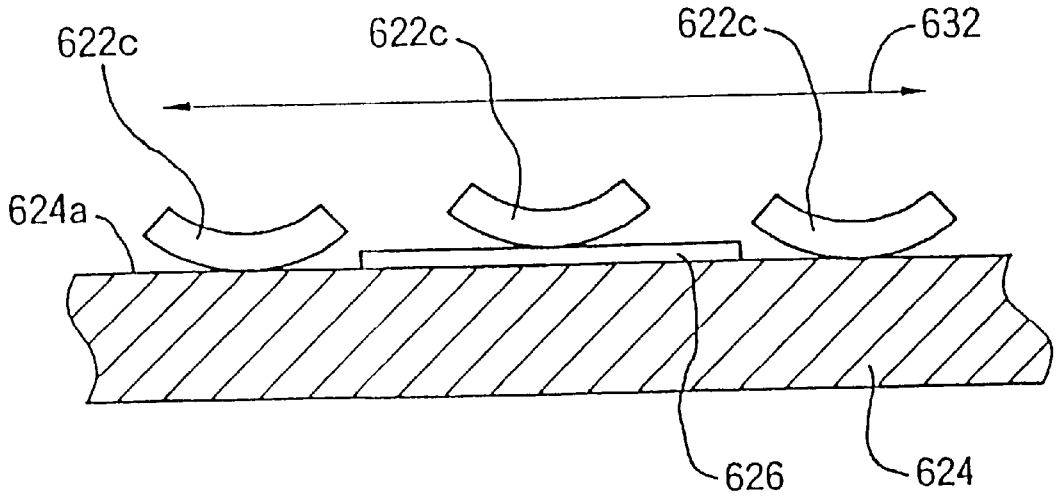
FIG. 23 is a partial sectional view illustrating the operation of a contact point spring in the first structure of the contact point portion of the electronic timepiece according to the present invention.

As illustrated in FIG. 23, the terminal contact point portion 622*c* rotates relative to the A pattern 626 in a direction indicated by an arrow 632 about the center of rotation 630 of the transmission wheel 620. Accordingly, when the terminal contact point portion 622*c* is out of contact with the pattern, the terminal contact point portion 622*c* rotates while being in contact with a surface 624*a* of the printed circuit board 624. This construction and function apply also to the terminal contact point portion 622*d*.

By this construction, it is possible to detect the rotational position of the transmission wheel with a simple pattern disposition.

(6-2) Second Structure Of The Contact Point Part

Figure 24:
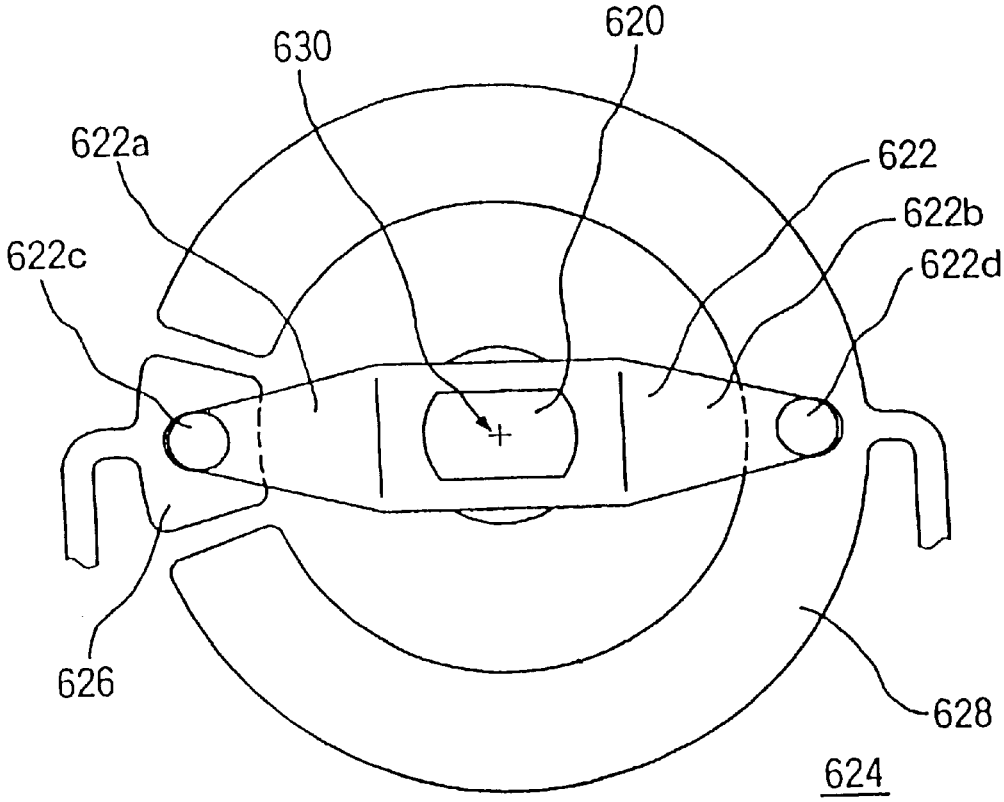
FIG. 24 is a partial plan view illustrating a second structure of the contact point portion of the electronic timepiece according to the present invention.

Referring to FIG. 24, in the same way as in the above-described first structure of the contact point, the transmission wheel 620 is rotatably incorporated into the electronic timepiece and the contact point spring 622 is fixed to the transmission wheel 620. The construction of the contact point spring 622 is the same as that in the first structure of the contact point part.

The printed circuit board 624 is incorporated into the electronic timepiece and the A pattern 626 and the B pattern 628 are provided on the surface of the printed circuit board 624. The A and B patterns 626, 628 are connected to the control circuit (not illustrated). When the A pattern 626 and B pattern 628 have been conducted to each other, the rotational position detection signal is input to the control circuit (not illustrated).

The A pattern 626 is formed about the center of rotation 630 of the transmission wheel 620 through a relatively small angular open space of, for example, approximately 30°. The B pattern 628 is formed about the center of rotation 630 of the transmission wheel 620 through a relatively large angular open space of, for example, approximately 320°. Accordingly, when the transmission wheel 620 rotates, there occurs a state where the terminal contact point portion 622*c* contacts with the A pattern 626 and the terminal contact point portion 622*d* contacts with the B pattern 628. At this time, the rotational position detection signal is input to the control circuit (not illustrated). When the transmission wheel 620 further rotates, the terminal contact point portion 622*c* moves away from the A pattern 626 to contact with the B pattern 628 and the terminal contact point portion 622*d* also contact with the B pattern 628. At this time, no rotational position detection signal is generated.

Further, when the transmission wheel 620 rotates, there occurs a state where the terminal contact point portion 622*c* contacts with the B pattern 628 and the terminal contact point portion 622*d* contacts with the A pattern 626. At this time, the rotational position detection signal is again input to the control circuit (not illustrated). When the transmission wheel 620 further rotates, the terminal contact point portion 622*c* contacts with the B pattern 628 and the terminal contact point portion 622*d* moves away from the A pattern 626 to contact with the B pattern 628. At this time, no rotational position detection signal is generated.

In this construction, when the transmission wheel 620 makes one rotation, the rotational position detection signal is input once to the control circuit (not illustrated). Accordingly, when the construction is of a type wherein the transmission wheel 620 makes one rotation per 24 hours, the rotational position detection signal is input to the control circuit (not illustrated) every 24 hours. When it is needed to count 24 hours as in the case of changing a date indication, the control circuit is constructed such that a detecting circuit for detecting the generation of the rotational position generating signal is provided with respect to the control circuit, whereby when the rotational position detection signal is input thereto, the signal for changing a date indication is output therefrom.

Even when the transmission 620 rotates clockwise or counterclockwise, the operation of the contact point part is the same.

Figure 25:
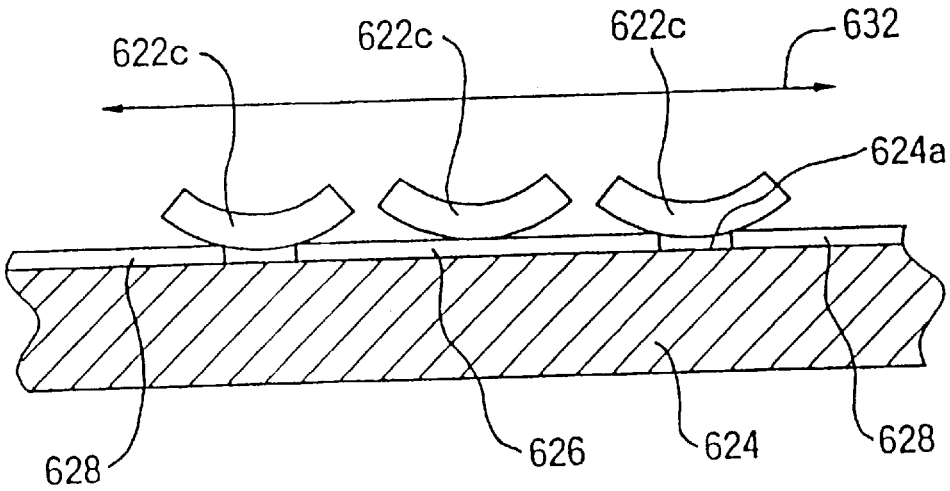
FIG. 25 is a partial sectional view illustrating the operation of a contact point spring in the second structure of the contact point portion of the electronic timepiece according to the present invention.

As illustrated in FIG. 25, the terminal contact point portion 622*c* rotates relative to the A pattern 626 in the direction indicated by the arrow 632 about the center of rotation 630 of the transmission wheel 620. Accordingly, when the gap in the circumferential direction between the A pattern 626 and the B pattern 628 is small relative to the size of the terminal contact portion 622*c*, there is taken any one of a state where the terminal contact point portion 622*c* contacts with only the A pattern 626, a state where the terminal contact portion 622*c* contacts with only the B pattern 628 and a state where the terminal contact portion 622*c* simultaneously contacts with the both A pattern 626 and B pattern 628, with the result that there is no possibility that the terminal contact point portion 622*c* will contact with the surface 624*a* of the printed circuit board 624. This construction and function similarly apply also to the terminal contact point portion 622*d*.

By this construction, there is no possibility that the surface 624*a* of the printed circuit board 624 will be shaved off, and it is less likely that the A pattern 626 and B pattern 628 will have their edge portions shaved off or peeled off.

Figure 26:
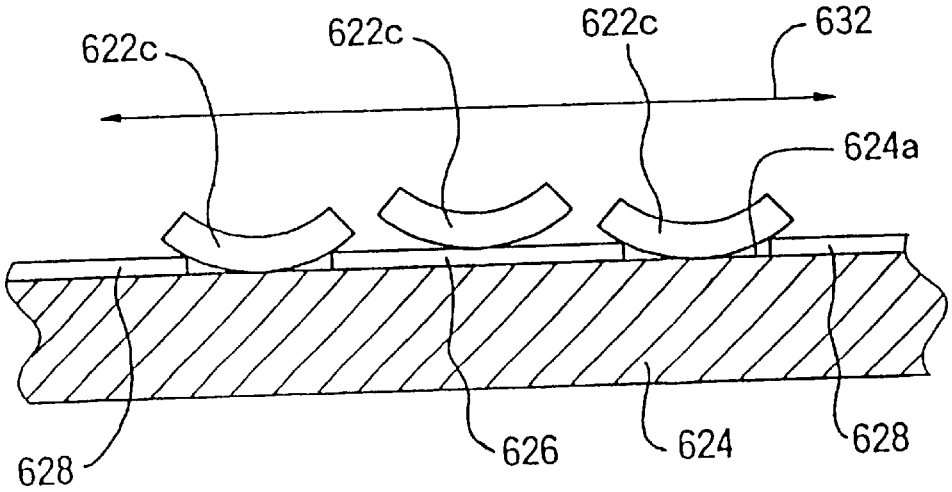
FIG. 26 is a partial sectional view illustrating the operation of the contact point spring in a modification of the second structure of the contact point portion of the electronic timepiece according to the present invention.

Incidentally, as illustrated in FIG. 26, when the circumferential gap between the A pattern 626 and the B pattern 628 is approximate to the size of the terminal contact point portion 622*c*, there occurs the possibility that the terminal contact portion 622*c* will contact with the surface 624*a* of the printed circuit board 624. Accordingly, preferably, the circumferential gap between the A pattern 626 and the B pattern 628 is formed small.

(6-3) Third Structure Of The Contact Point Part

Figure 27:
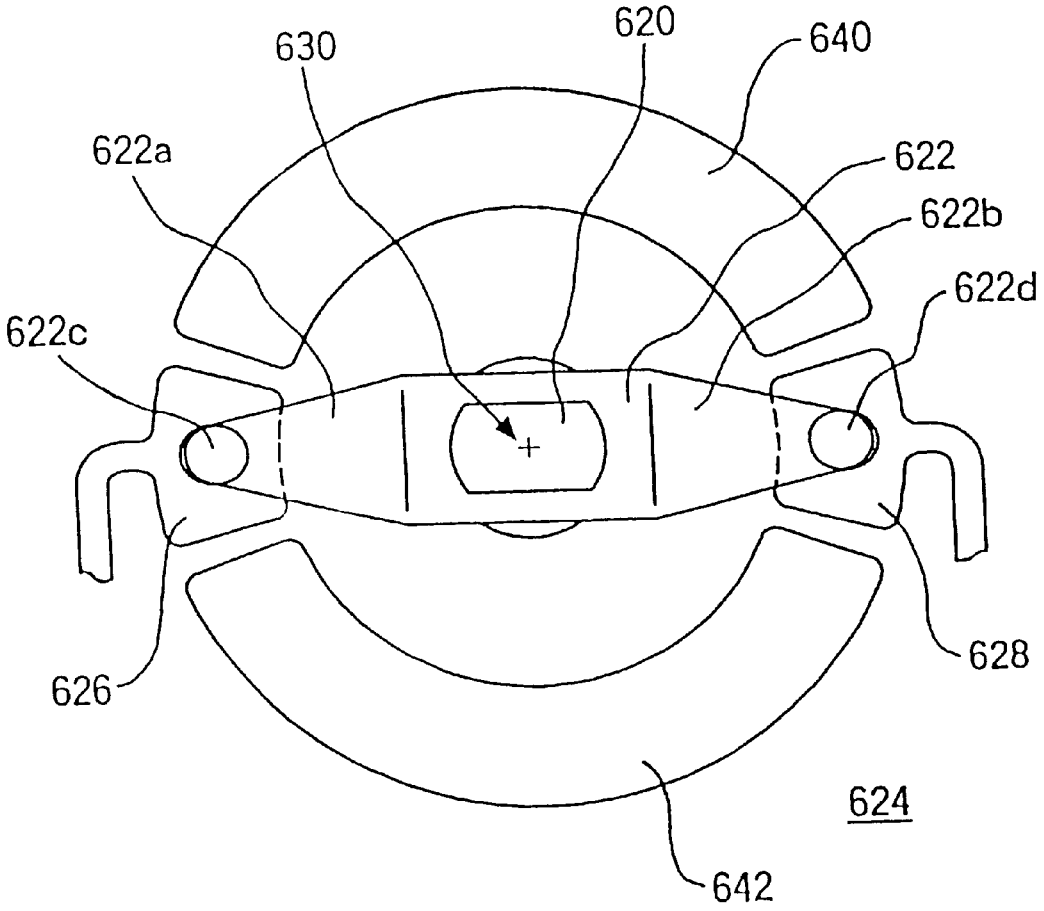
FIG. 27 is a partial plan view illustrating a third structure of the contact point portion of the electronic timepiece according to the present invention.

Referring to FIG. 27, the A pattern 626, B pattern 628, C pattern 640 and D pattern 642 are provided on the surface of the printed circuit board 624. The A pattern 626 and B pattern 628 are connected to the control circuit (not illustrated). The C pattern 640 and D pattern 642 are so-called "dummy patterns" which are not connected to the control circuit and have no special function. When the A pattern 626 and the B pattern 628 have been conducted to each other, the rotational position detection signal is input to the control circuit (not illustrated).

The contact point spring 622 substantially linearly extends passing through the transmission wheel 620 at a center of rotation 630 thereof. The A pattern 626 and B pattern 628 are disposed in such a way as to define an angle of approximately 180° therebetween about the center of rotation 630 of the transmission wheel 620. Accordingly, when the transmission wheel 620 rotates, there occurs a state where the terminal contact point portion 622*c* contacts with the A pattern 626 and the terminal contact point portion 622*d* contacts with the B pattern 628. At this time, the rotational position detecting signal is input to the control circuit (not illustrated). When the transmission wheel 620 further rotates, the terminal contact point portion 622*c* moves away from the A pattern 626 to contact with the C pattern 640 and the terminal contact point portion 622*d* moves away from the B pattern 628 to contact with the D pattern 642. At this time, no rotational position detection signal is generated.

Further, when the transmission wheel 620 rotates clockwise, there occurs a state where the terminal contact point portion 622*c* contacts with the B pattern 628 and the terminal contact point portion 622*d* contacts with the A pattern 626. At this time, the rotational position detecting signal is again input to the control circuit (not illustrated). When the transmission wheel 620 further rotates clockwise, the terminal contact point portion 622*c* moves away from the B pattern 628 to contact with the D pattern 642 and the terminal contact point portion 622*d* moves away from the A pattern 626 to contact with the C pattern 640. At this time, no rotational position detection signal is generated.

In this construction, when the transmission wheel 620 makes one rotation, the rotational position detection signal is input twice to the control circuit (not illustrated). Accordingly, when the construction is of a type wherein the transmission wheel 620 makes one rotation per 24 hours, the rotational position detection signal is input to the control circuit (not illustrated) every 12 hours. When it is needed to count 24 hours as in the case of changing a date indication, the control circuit is constructed such that a counting circuit for counting the frequency at which the rotational position generating signal is generated is provided with respect to the control circuit, whereby when the rotational position detection signal is input twice thereto, the signal for changing a date indication is output therefrom.

Even when the transmission 620 rotates clockwise or counterclockwise, the operation of the contact point part is the same.

By this construction, it is possible to detect the rotational position of the transmission wheel with a simple pattern disposition.

(6-4) Fourth Structure Of The Contact Point Part

Figure 28:
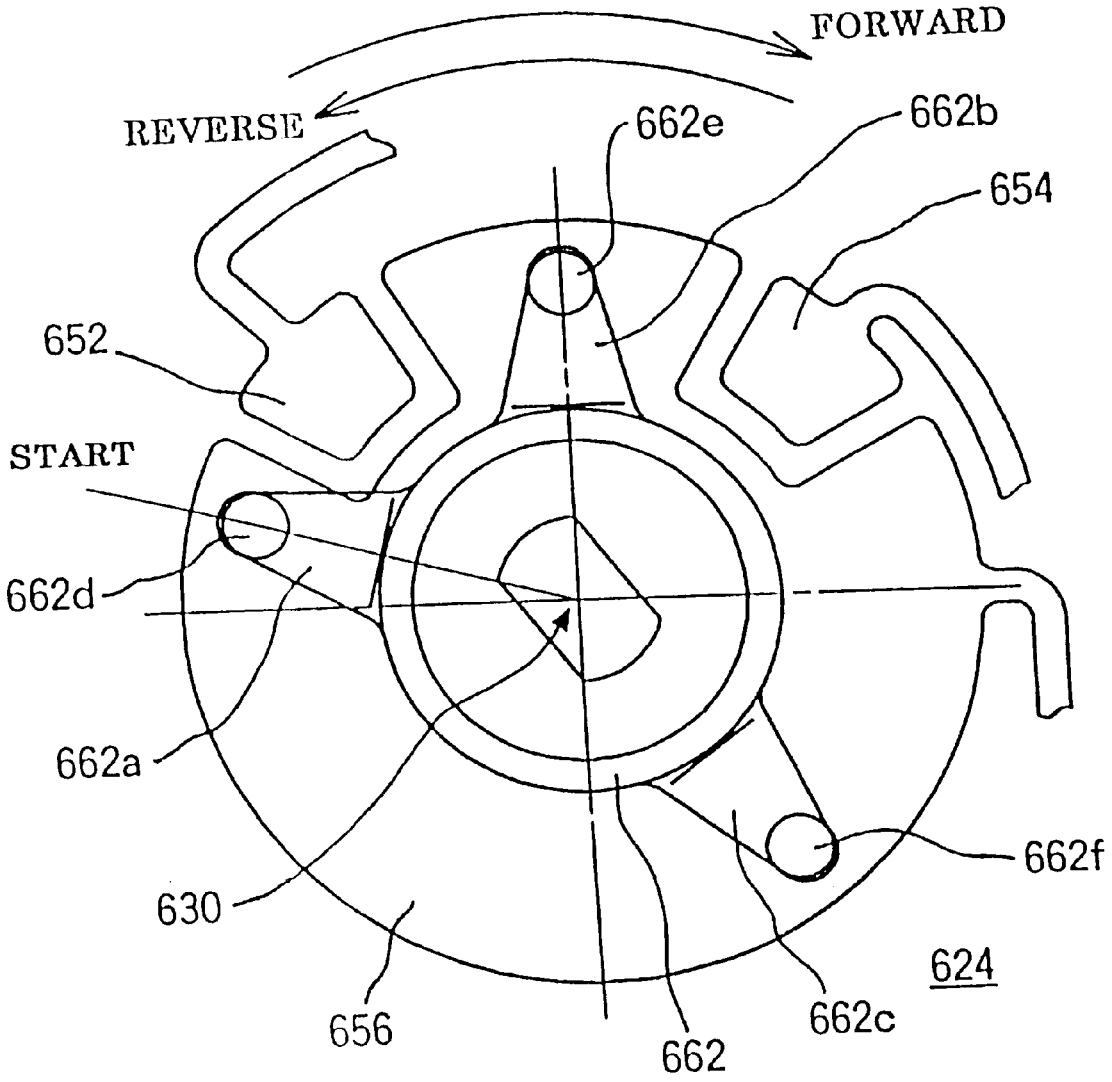
FIG. 28 is a partial plan view illustrating a fourth structure of the contact point portion of the electronic timepiece according to the present invention.

Referring to FIG. 28, the A pattern 652, B pattern 654 and VDD pattern 656 are provided on the surface of the printed circuit board 624. The A pattern 652 and B pattern 654 are connected to the control circuit (not illustrated). The VDD pattern 656 may be connected directly to the plus terminal (VDD) of a power source or may be connected to the control circuit (not illustrated) within which it is connected to the plus terminal (VDD) of the power source.

When the A pattern 652 has been conducted to the plus terminal (VDD) of the power source, an A pattern detection signal which is a first detection signal is input to the control circuit (not illustrated). Namely, in this case, an A pattern input terminal of the control circuit has a '1' level, i.e. becomes 'HIGH'.

When the B pattern 654 has been conducted to the plus terminal (VDD) of the power source, a B pattern detection signal which is a second detection signal is input to the control circuit (not illustrated). Namely, in this case, a B pattern input terminal of the control circuit has a '1' level, i.e. becomes 'HIGH'.

Figure 30:
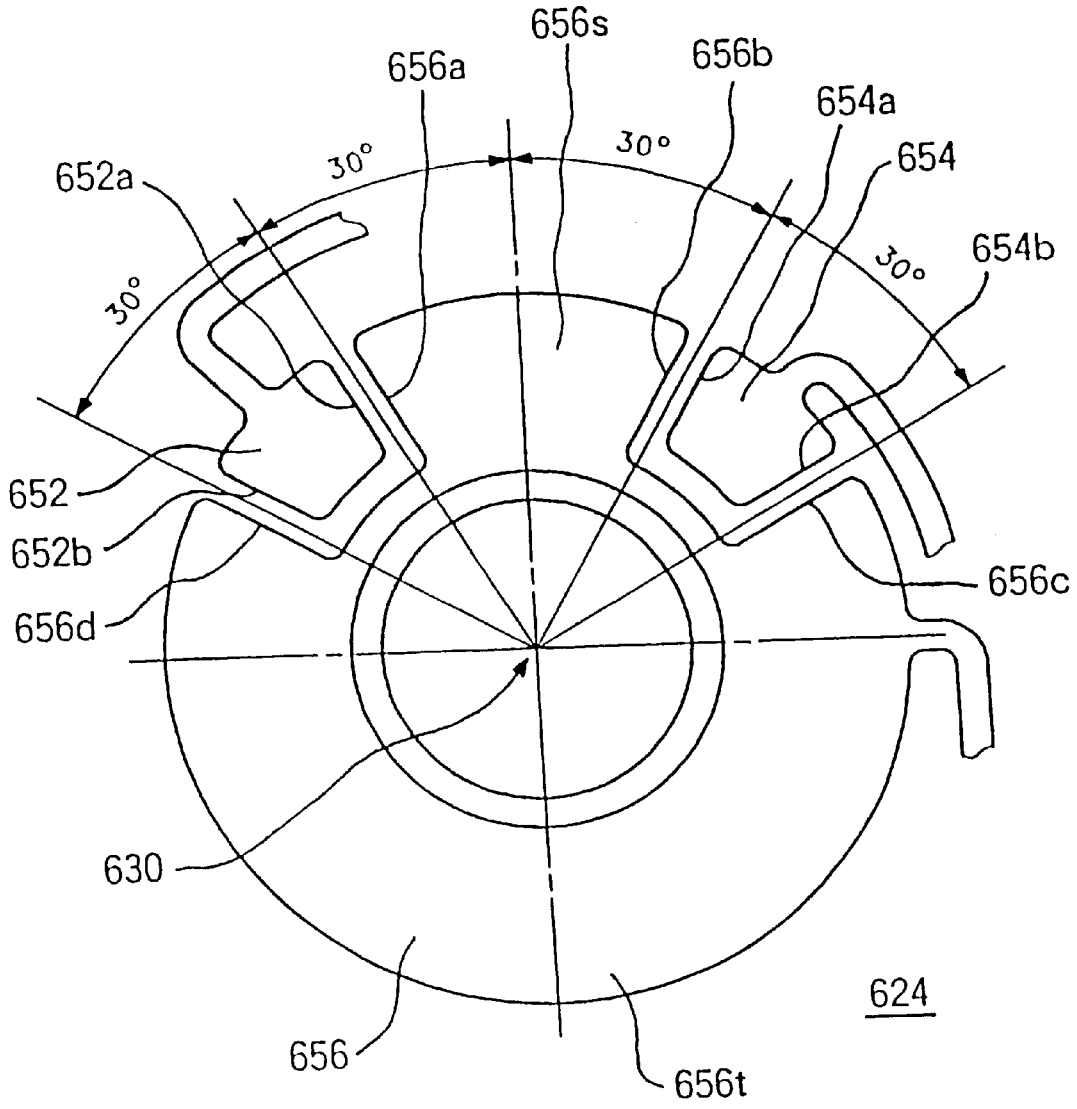
FIG. 30 is a partial plan view illustrating the configuration of a circuit pattern used in the fourth structure of the contact point portion of the electronic timepiece according to the present invention.

The respective patterns will now be explained with reference to FIG. 30 sequentially in the clockwise direction.

The A pattern 652 is provided within an angular open space of approximately 30° about the center of rotation 630 of the transmission wheel. The A pattern 652 has a first end portion 652*a* and a second end portion 652*b* in the circumferential direction.

The VDD pattern 656 has a first pattern 656*a* and a second pattern portion 656*t*. The first pattern portion 656*s* of the VDD pattern 656 has a first end portion 656*a* and a second end portion 656*b* in the circumferential direction. The first end portion 656*a* of the VDD pattern 656 is adjacent to the first end portion 652*a* of the A pattern 652 with a gap existing therebetween. The first pattern portion 656*s* of the VDD pattern 656 is provided within an angular open space of approximately 60° about the center of rotation 630 of the transmission wheel.

The B pattern 654 has a first end portion 654*a* and a second end portion 654*b* in the circumferential direction. The first end portion 654*a* of the B pattern 654 is adjacent to the second end portion 656*b* of the first pattern portion 656*s* of the VDD pattern 656 with a gap existing therebetween. The B pattern 654 is provided within an angular open space of approximately 30° about the center of rotation 630 of the transmission wheel.

The second end portion 654*b* of the B pattern 654 is adjacent to the first end portion 656*c* of the second pattern portion 656*t* of the VDD pattern 656 with a gap existing therebetween. The second pattern portion 656*t* of the VDD pattern 656 is provided within an angular open space of approximately 240° about the center of rotation 630 of the transmission wheel. And, the second end portion 656*d* of the second pattern portion 656*t* of the VDD pattern 656 is adjacent to the second end portion 656*b* of the A pattern 652 with a gap existing therebetween.

As described above, on the surface of the printed circuit board 624 there are provided the A pattern 652, first pattern portion 656*s* of the VDD pattern 656, B pattern 654, and second pattern portion 656*t* of the VDD pattern 656 circumferentially in the clockwise direction in this order.

Figure 29:
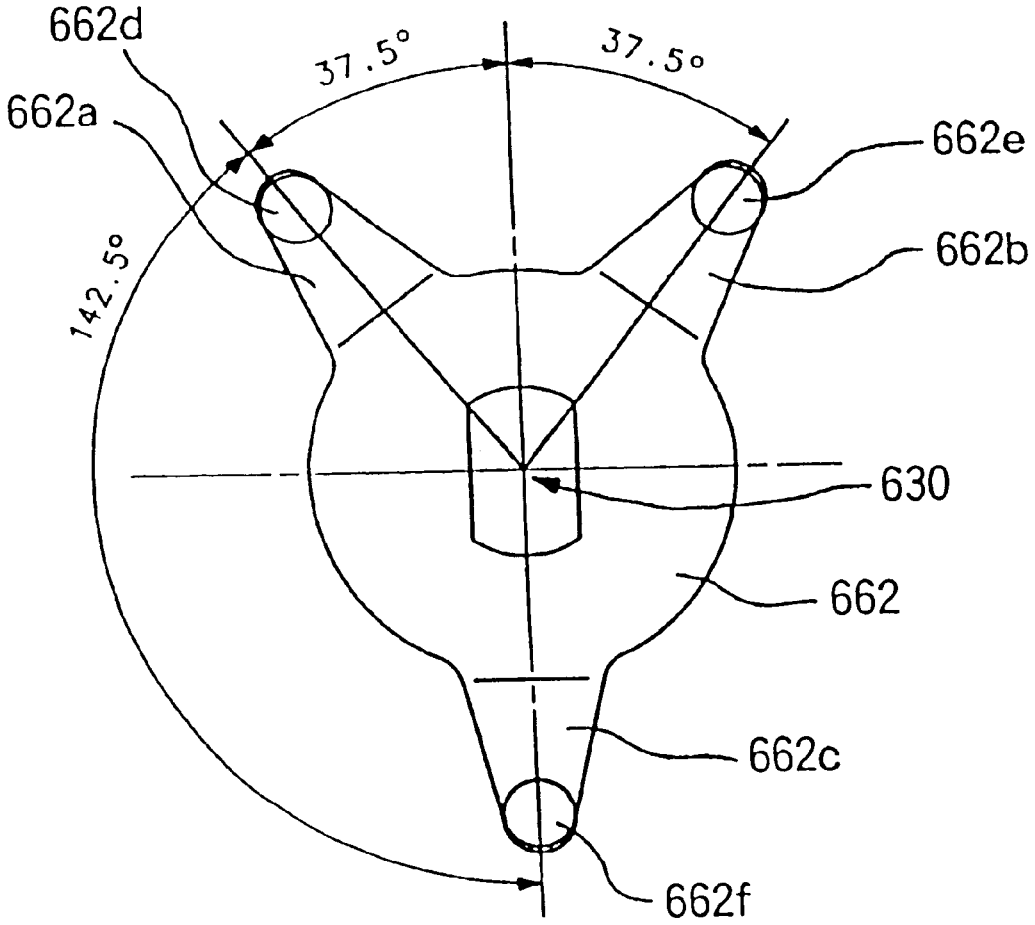
FIG. 29 is a partial plan view illustrating the configuration of a contact point spring used in the fourth structure of the contact point portion of the electronic timepiece according to the present invention.

Referring to FIG. 29, the contact point spring 662 has three contact point spring terminals 662*a*, 662*b* and 662*c* which extend externally from the center of rotation 630 of the transmission wheel 620. The contact point spring terminals 662*a* and 662*b* are provided so as to define an angle of approximately 75° therebetween. The contact point spring terminals 662*a* and 662*c* are provided so as to define an angle of approximately 142. 5° therebetween. The contact point spring terminals 662*b* and 662*c* are provided so as to define an angle of approximately 142. 5° therebetween.

A terminal contact point portion 662*d* is provided on a forward end portion of the contact point spring terminal 662*a*, a terminal contact point portion 662*e* is provided on a forward end portion of the contact point spring terminal 662*b*, and a terminal contact point portion 662*f* is provided on a forward end portion of the contact point spring terminal 662*c*.

When the transmission wheel 620 rotates, the terminal contact point portions 662*a*, 662*b* and 662*c* contact with the A pattern 652, first pattern portion 656*s* of the VDD pattern 656, B pattern 654, and second pattern portion 656*t* of the VDD pattern 656, respectively.

Next, the detection of the rotation direction and the operation of the detection of the state of start of the rotation when the transmission wheel rotates in the clockwise direction, i.e. forwardly rotates will be explained.

Figure 31:
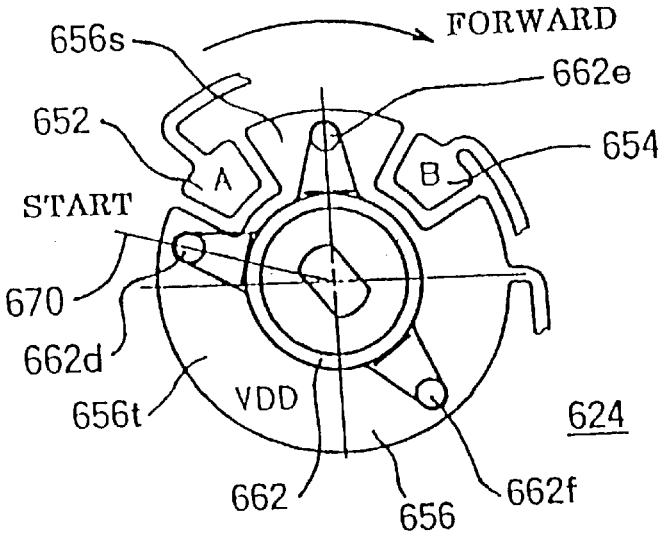
FIG. 31 is a partial plan view illustrating the operation in the direction of a forward rotation of the fourth structure of the contact point portion of the electronic timepiece according to the present invention.

(f1) Operational State 1:

FIG. 31 illustrates an initial state of the transmission wheel, i.e., an operational state 1 wherein the terminal contact point portion 662*d* of the contact point spring 662 is situated at a start position 670. This state 1 is set to be '0°' in a timing chart of FIG. 32.

In the operational state 1 illustrated in FIG. 31, the terminal contact point portion 662*d* contacts with the second pattern portion 656*t* of the VDD pattern 656, the terminal contact point portion 662*e* contacts with the first pattern portion 656*s* of the VDD pattern 656, and the terminal contact point portion 662*f* contacts with the second pattern portion 656*t* of the VDD pattern 656.

In this operational state 1, neither the A pattern detection signal nor the B pattern detection signal is input to the control circuit (not illustrated). Namely, in this operational state 1, the A pattern input terminal and B pattern input terminal of the control circuit are each '0', i.e., 'LOW'.

(f2) Operational State 2:

Next, in an operational state 2 wherein the terminal contact point portion 662*d* of the contact point spring 662 has rotated clockwise from the start position 670 up to the position of approximately 15°, the terminal contact point portion 662*d* contacts with the A pattern 652, the terminal contact point portion 662*e* contacts with the first pattern portion 656*s* of the VDD pattern 656, and the terminal contact point portion 662*f* contacts with the second pattern portion 656*t* of the VDD pattern 656.

In this operational state 2, only the A pattern detection signal is input to the control circuit (not illustrated). Namely, in this operational state 2, the A pattern input terminal of the control circuit is '1', i.e. becomes 'HIGH', and the B pattern input terminal thereof is '0', i.e., remains to be 'LOW'.

(f3) Operational State 3:

Next, in an operational state 3 wherein the terminal contact point portion 662*d* of the contact point spring 662 has rotated clockwise from the start position 670 up to the position of approximately 30°, the terminal contact point portion 662*d* contacts with the A pattern 652, the terminal contact point portion 662*e* contacts with the B pattern 654, and the terminal contact point portion 662*f* contacts with the second pattern portion 656*t* of the VDD pattern 656.

In this operational state 3, the A pattern detection signal and B pattern detection signal are input to the control circuit (not illustrated). Namely, in this operational state 3, the A pattern input terminal of the control circuit is '1', i.e. becomes 'HIGH', and the B pattern input terminal thereof also is '1', i.e., becomes 'HIGH'.

(f4) Operational State 4:

Next, in an operational state 4 wherein the terminal contact point portion 662*d* of the contact point spring 662 has rotated clockwise from the start position 670 up to the position of approximately 45°, the terminal contact point portion 662*d* contacts with the first pattern portion 656*s* of the VDD pattern 656, the terminal contact point portion 662*e* contacts with the B pattern 654, and the terminal contact point portion 662*f* contacts with the second pattern portion 656*t* of the VDD pattern 656.

In this operational state 4, only the B pattern detection signal is input to the control circuit (not illustrated) . Namely, in this operational state 4, the A pattern input terminal of the control circuit is '0', i.e. becomes 'LOW', and the B pattern input terminal thereof is '1', i.e., remains to be 'HIGH'.

Figure 32:
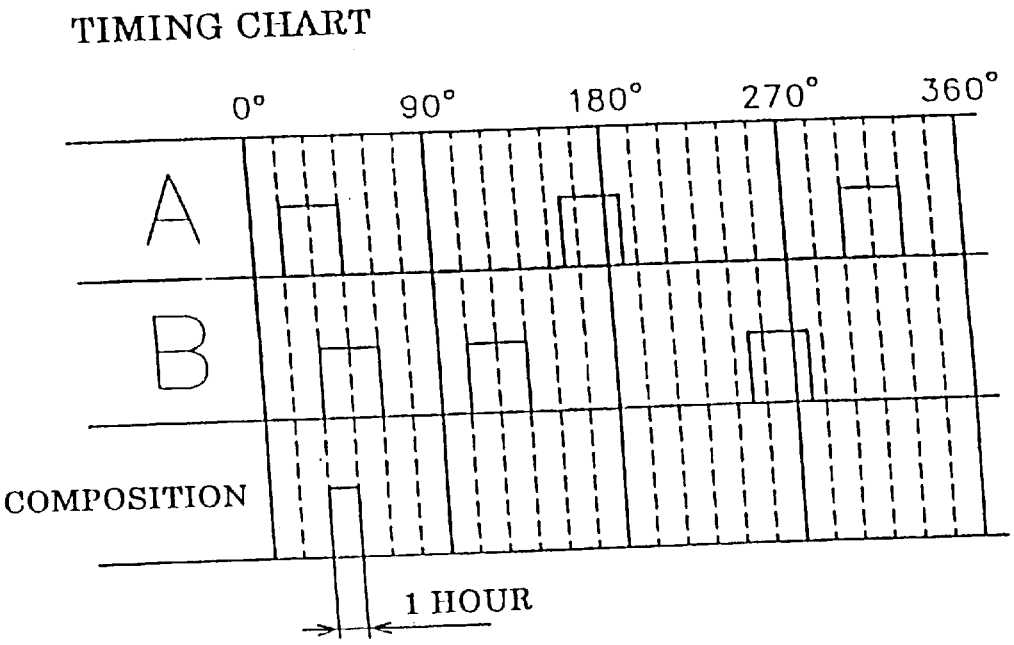
FIG. 32 is a timing chart that corresponds to the time when the fourth structure of the contact point portion of the electronic timepiece according to the present invention is operated in the direction of the forward rotation.

Accordingly, as illustrated in FIG. 32, the state wherein both the A pattern input terminal and the B pattern input terminal of the control circuit are each '1' lasts for approximately one hour. This is because in a case where it is arranged that the transmission wheel makes one rotation per 24 hours, approximately one hour is needed for the transmission wheel to rotate through an angle of 15°.

(f5) Operational State 5:

Next, in an operational state 5 wherein the terminal contact point portion 662*d* of the contact point spring 662 has rotated clockwise from the start position 670 up to the position of approximately 60°, the terminal contact point portion 662*d* contacts with the first pattern portion 656*s* of the VDD pattern 656, the terminal contact point portion 662*e* contacts with the second pattern portion 656*t* of the VDD pattern 656, and the terminal contact point portion 662*f* contacts with the second pattern portion 656*t* of the VDD pattern 656.

In this operational state 5, neither the A pattern detection signal nor the B pattern detection signal is input to the control circuit (not illustrated). Namely, in this operational state 5, the A pattern input terminal and B pattern input terminal of the control circuit are each '0', i.e. 'LOW'.

(f6) Operational State 6:

Next, in an operational state 6 wherein the terminal contact point portion 662*d* of the contact point spring 662 has rotated clockwise from the start position 670 up to the position of approximately 105°, the terminal contact point portion 662*d* contacts with the B pattern 654, the terminal contact point portion 662*e* contacts with the second pattern portion 656*t* of the VDD pattern 656, and the terminal contact point portion 662*f* contacts with the second pattern portion 656*t* of the VDD pattern 656.

In this operational state 6, only the B pattern detection signal is input to the control circuit (not illustrated). Namely, in this operational state 6, the A pattern input terminal of the control circuit remains to be '0', and the B pattern input terminal thereof is '1', i.e., becomes 'HIGH'.

(f7) Operational State 7:

Next, in an operational state 7 wherein the terminal contact point portion 662*d* of the contact point spring 662 has rotated clockwise from the start position 670 up to the position of approximately 135°, the terminal contact point portion 662*d* contacts with the second pattern portion 656*t* of the VDD pattern 656, the terminal contact point portion 662*e* contacts with the second pattern portion 656*t* of the VDD pattern 656, and the terminal contact point portion 662*f* contacts with the second pattern portion 656*t* of the VDD pattern 656.

In this operational state 7, neither the A pattern detection signal nor the B pattern detection signal is input to the control circuit (not illustrated). Namely, in this operational state 7, the A pattern input terminal and B pattern input terminal of the control circuit are each '0', i.e. 'LOW'.

(f8) Operational State 8:

Next, in an operational state 8 wherein the terminal contact point portion 662*d* of the contact point spring 662 has rotated clockwise from the start position 670 up to the position of approximately 157.5°, the terminal contact point portion 662*d* contacts with the second pattern portion 656*t* of the VDD pattern 656, the terminal contact point portion 662*e* contacts with the second pattern portion 656*t* of the VDD pattern 656, and the terminal contact point portion 662*f* contacts with the A pattern 652.

In this operational state 8, only the A pattern detection signal is input to the control circuit (not illustrated). Namely, in this operational state 8, the A pattern input terminal of the control circuit is '1', i.e. becomes 'HIGH', and the B pattern input terminal thereof is '0', i.e., remains to be 'LOW'.

(f9) Operational State 9:

Next, in an operational state 9 wherein the terminal contact point portion 662*d* of the contact point spring 662 has rotated clockwise from the start position 670 up to the position of approximately 187.5°, the terminal contact point portion 662*d* contacts with the second pattern portion 656*t* of the VDD pattern 656, the terminal contact point portion 662*e* contacts with the second pattern portion 656*t* of the VDD pattern 656, and the terminal contact point portion 662*f* contacts with the first pattern portion 656*s* of the VDD pattern 656.

In this operational state 9, neither the A pattern detection signal nor the B pattern detection signal is input to the control circuit (not illustrated). Namely, in this operational state 9, the A pattern input terminal and B pattern input terminal of the control circuit are each '0', i.e. 'LOW'.

(f10) Operational State 10:

Next, in an operational state 10 wherein the terminal contact point portion 662*d* of the contact point spring 662 has rotated clockwise from the start position 670 up to the position of approximately 247.5°, the terminal contact point portion 662*d* contacts with the second pattern portion 656*t* of the VDD pattern 656, the terminal contact point portion 662*e* contacts with the second pattern portion 656*t* of the VDD pattern 656, and the terminal contact point portion 662*f* contacts with the B pattern 654.

In this operational state 10, only the B pattern detection signal is input to the control circuit (not illustrated) . Namely, in this operational state 10, the A pattern input terminal of the control circuit remains to be '0', and the B pattern input terminal thereof is '1', i.e., becomes 'HIGH'.

(f11) Operational State 11:

Next, in an operational state 11 wherein the terminal contact point portion 662*d* of the contact point spring 662 has rotated clockwise from the start position 670 up to the position of approximately 277.5°, the terminal contact point portion 662*d* contacts with the second pattern portion 656*t* of the VDD pattern 656, the terminal contact point portion 662*e* contacts with the second pattern portion 656*t* of the VDD pattern 656, and the terminal contact point portion 662*f* contacts with the second pattern portion 656*t* of the VDD pattern 656.

In this operational state 11, neither the A pattern detection signal nor the B pattern detection signal is input to the control circuit (not illustrated). Namely, in this operational state 11, the A pattern input terminal and B pattern input terminal of the control circuit are each '0', i.e. 'LOW'.

(f12) Operational State 12:

Next, in an operational state 12 wherein the terminal contact point portion 662*d* of the contact point spring 662 has rotated clockwise from the start position 670 up to the position of approximately 300°, the terminal contact point portion 662*d* contacts with the second pattern portion 656*t* of the VDD pattern 656, the terminal contact point portion 662*e* contacts with the A pattern 652, and the terminal contact point portion 662*f* contacts with the A pattern 652.

In this operational state 12, only the A pattern detection signal is input to the control circuit (not illustrated). Namely, in this operational state 12, the A pattern input terminal of the control circuit is '1', i.e. becomes 'HIGH', and the B pattern input terminal thereof is '0', i.e., remains to be 'LOW'.

(f13) Operational State 13:

Next, in an operational state 13 wherein the terminal contact point portion 662*d* of the contact point spring 662 has rotated clockwise from the start position 670 up to the position of approximately 300°, the terminal contact point portion 662*d* contacts with the second pattern portion 656*t* of the VDD pattern 656, the terminal contact point portion 662*e* contacts with the first pattern portion 656*s* of the VDD pattern 656, and the terminal contact point portion 662*f* contacts with the second pattern portion 656*t* of the VDD pattern 656.

In this operational state 13, neither the A pattern detection signal nor the B pattern detection signal is input to the control circuit (not illustrated). Namely, in this operational state 13, the A pattern input terminal and B pattern input terminal of the control circuit are each '0', i.e. become 'LOW'.

(f14) Operation Returning To The Start State

Further, when the terminal contact point portion 662*d* of the contact point spring 662 has rotated clockwise from the start position 670 up to the position of 360°, the relevant portions return to the start state illustrated in FIG. 31.

In this construction, when the transmission wheel 620 makes one rotation, the both A pattern input terminal and B pattern input terminal of the control circuit become '1' only once for approximately one hour. And, when the A pattern input terminal becomes '1' before the A and B pattern input terminals both become '1', it is possible to determine the rotation of the transmission wheel as being 'the forward rotation'.

Accordingly, when the construction is of a type wherein the transmission 620 makes one rotation per 24 hours, the rotational position detection signal indicating the detected 'forward rotation' is input to the control circuit (not illustrated) every 24 hours. Simultaneously, when the A and B pattern input terminals become both '1', it is possible to detect the circumferential position of the transmission wheel 620.

Next, the detection of the rotation direction and the operation of the detection of the state of start of the rotation when the transmission wheel rotates in the counterclockwise direction, i.e. reversely rotates will be explained.

Figure 33:
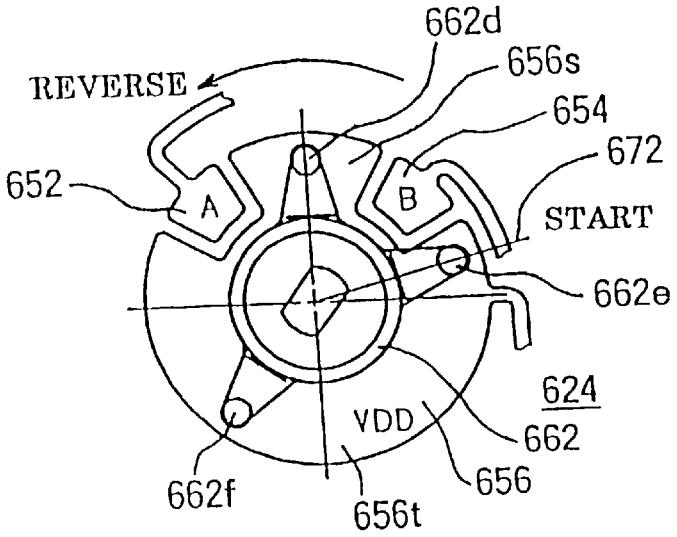
FIG. 33 is a partial plan view illustrating the operation in the direction of a reverse rotation of the fourth structure of the contact point portion of the electronic timepiece according to the present invention.

(g1) Operational State 1:

FIG. 33 illustrates an initial state of the transmission wheel, i.e., an operational state 1 wherein the terminal contact point portion 662*e* of the contact point spring 662 is situated at a start position 670. This state 1 is set to be '0' in a timing chart of FIG. 34.

In the operational state 1 illustrated in FIG. 33, the terminal contact point portion 662*d* contacts with the first pattern portion 656*s* of the VDD pattern 656, the terminal contact point portion 662*e* contacts with the second pattern portion 656*t* of the VDD pattern 656, and the terminal contact point portion 662*f* contacts with the second pattern portion 656*t* of the VDD pattern 656.

In this operational state 1, neither the A pattern detection signal nor the B pattern detection signal is input to the control circuit (not illustrated) Namely, in this operational state 1, the A pattern input terminal and B pattern input terminal of the control circuit are each '0', i.e., 'LOW'.

(g2) Operational State 2:

Next, in an operational state 2 wherein the terminal contact point portion 662*e* of the contact point spring 662 has rotated counterclockwise from the start position 670 up to the position of approximately 15°, the terminal contact point portion 662*d* contacts with the first pattern portion 656*s* of the VDD pattern 656, the terminal contact point portion 662*e* contacts with the B pattern 654, and the terminal contact point portion 662*f* contacts with the second pattern portion 656*t* of the VDD pattern 656.

In this operational state 2, only the B pattern detection signal is input to the control circuit (not illustrated). Namely, in this operational state 2, the A pattern input terminal of the control circuit is '0', i.e. becomes 'LOW', and the B pattern input terminal thereof is '1', i.e., becomes 'HIGH'.

(g3) Operational State 3:

Next, in an operational state 3 wherein the terminal contact point portion 662*e* of the contact point spring 662 has rotated counterclockwise from the start position 670 up to the position of approximately 30°, the terminal contact point portion 662*d* contacts with the A pattern 652, the terminal contact point portion 662*e* contacts with the B pattern 654, and the terminal contact point portion 662*f* contacts with the second pattern portion 656*t* of the VDD pattern 656.

In this operational state 3, the A pattern detection signal and B pattern detection signal are input to the control circuit (not illustrated). Namely, in this operational state 3, the A pattern input terminal of the control circuit is '1', i.e. becomes 'HIGH', and the B pattern input terminal thereof also is '1', i.e., becomes 'HIGH'.

(g4) Operational State 4:

Next, in an operational state 4 wherein the terminal contact point portion 662*e* of the contact point spring 662 has rotated counterclockwise from the start position 670 up to the position of approximately 45°, the terminal contact point portion 662*d* contacts with the A pattern 652, the terminal contact point portion 662*e* contacts with the first pattern portion 656*s* of the VDD pattern 656, and the terminal contact point portion 662*f* contacts with the second pattern portion 656*t* of the VDD pattern 656.

In this operational state 4, only the A pattern detection signal is input to the control circuit (not illustrated) . Namely, in this operational state 4, the A pattern input terminal of the control circuit is '1', i.e. remains to be 'HIGH', and the B pattern input terminal thereof is '0', i.e., becomes 'LOW'.

Accordingly, as illustrated in FIG. 32, the state wherein both the A pattern input terminal and the B pattern input terminal of the control circuit are each '1' lasts for approximately one hour. This is because in a case where it is arranged that the transmission wheel makes one rotation per 24 hours, approximately one hour is needed for the transmission wheel to rotate through an angle of 150.

(g5) Operational State 5:

Next, in an operational state 5 wherein the terminal contact point portion 662*e* of the contact point spring 662 has rotated counterclockwise from the start position 670 up to the position of approximately 60°, the terminal contact point portion 662*d* contacts with the second pattern portion 656*t* of the VDD pattern 656, the terminal contact point portion 662*e* contacts with the first pattern portion 656*s* of the VDD pattern 656, and the terminal contact point portion 662*f* contacts with the second pattern portion 656*t* of the VDD pattern 656.

In this operational state 5, neither the A pattern detection signal nor the B pattern detection signal is input to the control circuit (not illustrated). Namely, in this operational state 5, the A pattern input terminal and B pattern input terminal of the control circuit are each '0', i.e. 'LOW'.

(g6) Operational State Occurring Thereafter

Figure 34:
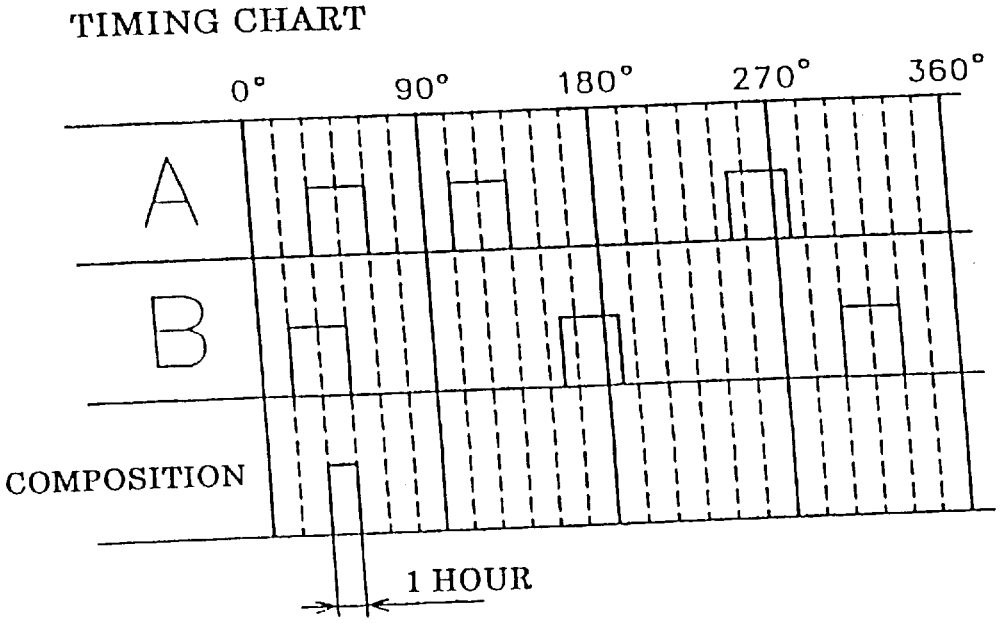
FIG. 34 is a timing chart that corresponds to the time when the fourth structure of the contact point portion of the electronic timepiece according to the present invention is operated in the direction of the reverse rotation.

In an operational state wherein the terminal contact point portion 662*e* has rotated counterclockwise from the start position 670 up to the position of approximately 105° as illustrated in FIG. 34, the A pattern input terminal of the control circuit is '1', i.e. becomes 'HIGH'.

In an operational state wherein the terminal contact point portion 662*e* has rotated counterclockwise from the start position 670 up to the position of approximately 135°, the A pattern input terminal of the control circuit are each '0', i.e. becomes 'LOW'.

In an operational state wherein the terminal contact point portion 662*e* has rotated counterclockwise from the start position 670 up to the position of approximately 157.5°, the B pattern input terminal of the control circuit is '1', i.e. becomes 'HIGH'.

In an operational state wherein the terminal contact point portion 662*e* has rotated counterclockwise from the start position 670 up to the position of approximately 135°, the A pattern input terminal and B pattern input terminal of the control circuit are each '0', i.e. becomes 'LOW'.

In an operational state wherein the terminal contact point portion 662*e* has rotated counterclockwise from the start position 670 up to the position of approximately 247.5°, the A pattern input terminal of the control circuit is '1', i.e. becomes 'HIGH'.

In an operational state wherein the terminal contact point portion 662*e* has rotated counterclockwise from the start position 670 up to the position of approximately 277.5°, the A pattern input terminal and B pattern input terminal of the control circuit are each '0', i.e. 'LOW'.

In an operational state wherein the terminal contact point portion 662*e* has rotated counterclockwise from the start position 670 up to the position of approximately 300°, the B pattern input terminal of the control circuit is '1', i.e. becomes 'HIGH'.

In an operational state wherein the terminal contact point portion 662*e* has rotated counterclockwise from the start position 670 up to the position of approximately 330°, the A pattern input terminal and B pattern input terminal of the control circuit are each '0', i.e. 'LOW'.

Accordingly, in an operational state wherein the terminal contact point portion 662*e* has rotated counterclockwise from the start position 670 up to the position of 360° beyond the position of 60°, there exists no state where the A and the B pattern input terminal both become '1'. And, when the terminal contact point portion 662*e* of the contact point spring 662 rotates counterclockwise from the start position 670 up to the position of 360°, the operational state returns to the initial state illustrated in FIG. 33.

In this construction, when the transmission wheel 620 makes one rotation, the both A pattern input terminal and B pattern input terminal of the control circuit become '1' only once for approximately one hour. And, when the B pattern input terminal becomes '1' before the A and B pattern input terminals both become '1', it is possible to determine the rotation of the transmission wheel as being 'the reverse rotation'.

Accordingly, when the construction is of a type wherein the transmission 620 makes one rotation per 24 hours, the rotational position detection signal indicating the detected 'reverse rotation' is input to the control circuit (not illustrated) every 24 hours. Simultaneously, when the A and B pattern input terminals become both '1', it is possible to detect the circumferential position of the transmission wheel 620.

Figure 14:
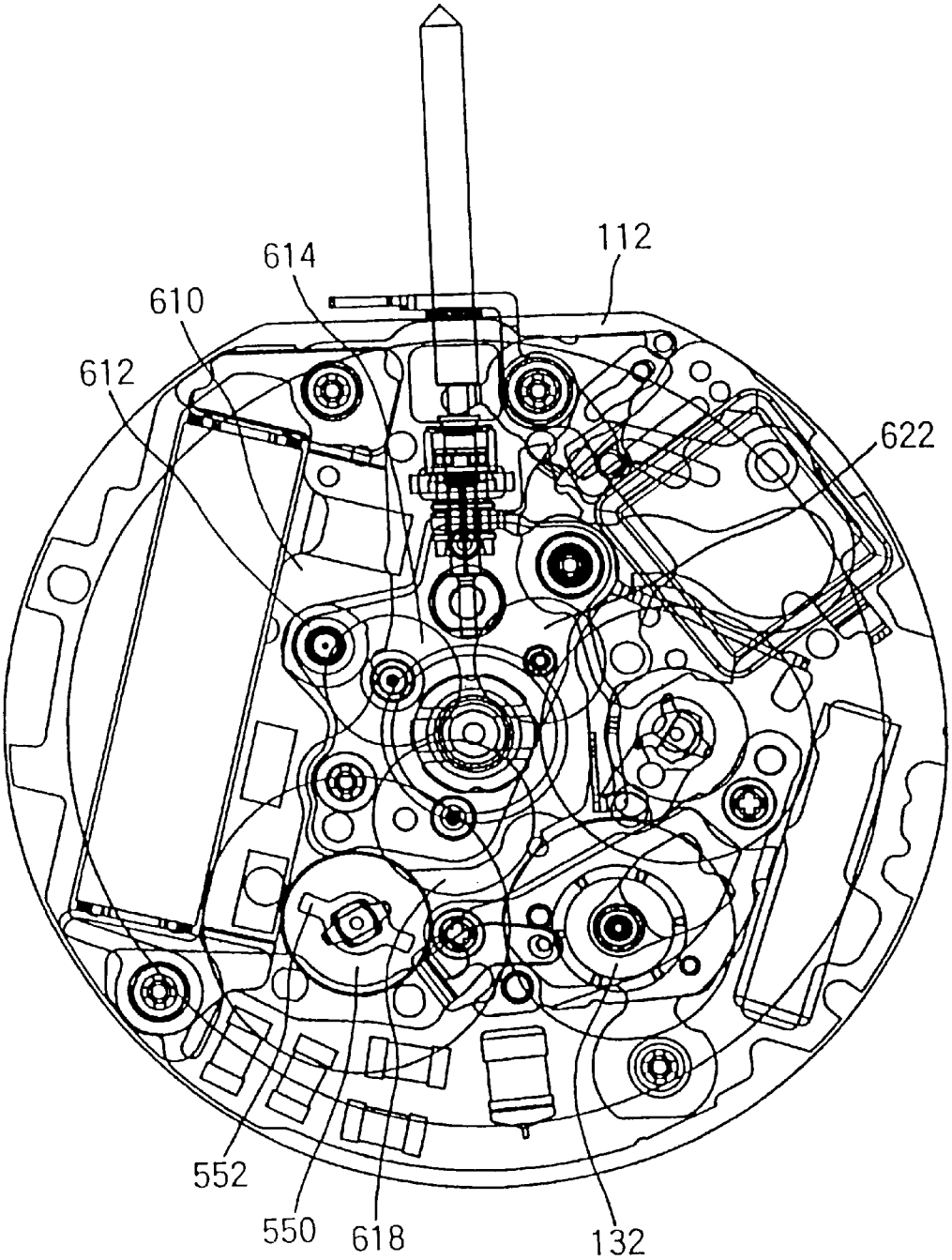
FIG. 14 is a schematic plan view (opened-up view) illustrating an obverse side portion of the fifth embodiment of the electronic timepiece according to the present invention.

(7) Entire Construction Of The Electronic Timepiece According To Sixth Embodiment of The Invention FIG. 14 illustrates an obverse side portion of a movement (mechanical body) of the electronic timepiece according to a sixth embodiment of the present invention. Here, the wording "obverse side portion" means the portion on a side opposite to the side on which a dial 570 is situated with respect to the main plate.

Figure 15:
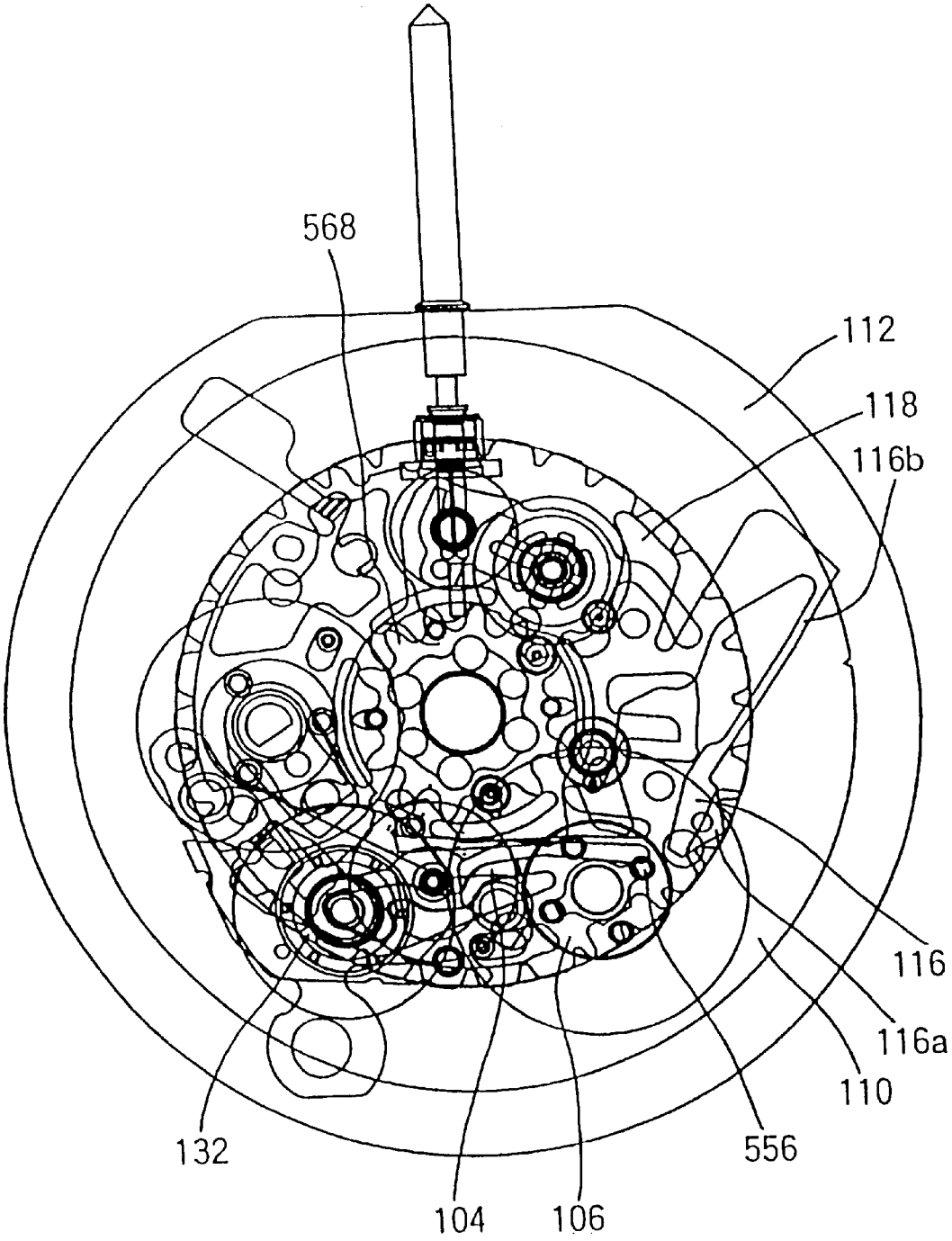
FIG. 15 is a schematic plan view (opened-up view) illustrating a reverse side portion of the sixth embodiment of the electronic timepiece according to the present invention.
Figure 16:
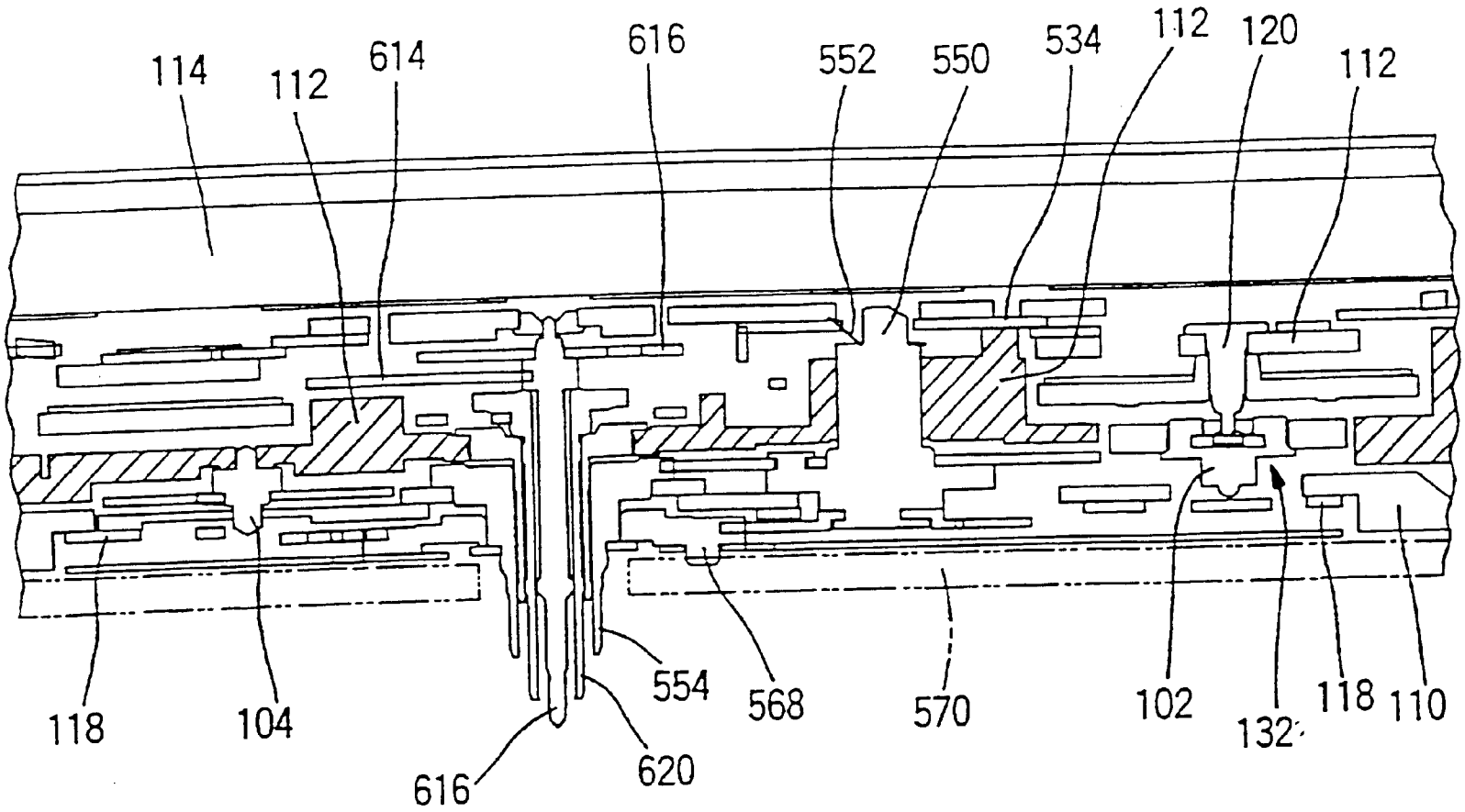
FIG. 16 is a schematic partial sectional view illustrating the sixth embodiment of the electronic timepiece according to the present invention.
Figure 17:
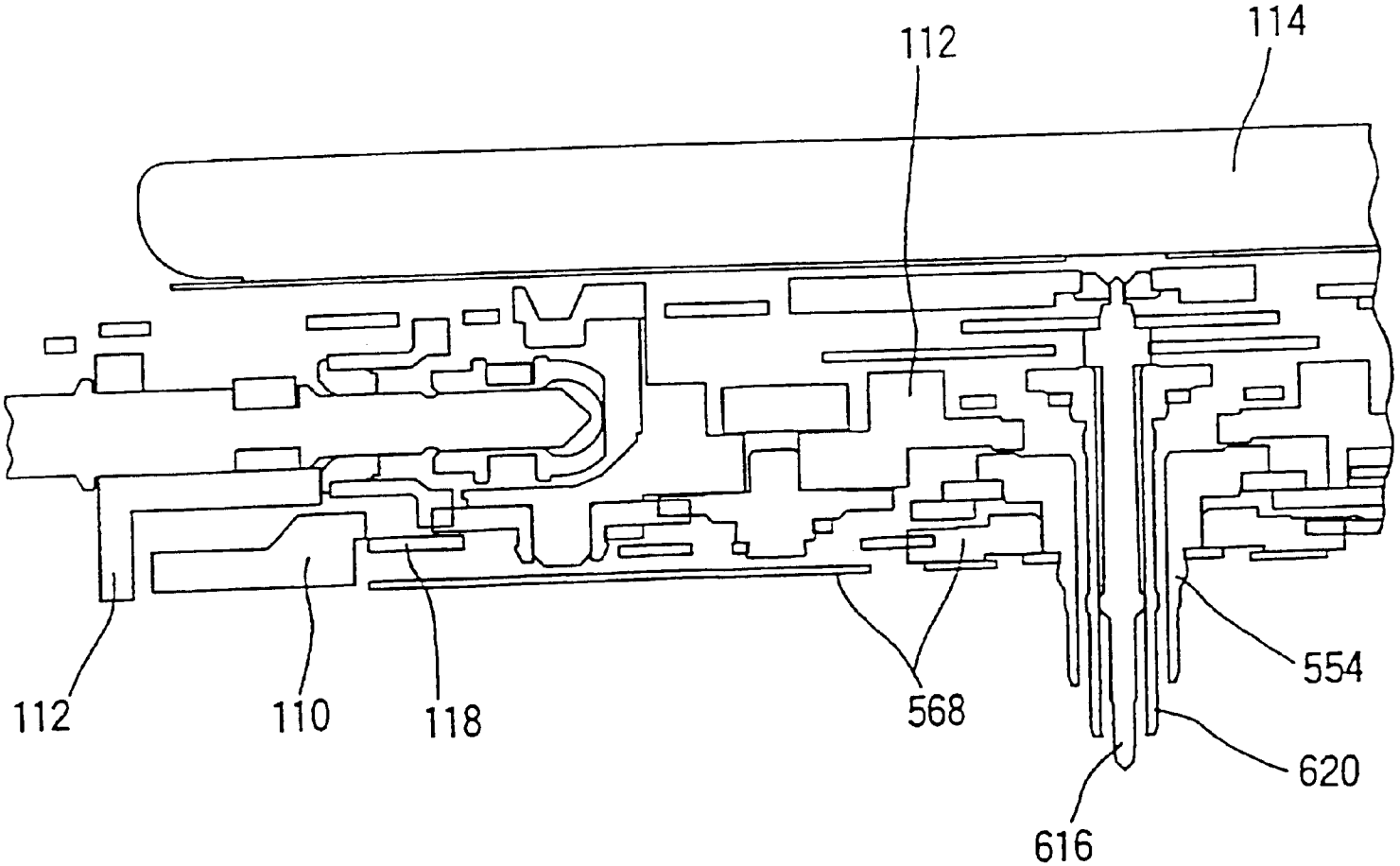
FIG. 17 is a schematic partial sectional view illustrating the sixth embodiment of the electronic timepiece according to the present invention.
Figure 18:
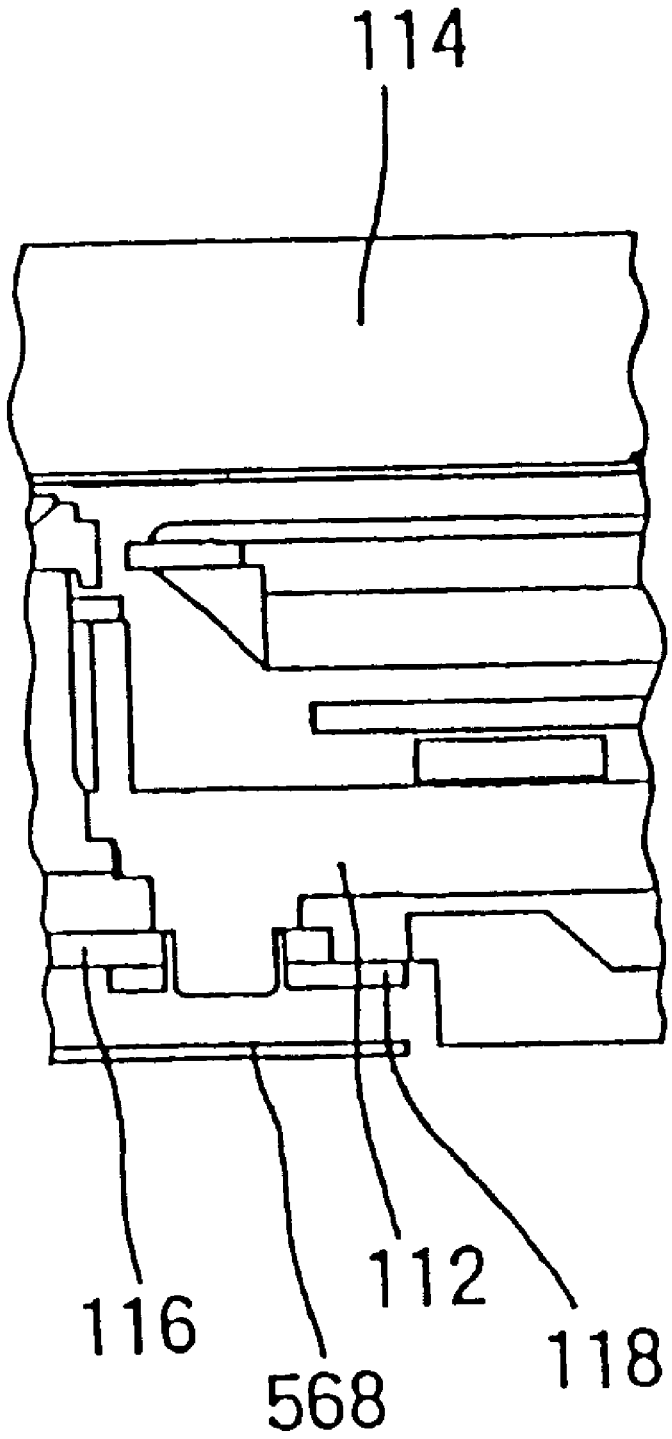
FIG. 18 is a schematic partial sectional view illustrating the sixth embodiment of the electronic timepiece according to the present invention.
Figure 19:
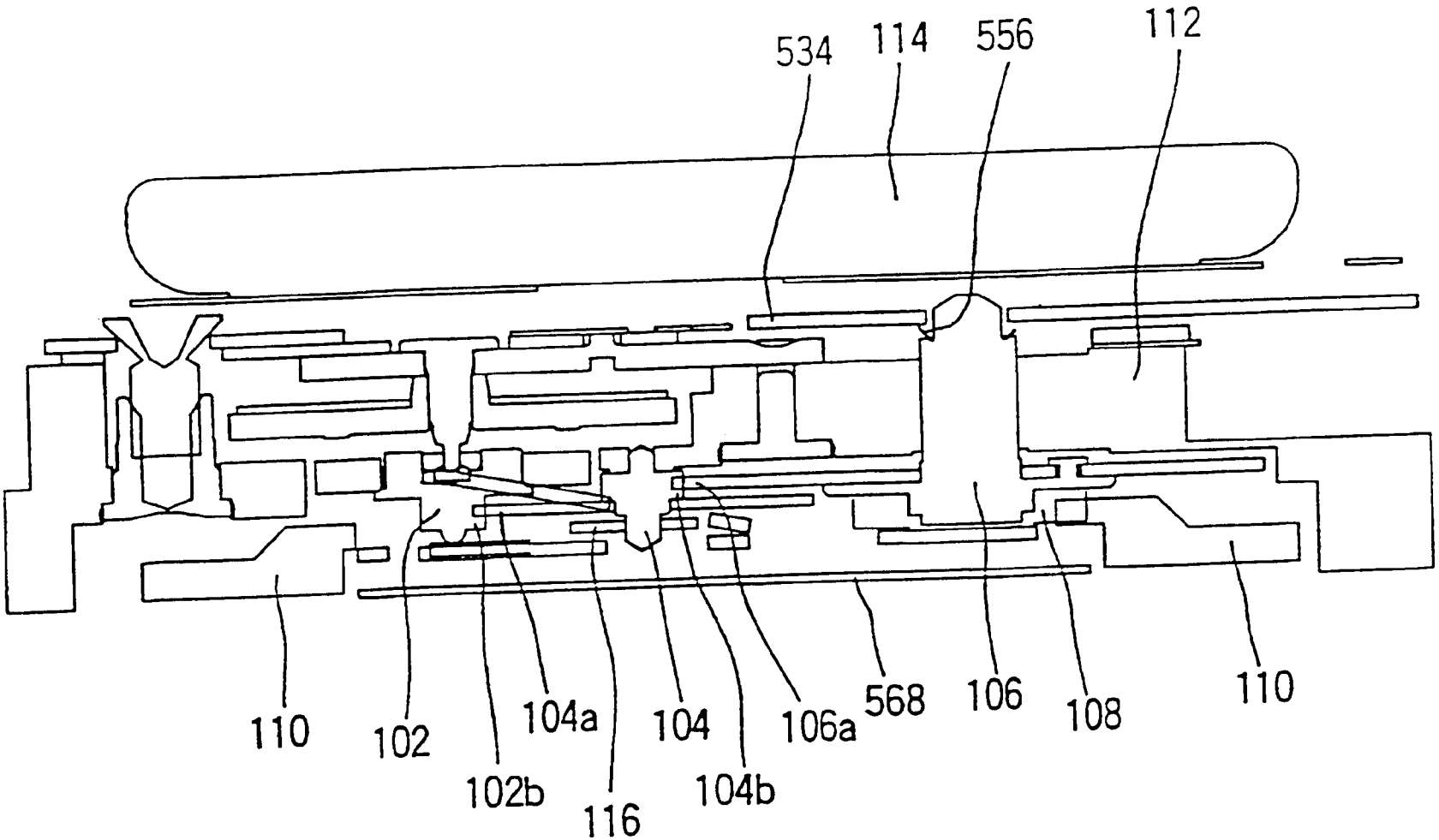
FIG. 19 is a schematic partial sectional view illustrating the sixth embodiment of the electronic timepiece according to the present invention.
Figure 20:
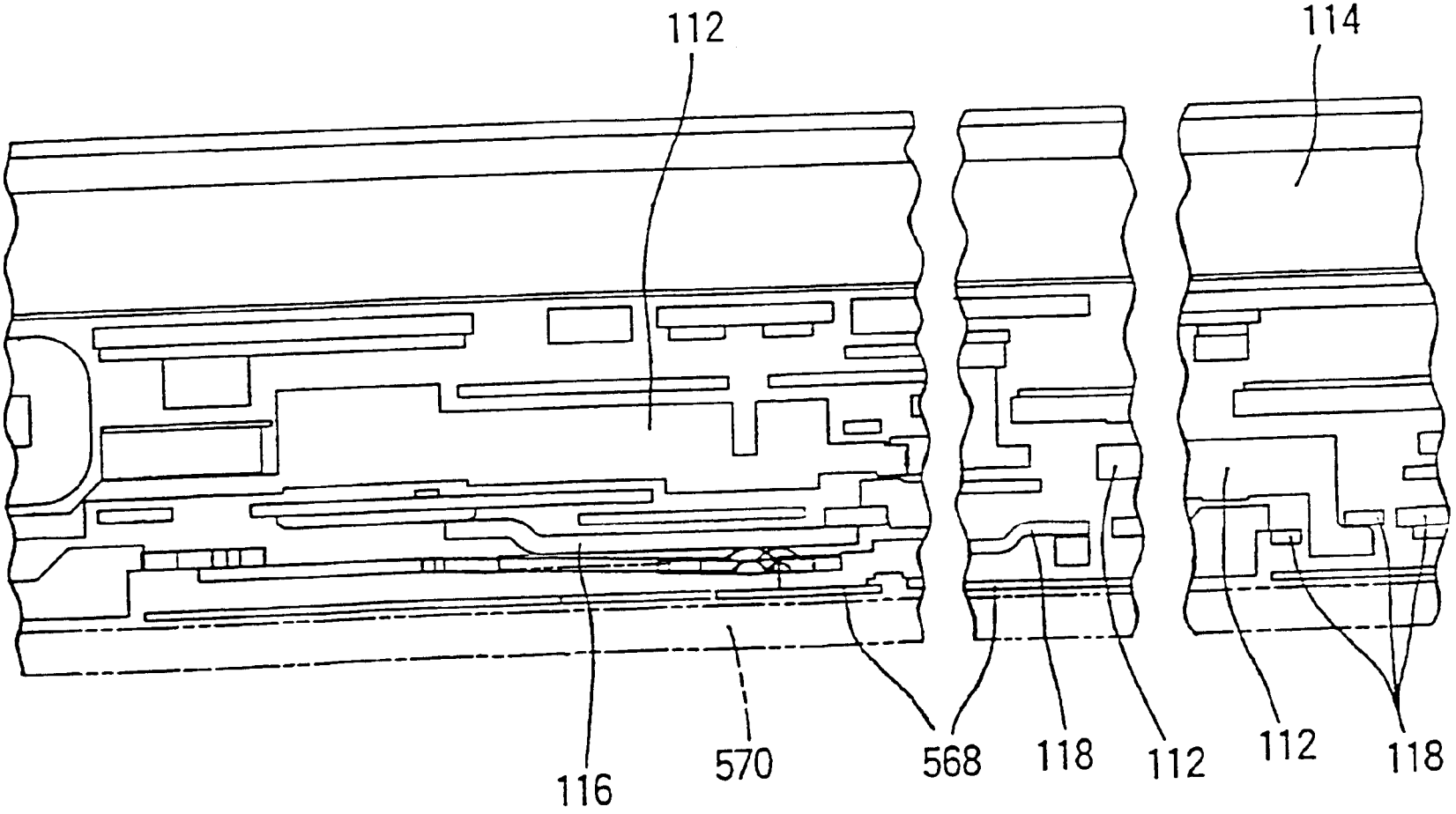
FIG. 20 is a schematic partial sectional view illustrating the sixth embodiment of the electronic timepiece according to the present invention.

FIG. 15 illustrates a reverse side portion of the movement (mechanical body) of the electronic timepiece according to the present invention. Here, the wording "reverse side portion" means the portion on the side on which the dial 570 is situated with respect to the main plate. That is, the date dial is incorporated into the "reverse side portion".

The electronic timepiece of the present invention illustrated in FIGS. 14 to 20 is also equipped with the contact point spring.

Referring to FIGS. 14 to 20, the electronic timepiece of the present invention has the main plate 112. A rotor 612 of a step motor 610 is meshed with a fifth wheel & pinion, which is meshed with a fourth wheel & pinion 616. Due to the rotation of the fourth wheel & pinion 616, a center wheel & pinion 620 rotates through a third wheel & pinion 618 and, further, an hour wheel 554 rotates through a minute wheel 622.

A 24-hour wheel 550 has a 24-hour contact point spring 552. The 24-hour contact point spring 552 is disposed so that this spring 552 can contact with a first pattern (not illustrated) of a circuit block 534. The 24-hour wheel 550 is meshed with the hour wheel 554 and makes one rotation per day. The hour wheel 554 makes one rotation per 12 hours and indicates an 'hour' by an hour hand (not illustrated) mounted on the hour wheel 554.

An ultrasonic rotor axle 120 of an ultrasonic motor 132 is fixed to the main plate 112 and an ultrasonic rotor 102 is rotatably fitted onto the ultrasonic rotor axle 120.

An ultrasonic rotor pinion 102*b* of the ultrasonic rotor 102 is meshed with an intermediate date driving gear wheel 104*a* of an intermediate date driving wheel 104. An intermediate date driving pinion 104*b* of the intermediate date driving wheel 104 is meshed with a date driving gear wheel 106*a* of a date driving wheel 106.

A date finger 108 is provided on the date driving wheel 106 and a date dial 110 which due to the rotation of the date driving wheel 106 simultaneously rotates is rotatably incorporated into the main plate 112. A battery 114 is incorporated into a side opposite to the side on which the date dial 110 is mounted with respect to the main plate 112.

A date jumper 116 is formed integrally with a date dial holder 118. A regulating portion 116*a* of the date jumper 116 regulates a date dial teeth 110*a*. The date jumper 116 has a date jumper spring portion 116*b*.

That is, the date driving wheel 106 has a date driving wheel contact point spring 556. The date driving wheel contact point spring 556 is disposed so that this spring 556 can contact with a second pattern (not illustrated) of the circuit block 534.

In the embodiment of the electronic timepiece of the present invention illustrated in FIGS. 14 to 20, a day of the week indicator 568 is provided and indicates a day of the week.

It is to be noted that the construction may be made into a type wherein indication of a day of the week is made by the day of the week indicator that rotates due to the rotation of the ultrasonic motor.

Figure 39:
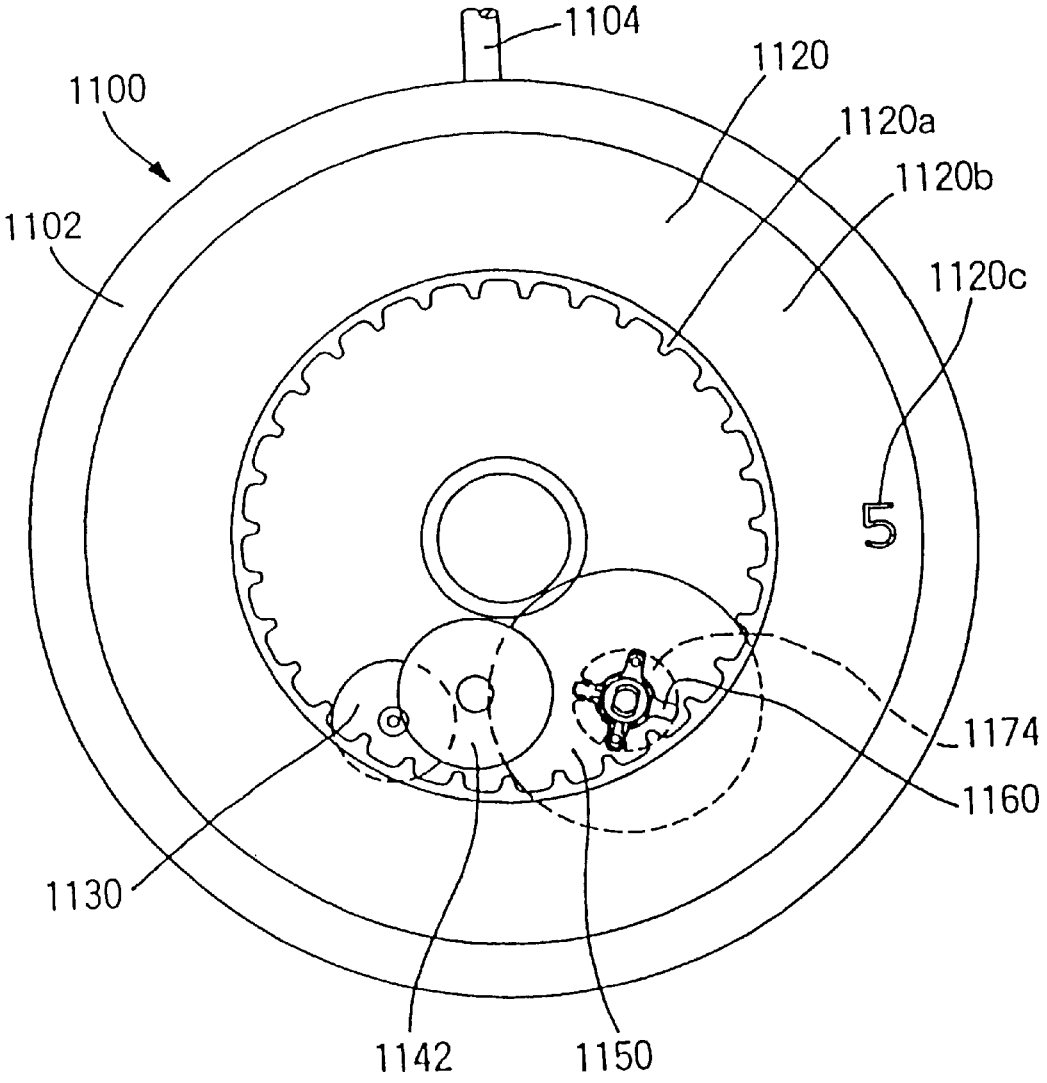
FIG. 39 is a schematic plan view illustrating the structure of a reverse side of the seventh embodiment of the electronic timepiece according to the present invention.
Figure 40:
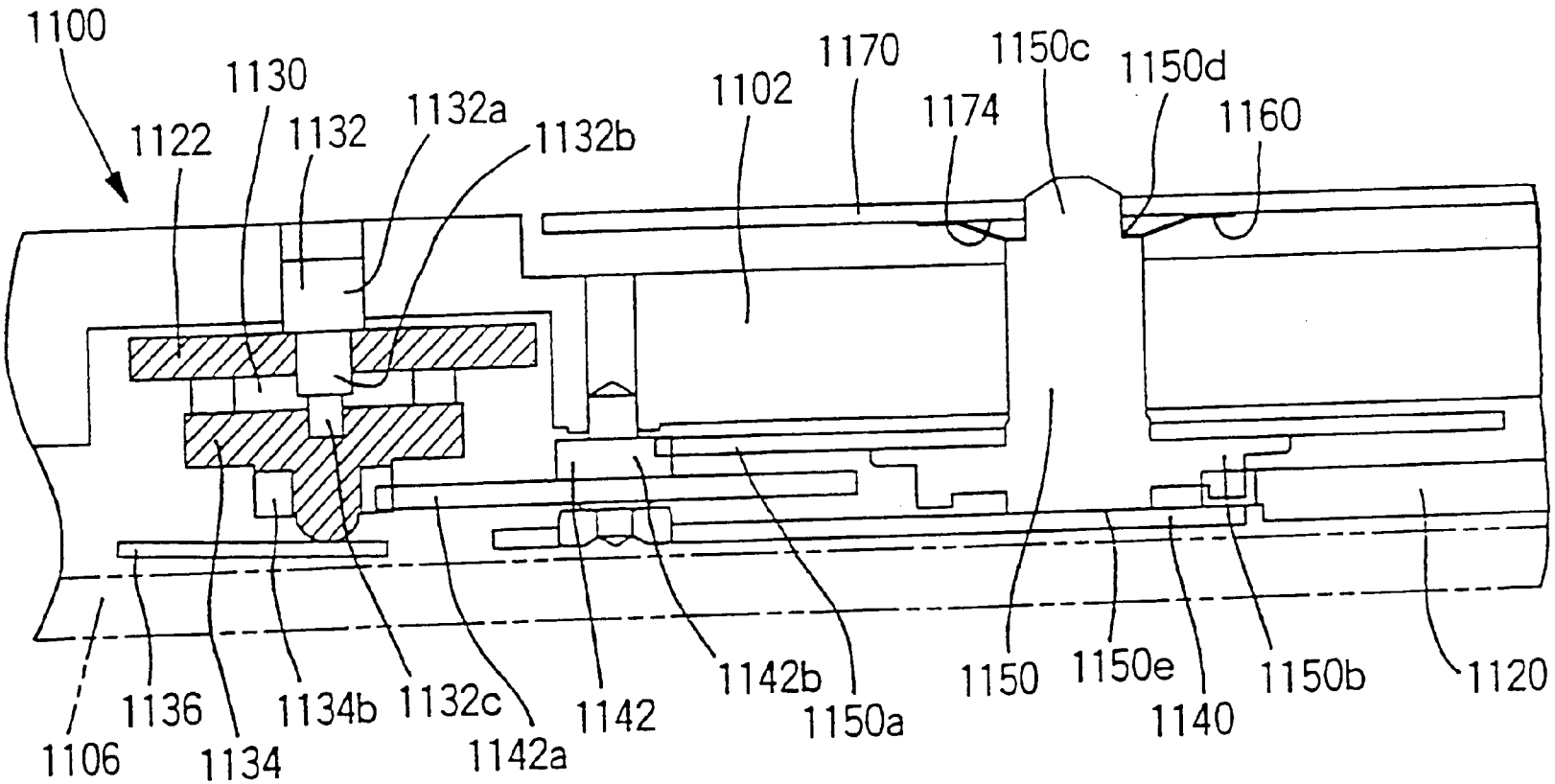
FIG. 40 is a partial sectional view illustrating respective structures of an indication wheel driving mechanism and indication wheel drive detecting mechanism of the seventh embodiment of the electronic timepiece according to the present invention.

(8) Structure and Function Of The Indication Wheel Drive Detecting Mechanism Of The electronic timepiece According To Seventh Embodiment of The Invention Referring to FIGS. 39 and 40, a movement (mechanical body) 1100 of a yet further embodiment of the electronic timepiece according to the present invention is constructed as an analog electronic timepiece and has a main plate 1102 constituting a substrate of the movement. A hand setting stem 1104 is rotatably incorporated into a hand setting stem guiding hole of the main plate 1102. A dial 1106 is mounted on the movement 1100. A dial 1106 is mounted on the movement 1100. A switch device (not illustrated) that operates through operating the hand setting stem 1104 is provided in the main plate 1102.

Of both sides of the main plate 1102, the side on which the dial 1106 is situated is called 'the reverse side' of the movement 1100 and the side opposite to the side on which the dial 1106 is situated is called 'the obverse side' of the movement 1100. The wheel train that is incorporated into the 'obverse side' of the movement 1100 is called 'the obverse wheel train' and the wheel train that is incorporated into the 'reverse side' of the movement is called 'the reverse wheel train'.

The switch device may be incorporated on the 'obverse side' of the movement 1100 or may be incorporated on the 'reverse side' of the movement 1100. The indication wheel such as a date dial, day of the week wheel or the like is incorporated into the 'reverse side' of the movement 1100.

The date dial 1120 is rotatably disposed on the main plate 1102. The date dial 1120 includes a date dial gear wheel portion 1120*a* and a date character print portion 1120*b*. Date characters 1120*c* from '1' to '31' are printed on the date character print portion 1120*b*. For simplifying the drawing, in FIG. 39, there is illustrated only the character '5' alone of the date characters 1120*c*. The date dial gear wheel portion 1120*a* includes thirty one date dial teeth.

An ultrasonic motor 1130 for rotating the date dial 1120 is disposed in the main plate 1102. A motor for rotating the date dial 1120 may be an electromagnetic motor or step motor. By using the ultrasonic motor 1130, it is possible to rotate the date dial 1120 reliably by a reduced number of reduction wheel trains.

The indication wheel for rotating the ultrasonic motor 1130 may be a date dial or a day of the week indicator, or may be another type of wheel for indicating data regarding a time or a calendar, such as an hour wheel, month wheel, year wheel or month age indication wheel.

The ultrasonic motor 1130 has a motor axle 1132, ultrasonic stator 1122 and ultrasonic rotor 1134. The ultrasonic rotor 1134 has an ultrasonic rotor pinion 1134*b*. With regard to the motor axle 1132, a first axle portion 1132*a* is fixed to the main plate 1102, a second axle portion 1132*b* has the ultrasonic stator 1122 fixed thereto and a third axle portion 1132*c* has the ultrasonic rotor 1134 rotatably guided thereby. A pressurizing spring 1136 for pressing the ultrasonic rotor 1134 against the ultrasonic stator 1122 by an elastic force is provided.

A date dial holder 1140 rotatably supports the date dial 1120 with respect to the main plate 1102. An intermediate date driving wheel 1142 is rotatably supported by the main plate 1102 and the date dial holder 1140. An intermediate date driving wheel 142 has an intermediate date driving gear wheel 1142*a* and an intermediate date driving pinion. The ultrasonic rotor pinion 1134*b* is meshed with an intermediate date driving gear wheel 1142*a*.

A date driving wheel 1150 is rotatably supported by the main plate 1102. The date driving wheel 1150 has a date driving gear 1150*a*, date driving gear portion 1150*b*, forward end axle portion 1150*c*, spring guiding portion 1150*d* and support portion 1150*e*. The date driving gear 1150*a* is meshed with an intermediate date driving pinion 1142*b*. The date driving gear portion 1150*b* is meshed with the date dial gear portion 1120*a*. The date driving gear portion 1150*b* has four date driving teeth. The end surface of the support portion 1150*e* contact with the date dial holder 1140.

A contact point spring 1160 is disposed on the spring guiding portion 1150*d*. It is arranged that the contact point spring 1160 rotates integrally with the date driving wheel 1150 through the rotation of the date driving wheel 1150. For example, the contact point spring 116.0 is fitted onto the spring guiding portion 1150*d* so that this spring 1160 cannot rotate about its own axis.

Figure 41:
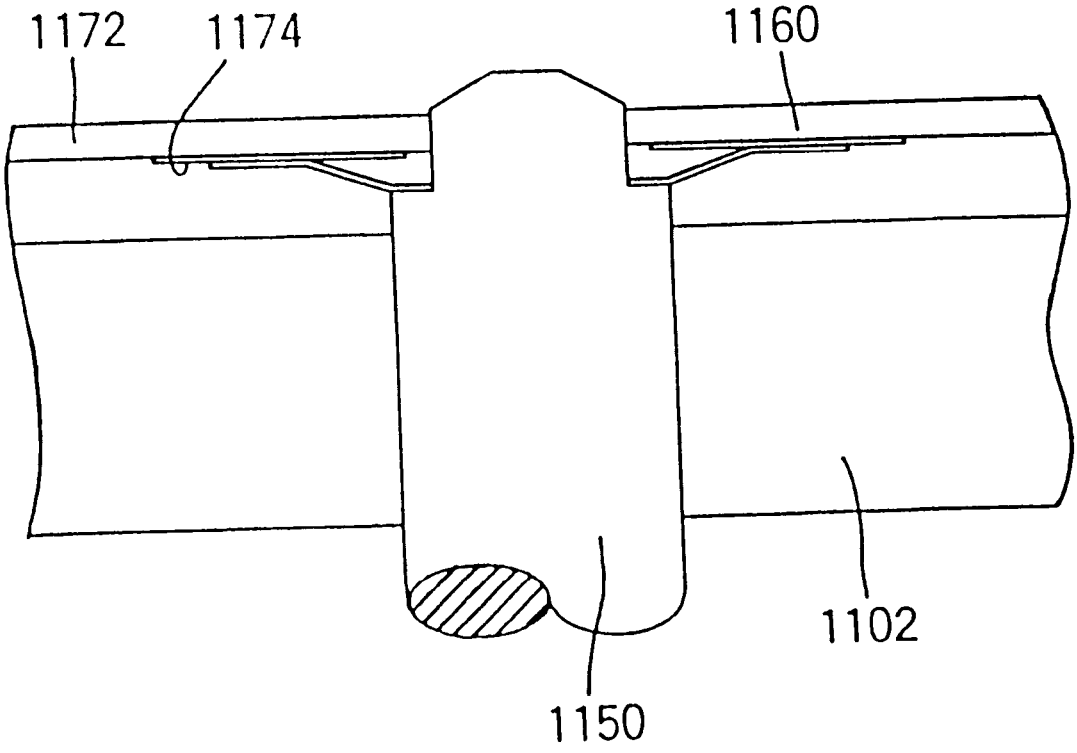
FIG. 41 is a partial sectional view illustrating respective structures of a date driving wheel and contact point spring of the seventh embodiment of the electronic timepiece according to the present invention.

Referring to FIGS. 40 and 41, a circuit block 1172 is provided on the movement 1100. The circuit block 1172 includes a printed circuit board 1170, and an integrated circuit and crystal oscillator (not illustrated). A contact point pattern 1174 is formed on the printed circuit board 1170. The contact point spring 1160 is rotatably provided so that this spring 1160 may contact with the contact point pattern 1174 or move away therefrom. The contact point pattern 1174 is conducted to the integrated circuit.

By contact of the contact point spring 1160 with the contact point pattern 1174, it is possible to detect the state of rotation of the date driving wheel 1150.

Upon contact of the contact point spring 1160 with the contact point pattern 1174, the rotation signal regarding the state of rotation of the date driving wheel 1150 output from the contact point pattern 1174 is input to the ultrasonic motor driving circuit.

Figure 42:
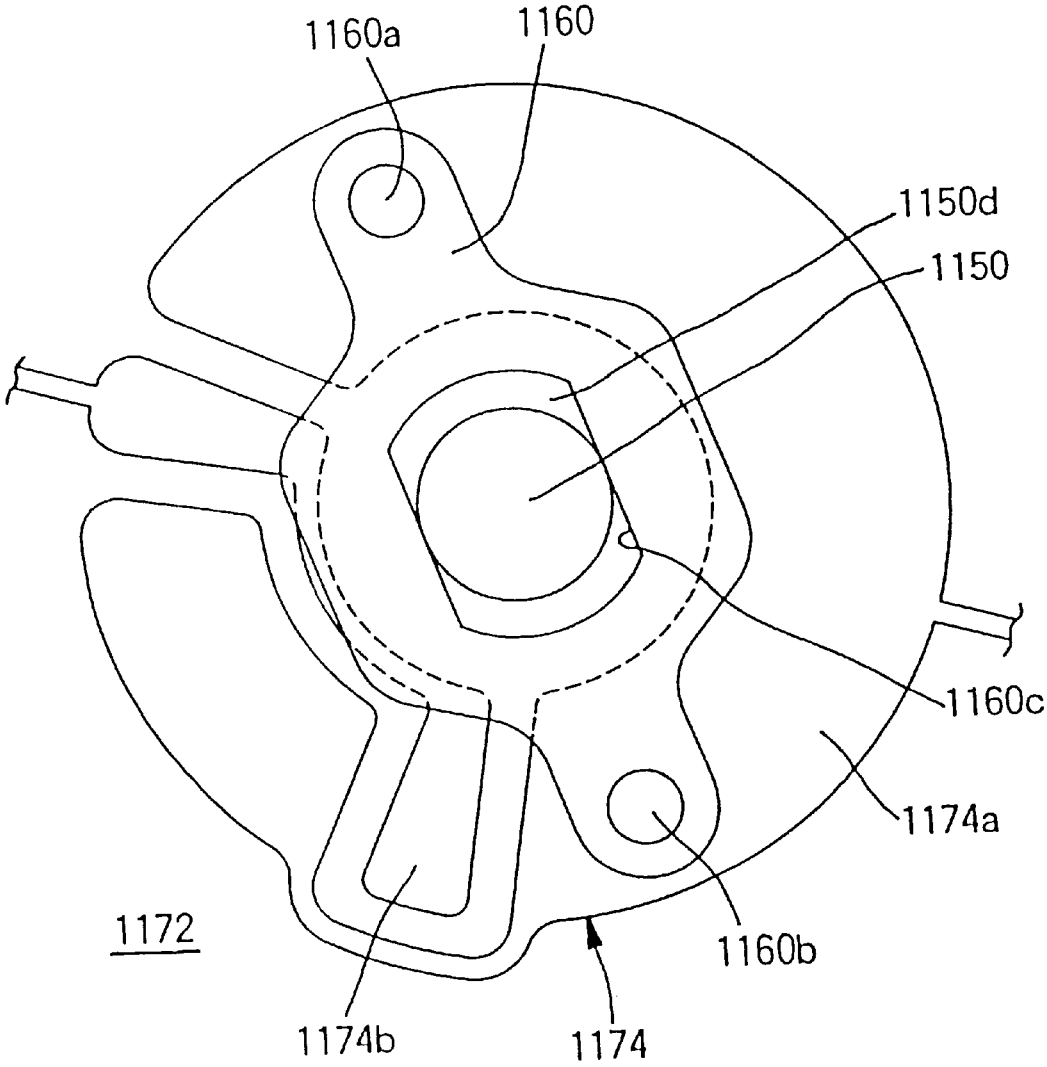
FIG. 42 is a partial sectional view illustrating the relationship between the contact point spring and a contact point pattern which holds true when the contact point is in "on" state, in the seventh embodiment of the electronic timepiece according to the present invention.

Referring to FIG. 42, the contact point pattern 1174 includes a reference potential pattern 1174*a* and a contact point switch pattern 1174*b*. The reference potential pattern 1174*a* is conducted to one potential of the battery (not illustrated), e.g. a plus terminal. The contact point switch pattern 1174*b* is conducted to a contact point terminal of the integrated circuit.

The contact point spring 1160 includes a first contact point portion 1160*a*, second contact point portion 1160*b* and a long hole 1160*c*. The long hole 1160*c* is disposed on the spring guiding portion 1150*d* of the date driving wheel 1150. The contact point spring 1160 is constructed so that this spring 1160 may rotate integrally with the date driving wheel 1150.

The first contact point portion 1160*a* extends from the long hole 1160*c* in a first direction and the second contact point portion 1160*b* extends from the long hole 1160*c* in a second direction. It is arranged that the first and the second direction define an angle of 180° about the long hole 1160*c*. The first contact point portion 1160*a* and the second contact point portion 1160*b* are provided so as to abut against the contact point pattern 1174 by the elastic force. The contact point spring 1160 is formed of, for example, an elastic material having a conductivity such as stainless steel.

Figure 43:
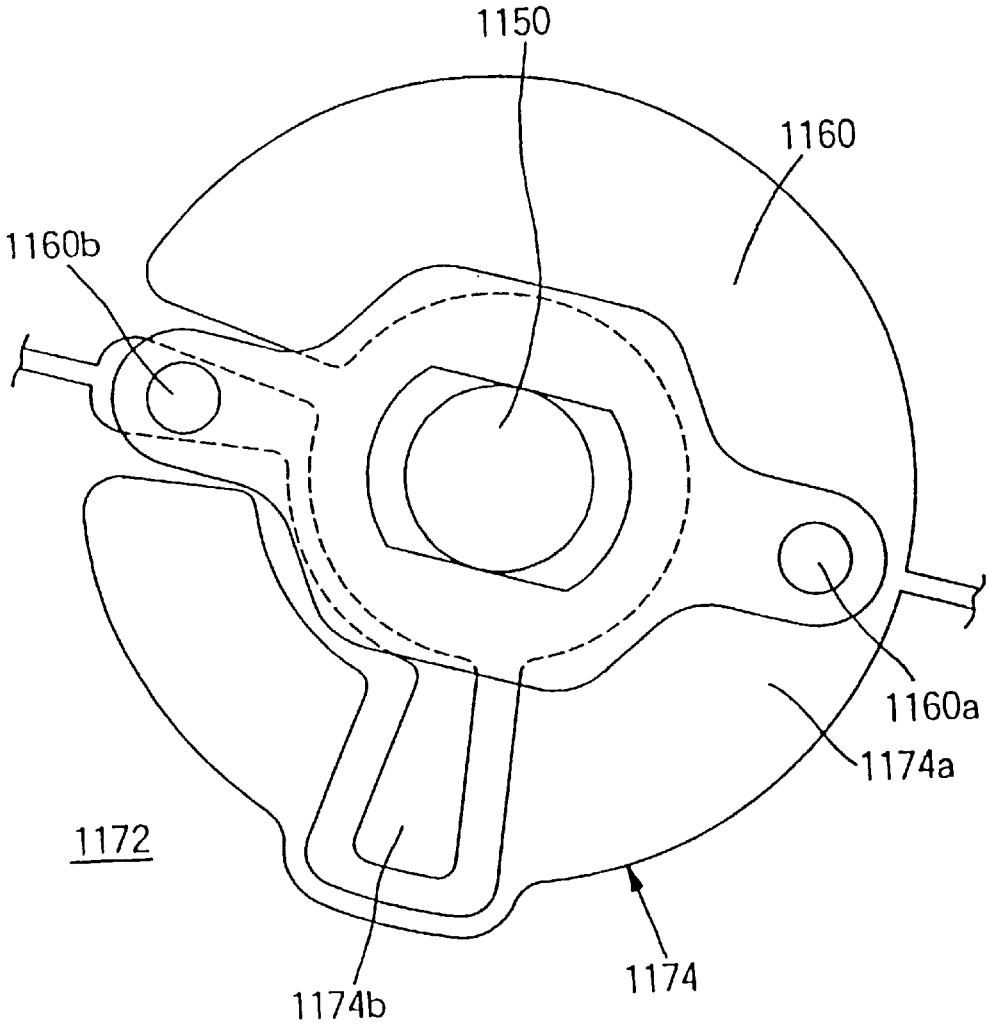
FIG. 43 is a partial sectional view illustrating the relationship between the contact point spring and a contact point pattern which holds true when the contact point is in "off" state, in the seventh embodiment of the electronic timepiece according to the present invention.

In contrast to this, in a state where as illustrated in FIG. 43 the first contact point portion 1160*a* contacts with the reference potential pattern 1174*a* and the second contact point portion 1160*b* contacts with the contact point switch pattern 1174*b*, the rotation signal is output. Similarly, in a state where the first contact point portion 1160*a* contacts with the contact point switch pattern 1174*b* and the second contact point portion 1160*b* contacts with the reference potential pattern 1174*a*, also, the rotation signal is output.

In a state where none of the first contact point portion 1160*a* and the second contact point portion 1160*b* contacts with the contact point switch pattern 1174*b*, no rotation signal is output.

(9) Structure And Function Of The Obverse Side Of The Electronic Timepiece According Seventh Embodiment Of To The Invention Next, the structure of the obverse side of a yet further embodiment of the electronic timepiece according to the present invention will be explained.

Figure 44:
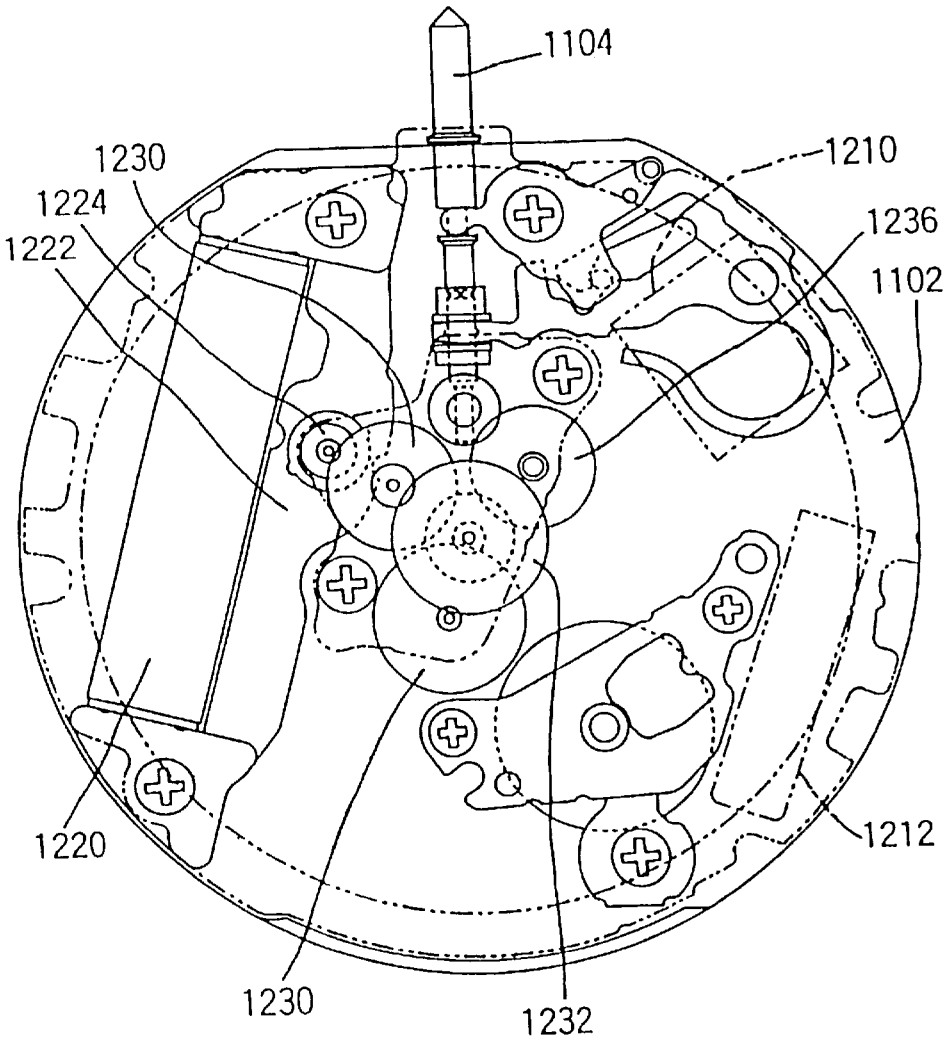
FIG. 44 is a schematic plan view illustrating the structure of an obverse side of the seventh embodiment of the electronic timepiece according to the present invention.
Figure 45:
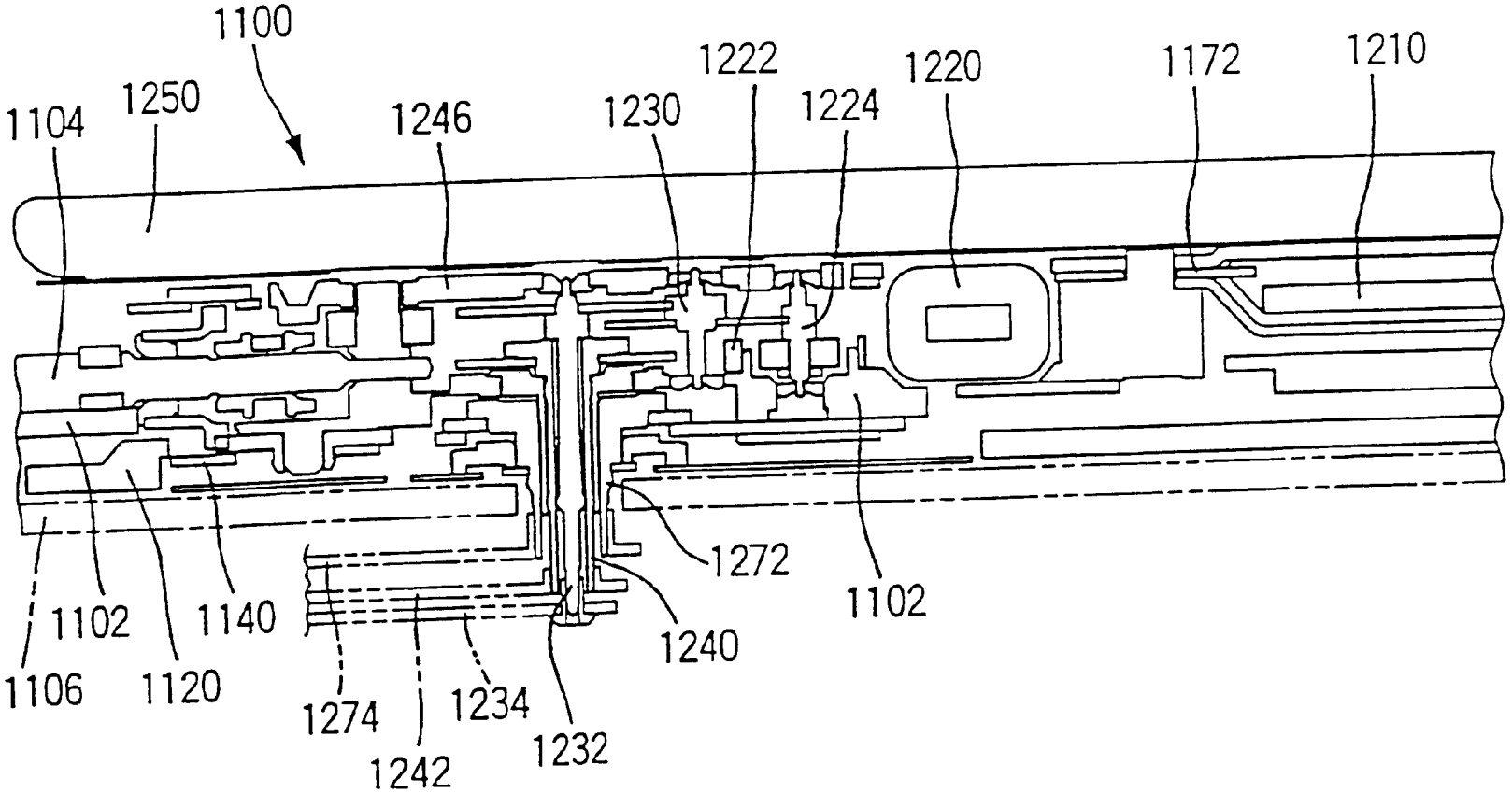
FIG. 45 is a partial sectional view illustrating the structure of an obverse wheel train of the seventh embodiment of the electronic timepiece according to the present invention. And, FIG. 46 is a block diagram illustrating the seventh embodiment of the electronic timepiece according to the present invention.

Referring to FIGS. 44 and 45, on the obverse side of the movement 1100 there is disposed a circuit block 1172, which has the printed circuit board 1170, integrated circuit 210 and crysal oscillator 1212.

The movement 1100 has a coil block 1220, stator 1222 and rotor 1224. A fifth wheel & pinion 1230 is disposed so as to rotate according to the rotation of the rotor 1224. A fourth wheel & pinion 1232 is disposed so as to rotate according to the rotation of the fifth wheel & pinion 1230. A second hand 1234 for indicating a 'second' is mounted on the fourth wheel & pinion 1232. A third wheel & pinion 1236 is disposed so as to rotate according to the rotation of the fourth wheel & pinion 1232. A center wheel & pinion 1240 is disposed so as to rotate according to the rotation of the third wheel & pinion 1236. A minute hand 1242 for indicating a 'minute' is mounted on the center wheel & pinion 1240. A battery 1250 is disposed on the circuit block 1172 and train wheel bridge 1246.

Next, the function of the indication wheel equipped timepiece of the present invention will be explained.

Figure 46:
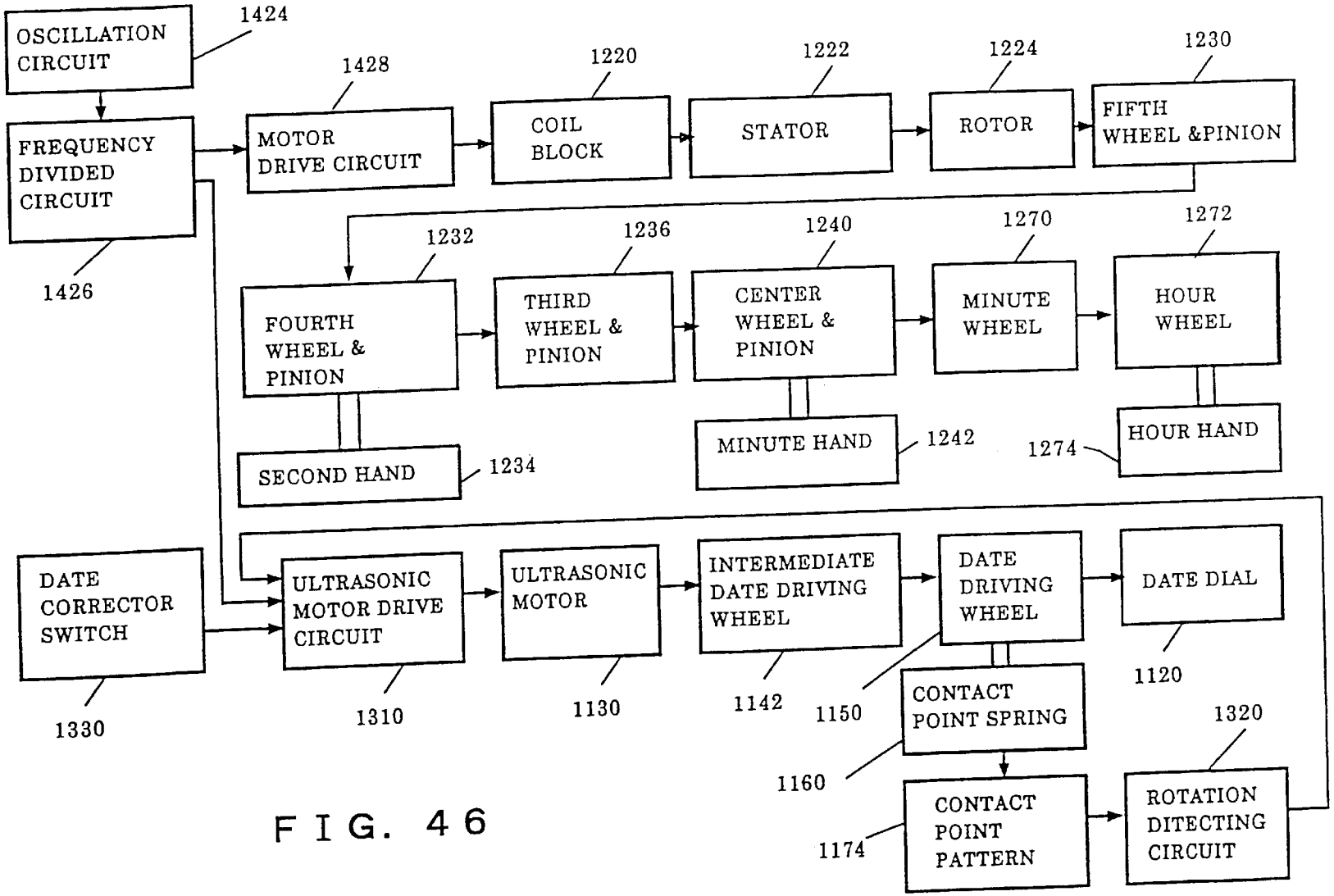

Referring to FIG. 46, an oscillation circuit 1424 outputs a reference signal. The oscillation circuit 1424 includes a crystal oscillator 1212 constitutes an oscillation source. The crystal oscillator 1212 oscillates at a frequency of, for example, 32, 768 hertz. According to the oscillation of this crystal oscillator 1212 a frequency dividing circuit 1426 divides the frequency of an output signal from the oscilation circuit 1424. A motor driving circuit 1428 outputs a motor driving signal for driving the step motor according to the output signal from the frequency dividing circuit 1426. The oscillation circuit 1424, frequency dividing circuit 1426 and motor driving circuit 1428 are contained in the integrated circuit 1210.

Upon input of the motor driving signal by the coil block 1220, the stator 1222 is magnetized to rotate the rotor 1224. The rotor 1224 rotates through an angle of 180°, for example, per second.

According to the rotation of the rotor 1224, the fourth wheel & pinion 1232 rotates through the rotation of the fifth wheel & pinion 1230. It is arranged that the fourth wheel & pinion 1232 makes one rotation per minute. The second hand 1234 rotates integrally with the fourth wheel & pinion 1232.

The third wheel & pinion 1236 rotates according to the rotation of the fourth wheel & pinion 1232. The center wheel & pinion 1240 rotates according to the rotation of the third wheel & pinion 1236. The minute hand 1242 rotates integrally with the center wheel & pinion 1240. A slip mechanism (not illustrated) is provided on the center wheel & pinion 1240. When obtaining a hand/time coincidence, by rotating the hand setting stem 1104 in a state where the second hand 1234 is kept stopped, the minute hand 1242 and hour hand can be rotated through the use of the slip mechanism. The center wheel & pinion 1240 makes one rotation per hour.

A minute wheel 1270 rotates according to the rotation of the center wheel & pinion 1240. An hour wheel 1272 rotates according to the rotation of the minute wheel 1270. The hour wheel 1272 makes one rotation per 12 hours. An hour hand 1274 is mounted on the hour wheel 1272. The hour hand 1274 rotates integrally with the hour wheel 1272.

An ultrasonic motor driving circuit 1310 outputs an ultrasonic motor driving signal for driving the ultrasonic motor 1130 according to the output signal from the frequency dividing circuit 1426. The ultrasonic motor driving circuit 1310 is contained in the integrated circuit 1210.

An intermediate date driving wheel 1142 rotates according to the operation of the ultrasonic motor 1130. The date driving wheel 1150 rotates according to the rotation of the intermediate date driving wheel 1142. Through the rotation of the date driving wheel 1150, the date driving gear portion 1150*b* rotates the date dial 1120. The signal that is output from the ultrasonic motor driving circuit 1310 is output so as to rotate the date dial 1120 one tooth per day.

Through the rotation of the date driving wheel 1150, the contact point spring 1160 rotates. Through the rotation of the contact point spring 1160, there results a state wherein the first contact point portion 1160*a* contacts with the reference potential pattern 1174*a* and the second contact point portion 160*b* contacts with the contact point switch pattern 1174*b*. In this state, the rotation signal is output to a rotation detecting circuit 1320. The rotation detecting circuit 1320 is contained in the integrated circuit 1210.

When the rotation detecting circuit 1320 inputs a rotation signal, the rotation detecting circuit 1320 outputs an ultrasonic motor control signal to the ultrasonic motor driving circuit 1310 in order to control the operation of the ultrasonic motor 1130. Upon input of the ultrasonic motor control signal, the ultrasonic motor driving circuit 1310 stops outputting the ultrasonic motor driving signal. By making this construction, it is possible to control the rotation of the date dial 1120.

Further, through the rotation of the date driving wheel 1150, the contact point spring 1160 rotates. Through the rotation of the contact point spring 1160, there results a state where the first contact point portion 1160*a* moves away from the reference potential pattern 1174*a* to contact with the contact point switch pattern 1174*b* and the second contact point portion 1160*b* moves away from the contact point switch pattern 1174*b* to contact with the reference potential pattern 1174*a*. In this state, also, the rotation signal is output to the rotation detecting circuit 1320.

When the rotation detecting circuit 1320 inputs a rotation signal, the rotation detecting circuit 1320 outputs an ultrasonic motor control signal to the ultrasonic motor driving circuit 1310 in order to control the operation of the ultrasonic motor 1130. Upon input of the ultrasonic motor control signal, the ultrasonic motor driving circuit 1310 stops outputting the ultrasonic motor driving signal. By making this construction, it is possible to rotate the date dial 1120 by the extent corresponding to one tooth one time everyday.

It is arranged that through the operation of a date correction switch 1330 the date dial 1120 can be rotated. Upon operation of the date correction switch 1330, the ultrasonic motor driving circuit 1310 outputs an ultrasonic motor driving signal for driving the ultrasonic motor 1130. By this construction, it is possible to change the indication of the date dial 1120. The date correction switch 1330 may be constructed so as to operate through the operation of the hand setting stem 1104 or a button or the like for operating the date correction switch 1330 may be provided as the date correction switch 1330.

(10) Structure And Function Of Electronic Timepiece According To Eighth Embodiment Of The Invention Next, an explanation will be given of the structure of the calendar mechanism of the electronic timepiece according to an eighth embodiment of the present invention.

Figure 47:
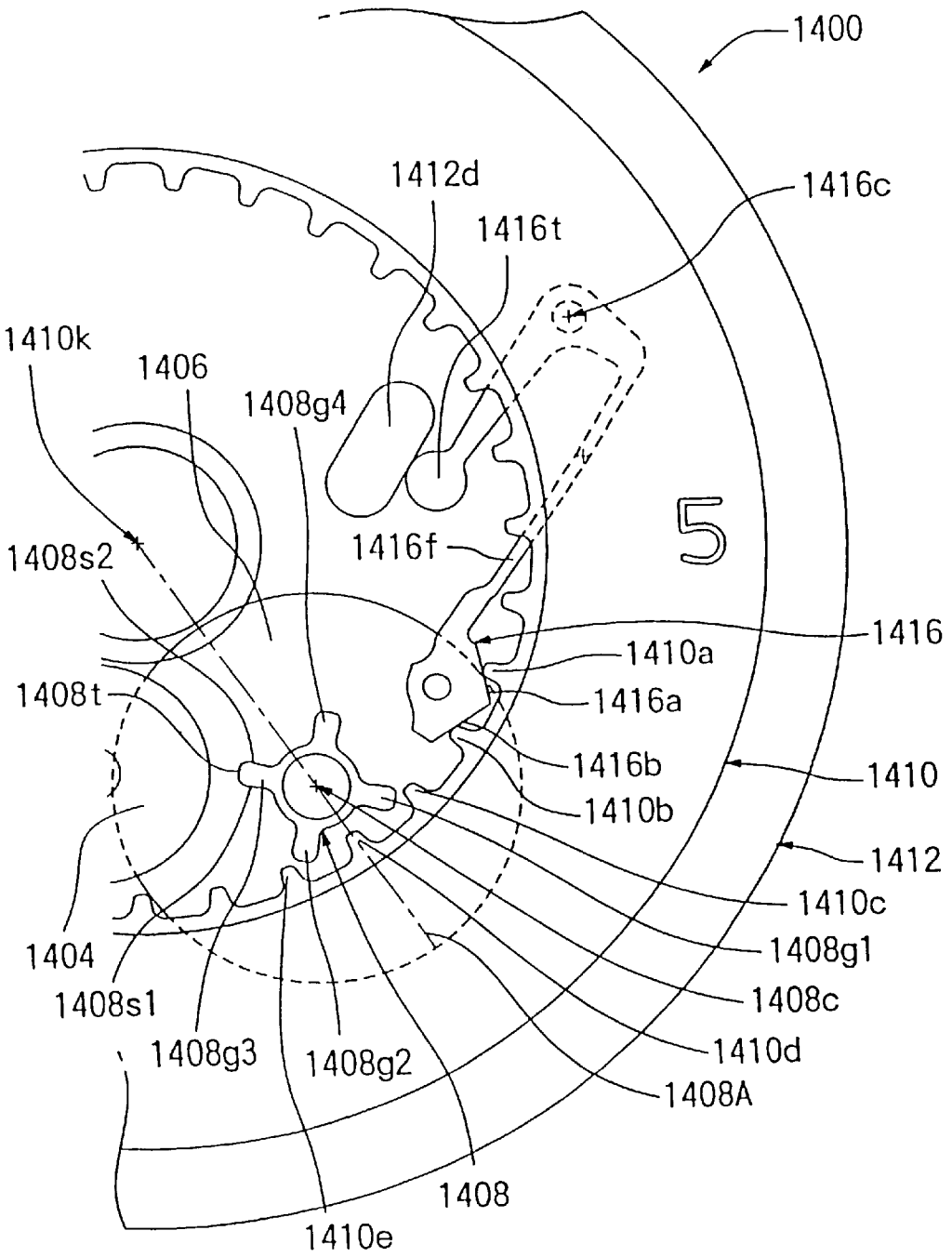
FIG. 47 is a schematic plan view illustrating a calendar mechanism portion of an eighth embodiment of the electronic timepiece according to the present invention that is equipped with a date finger of a first configuration.

Referring to FIG. 47, according to the eighth embodiment of the present invention, in the calendar-equipped electronic timepiece 1400, an ultrasonic motor (not illustrated) is used as the motor for rotating the date dial 1410. This ultrasonic motor includes an ultrasonic rotor. An ultrasonic rotor pinion of the ultrasonic rotor is meshed with the intermediate date driving gear of the intermediate date driving wheel 1404. An intermediate date driving pinion of the intermediate date driving wheel 1404 is meshed with a date driving gear of the date driving wheel 1406.

The date finger 1408 is provided on the date driving wheel 1406 and, when the date driving wheel 1406 is rotated, is rotated simultaneously therewith. The date finger 1408 includes four date finger portions 1408*g*1, 1408*g*2, 1408*g*3 and 1408*g*4.

The date dial 1410 is rotatably incorporated with respect to the main plate 1412. The date dial 1410 has thirty one date dial teeth. Day characters that consist, respectively, of the numeric values '1' to '31' are provided on the indication surface of the date dial 1410. Here, for simplification of the drawing, only a single day character '5' alone is illustrated in FIG. 47.

The date jumper 1416 is rotatably incorporated with respect to the main plate 1412 so as to rotate about a date jumper rotation center 1416*c*. The date jumper 1416 has a date jumper spring portion 1416*f*. A tail portion 1416*t* of the date jumper 1416 is positioned by a positioning portion 1412*d*. By the spring force of the date jumper spring portion 1416*f*, a regulating portion 1416*a* of the date jumper 1416 regulates a date dial tooth 1410*a* and a regulating portion 1416*b* of the date jumper 1416 regulates a date dial tooth 1410*b*.

The date jumper 1416 may be formed as a separate part as illustrated or may be formed integrally with the date dial holder; back part holder or the like.

Each of the date finger portions 1408*g*1, 1408*g*2, 1408*g*3 and 1408*g*4 is formed into the same configuration and has an outer-peripheral portion 1408*t* shaped like a circular arc whose circle has a center 1408*c* or approximately shaped like this circular arc and two side portions 1408*s*1 and 1408*s*2 respectively extending from both ends of this outer-peripheral portion 1408*t* toward a side nearer to the center 1408*c*. Although in FIG. 47 illustration is made of the outer-peripheral portion 1408*t* and side portions 1408*s*1 and 1408*s*2 with regard to only the date finger 1408*g*3 alone, the configurations of the outer-peripheral portion 1408*t* and side portions 1408*s*1 and 1408*s*2 are the same, also, with regard to the other date fingers 1408*g*1, 1408*g*2 and 1408*g*4.

At the intersection portion between the outer-peripheral portion 1408*t* and each of the side portions 1408*s*1 and 1408*s*2 there is provided a corner 'R' (relatively small circular arc). Each of the side portions 1408*s*1 and 1408*s*2 may be formed in the form of a line, or one or more circular arcs, or a combination of lines and circular arcs. Each of the side portions 1408*s*1 and 1408*s*2 is so formed as to have such a configuration as to enable the reliable rotation of the date dial 1410 with the rotation of the date finger 1408.

In contrast to this, the outer-peripheral portion 1408*t* is formed into a configuration which when the date dial 1410 rotates and has thereby contacted with the outer-peripheral portion 1408*t* causes the rotation of the date dial 1410.

Namely, in the FIG. 47 illustrated embodiment of the electronic timepiece of the present invention, the date finger 1408 is so constructed as to have lock tooth configurations at respective forward end portions of its date finger portions 1408*g*1, 1408*g*2, 1408*g*3 and 1408*g*4.

As in the case of the above-described fifth embodiment of the present invention, the contact point spring is provided on the date driving wheel 1404 and it is arranged that the state of rotation of the date driving wheel 1406 is detected by the mutual contact between the contact point pattern of the printed circuit board and the contact point spring. And, it is arranged that the motor drive circuit controls the rotation of the ultrasonic motor by inputting the rotation signal output from the contact point pattern.

It is arranged that the date jumper 1416 regulates the position in the rotation direction of the date dial 1410 so that one date dial tooth 1410*d* of the date dial 1410 may be located on a straight line 1408A passing through a rotation center 1410*k* of the date dial 1410 and a rotation center 1408*c* of the date finger 1408.

In a state where the ultrasonic motor is being stopped, the two date finger portions 1408*g*1 and 1408*g*2 of the four date finger portions are positioned symmetrically about the straight line 1408A as a symmetry axis.

Next, an explanation will be given of the function of the calendar mechanism of the electronic timepiece according to the eighth embodiment of the present invention.

In the electronic timepiece 1400, in the same way as in the seventh embodiment of the present invention explained in connection with FIGS. 42 and 43, through the rotation of the date driving wheel 1406, the first contact point portion 1160*a* and the second contact point portion 1160*b* can contact with the reference potential pattern 1174*a* and the contact point switch pattern 1174*b* in the order mentioned. And, as illustrated in FIG. 42, in a state where both of the first contact point portion 1160*a* and the second contact point portion 1160*b* contact with the reference potential pattern 1174*a*, no rotation signal is output.

In contrast to this, as illustrated in FIG. 43, in a state where the first contact point portion 1160*a* contacts with the reference potential pattern 1174*a* and the second contact portion 1160*b* contacts with the contact point switch pattern 1174*b*, the rotation signal is output. Similarly, in a state where the first contact point portion 1160*a* contacts with the contact point switch pattern 1174*b* and the second contact point portion 1160*b* contacts with the reference potential pattern 1174*a*, also, the rotation signal is output.

In a state where neither the first contact point portion 1160*a* nor the second contact point portion 1160*b* contacts with the contact point switch pattern 1174*b*, no rotation signal is output.

Accordingly, referring to FIG. 47, by operating the ultrasonic motor and thereby rotating the date driving wheel 1406 clockwise through an angle of 90°, the date finger portion 1408*g*1 can also be rotated clockwise through an angle of 90°, whereby the date dial tooth 1410*d* of the date dial 1410 can be rotated clockwise. And, through the operation of the date jumper 1416, the date dial 1410 stops in a state where the date dial 1410 has been rotated clockwise through an angle of (360/31)°.

In this state, the motor drive circuit inputs the rotation signal output from the contact point pattern to thereby control the rotation of the ultrasonic motor. Accordingly, the date driving wheel 1406 stops in a state where the date driving wheel 1406 has been rotated clockwise through an angle of 90°.

Also, by operating the ultrasonic motor and thereby rotating the date driving wheel 1406 counterclockwise through an angle of 90°, the date finger portion 1408*g*1 can also be rotated counterclockwise through an angle of 90°, whereby the date dial tooth 1410*d* of the date dial 1410 can be rotated counterclockwise. And, through the operation of the date jumper 1416, the date dial 1410 stops in a state where the date dial 1410 has been rotated counterclockwise through an angle of (360/31)°.

In this state, the motor drive circuit inputs the rotation signal output from the contact point pattern to thereby control the rotation of the ultrasonic motor. Accordingly, the date driving wheel 1406 stops in a state where the date driving wheel 1406 has been rotated counterclockwise through an angle of 90°.

By such construction, in the electronic timepiece of the present invention, by rotating the date finger 1408 clockwise, the date dial 1410 can be rotated clockwise and, by rotating the date finger 1408 counterclockwise, the date dial 1410 can be rotated counterclockwise. And, through the operation of the date jumper 1416, the position in the rotation direction of the date dial 1410 can be positioned always with a high accuracy.

Next, the operation when the date dial 1410 has been rotated upon reception by the electronic timepiece of, for example, an impact will be explained.

Figure 48:
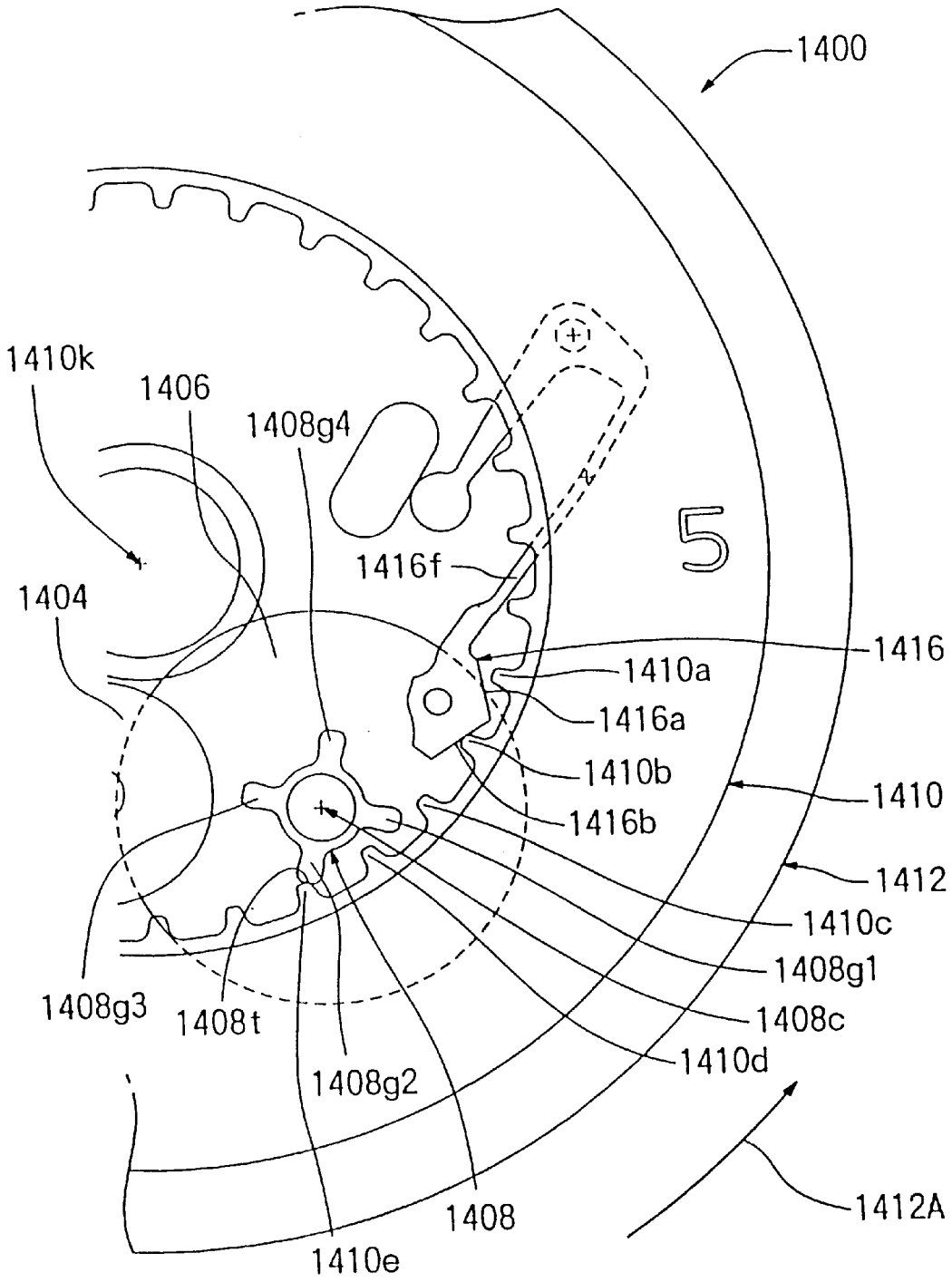
FIG. 48 is a schematic plan view illustrating the calendar mechanism portion of the eighth embodiment of the electronic timepiece according to the present invention equipped with a date finger of a first configuration, in a state where the date dial has been rotated counterclockwise by an external force.

Referring to FIG. 48, when the date dial 1410 has been rotated counterclockwise as indicated by an arrow 1412A, a date dial tooth 1410*e* of the date dial 1410 contacts with the outer-peripheral portion 1408*t* of the date finger portion 1408*g*2. The configuration of the outer-peripheral portion 1408*t* is shaped like a circular arc whose circle has the center 1408*c* or is approximately shaped like this circular arc. Also, the index torque of the ultrasonic motor is transmitted to the date finger 1408. Accordingly, the date finger 1408 cannot be rotated by the date dail tooth 1410*e* being contacted therewith.

And, in a state illustrated in FIG. 48, since the regulating portion 1416*b* of the date jumper 1416 is being contacted with the date dial tooth 1410*b*, the date dial 1410 can be rotated clockwise by the spring force of the date jumper spring portion 1416f and can be thereby returned to the state illustrated in FIG. 47.

Figure 49:
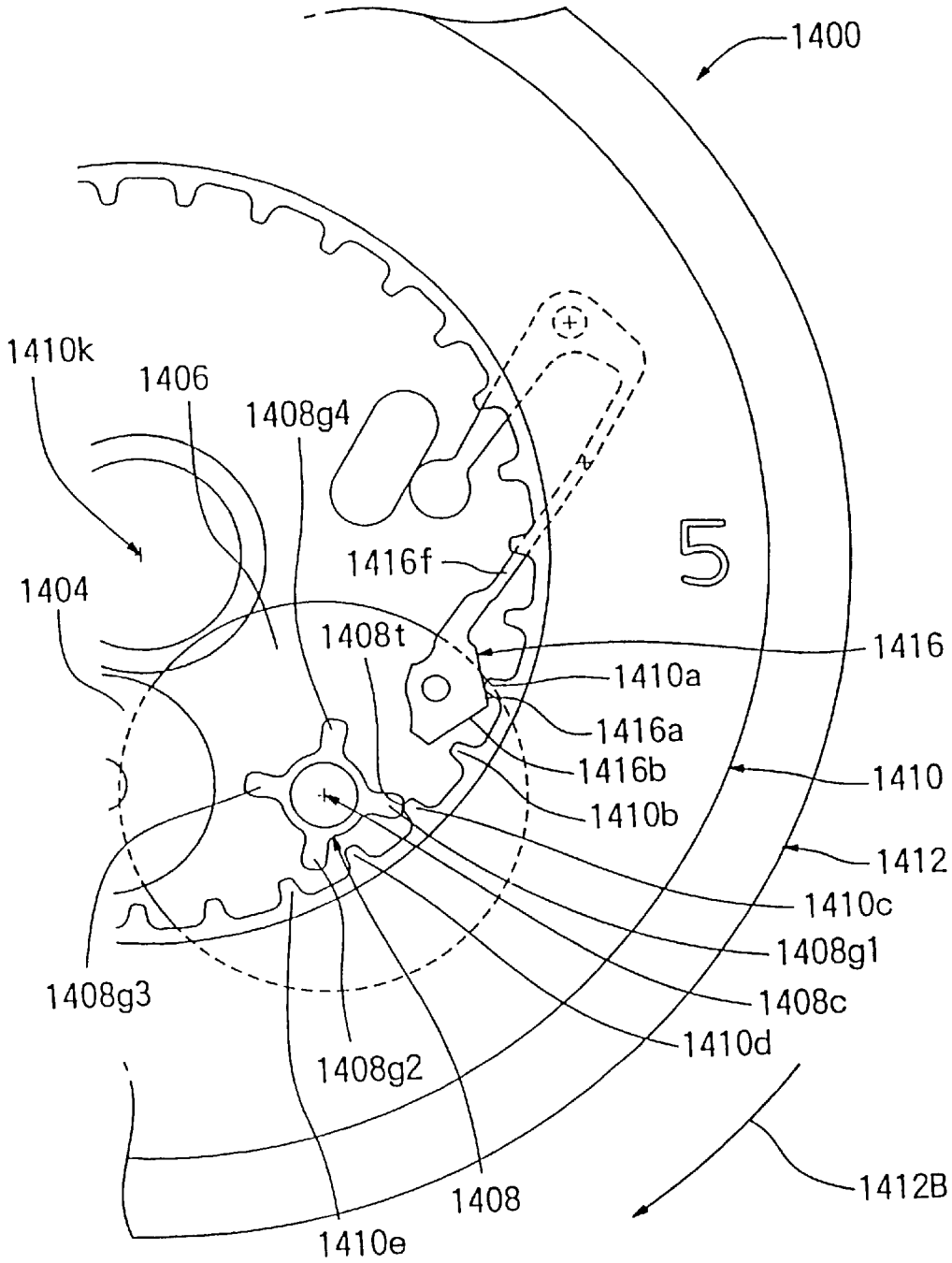
FIG. 49 is a schematic plan view illustrating the calendar mechanism portion of the eighth embodiment of the electronic timepiece according to the present invention equipped with the date finger of the first configuration, in a state where the date dial has been rotated clockwise by an external force.

Next, referring to FIG. 49, when the date dial 1410 has been rotated clockwise as indicated by an arrow 1412B, a date dial tooth 1410*e* of the date dial 1410 contacts with the outer-peripheral portion 1408*t* of the date finger portion 1408*g*1. Accordingly, the date finger 1408 cannot be rotated by the date dail tooth 1410*c* being contacted therewith.

And, in a state illustrated in FIG. 49, since the regulating portion 1416*a* of the date jumper 1416 is being contacted with the date dial tooth 1410*a*, the date dial 1410 can be rotated counterclockwise by the spring force of the date jumper spring portion 1416f and can be thereby returned to the state illustrated in FIG. 47.

Namely, in the electronic timepiece of the present invention, it is arranged that through the intermeshing between the date dial tooth 1410*e* or 1410*c* of the date dial 1410 and the date finger 1408 and through the index torque of the ultrasonic motor the date finger 1408 cannot be rotated even when the date dial 1410 is rotated either clockwise or counterclockwise.

For example, it is assumed that the rotating force from the date dial 1410 which is produced due to an external force such as an impact be represented by F1, the index torque of the ultrasonic motor be represented by F2, the rotation resistance force which is produced due to the intermeshing between the date dial tooth 1410*e* or 1410*c* and the date finger 1408 be represented by F3, and the reduction ratio of the wheel train from the ultrasonic motor to the date finger 1408 be represented by n.

Comparison is made between the force F1 of rotating the date dial 1410 by the external force such as an impact and the force (F2+F3)/n of stopping this rotation. At this time, the F3 can be made larger than F1 according to the configuration of the outer-peripheral portion 1408*t* of the date finger portion 1408*g*1.

Therefore, according to the construction of the electronic timepiece of the present invention, it results that (F2+F3)/n >>F1, with the result that it is possible to effectively stop the rotation of the date dial 1410 which occurs due to the external force.

Figure 50:
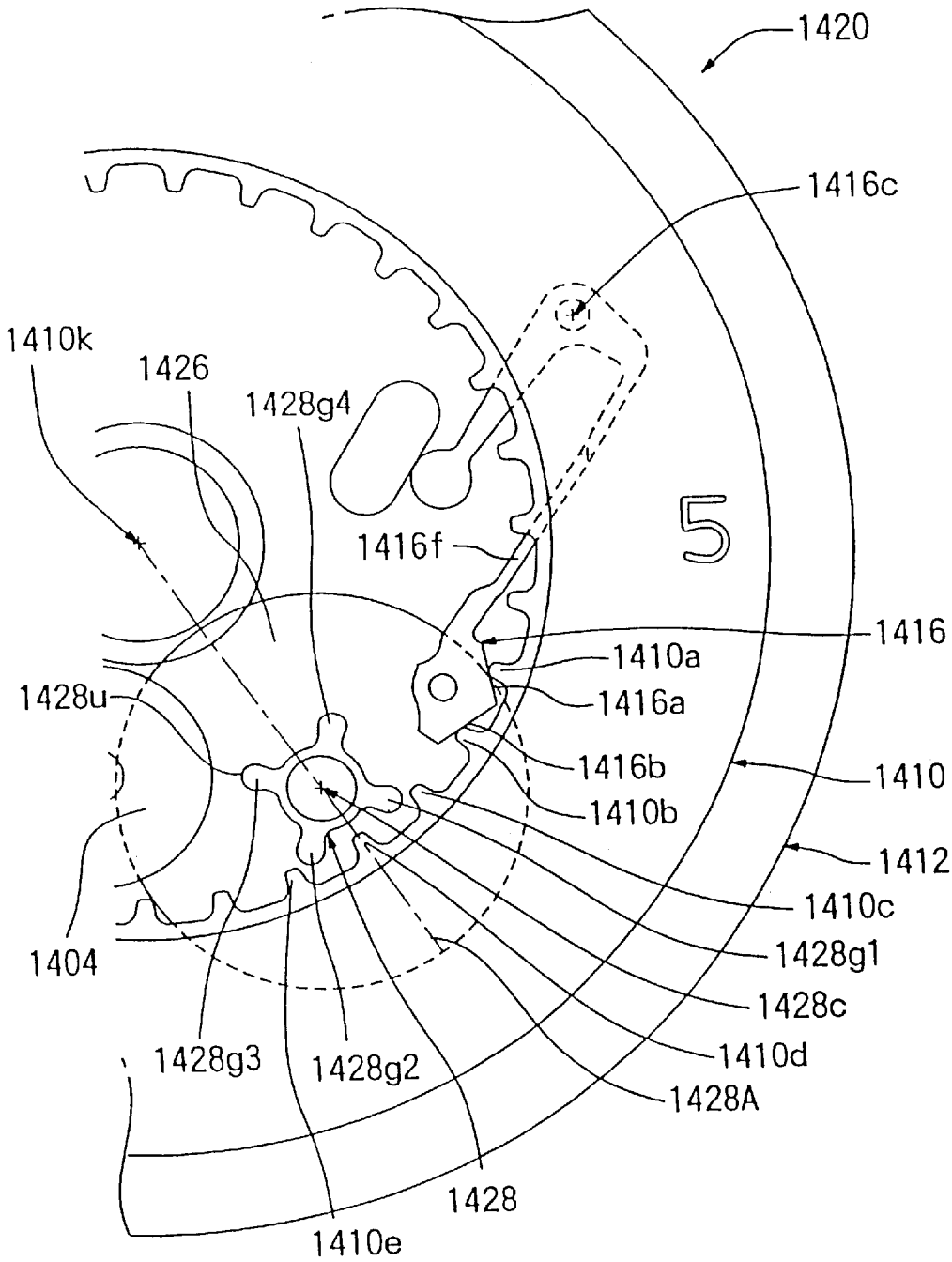
FIG. 50 is a schematic plan view illustrating the calendar mechanism portion of the eighth embodiment of the electronic timepiece according to the present invention that is equipped with a date finger of a second configuration.

Next, referring to FIG. 50, each of the date finger portions 1428*g*1, 1428*g*2, 1428*g*3 and 1428*g*4 of the date finger 1428 is formed into the same configuration and has an outer-peripheral portion 1428*u* having a circular arc configuration whose circle has its center at a position spaced away from a center 1428*c*. Although in FIG. 50 illustration is made of the outer-peripheral portion 1428*u* with regard to only the date finger 1428*g*3 alone, the configuration of the outer-peripheral portion 1428*u* is the same, also, with regard to the other date fingers 1428*g*1, 1428*g*2 and 1428*g*4.

The outer-peripheral portion 1428*u* is formed into such a configuration as to enable the reliable rotation of the date dial 1410 with the rotation of the date finger 1428 and as, when the date dial 1410 rotates and has thereby contacted with the outer-peripheral portion 1428*u*, to stop the rotation of the date dial 1410.

Namely, in the FIG. 50 illustrated embodiment of the electronic timepiece of the present invention, the date finger 1428 is so constructed as to have lock tooth configurations at respective forward end portions of its date finger portions 1428*g*1, 1428*g*2, 1428*g*3 and 1428*g*4.

Figure 51:
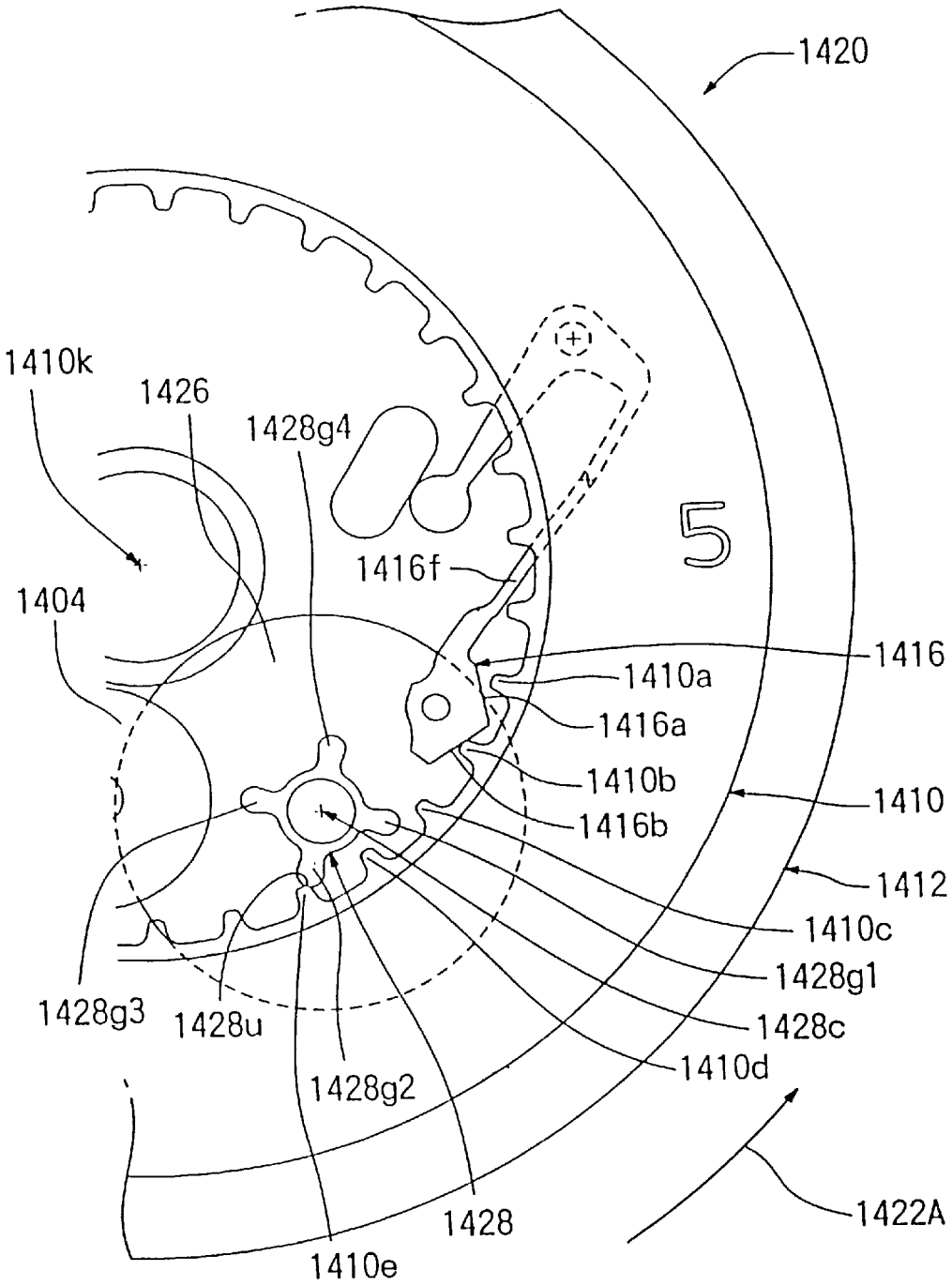
FIG. 51 is a schematic plan view illustrating the calendar mechanism portion of the eighth embodiment of the electronic timepiece according to the present invention equipped with the date finger of the second configuration, in a state where the date dial has been rotated counterclockwise by an external force.

Referring to FIG. 51, when the date dial 1410 has been rotated counterclockwise as indicated by an arrow 1422A, the date dial tooth 1410*e* of the date dial 1410 contacts with the outer-peripheral portion 1428*u* of the date finger portion 1428*g*2. The configuration of the outer-peripheral portion 1428*u* is shaped like a circular arc whose circle has its center at the position spaced away from the center 1428*c*. Also, the index torque of the ultrasonic motor is transmitted to the date finger 1428. Accordingly, the date finger 1428 cannot be rotated by the date dail tooth 1410*e* being contacted therewith.

And, in a state illustrated in FIG. 51, since the regulating portion 1416*b* of the date jumper 1416 is being contacted with the date dial tooth 1410*b*, the date dial 1410 can be rotated clockwise by the spring force of the date jumper spring portion 1416*f* and can be thereby returned to the state illustrated in FIG. 50.

Figure 52:
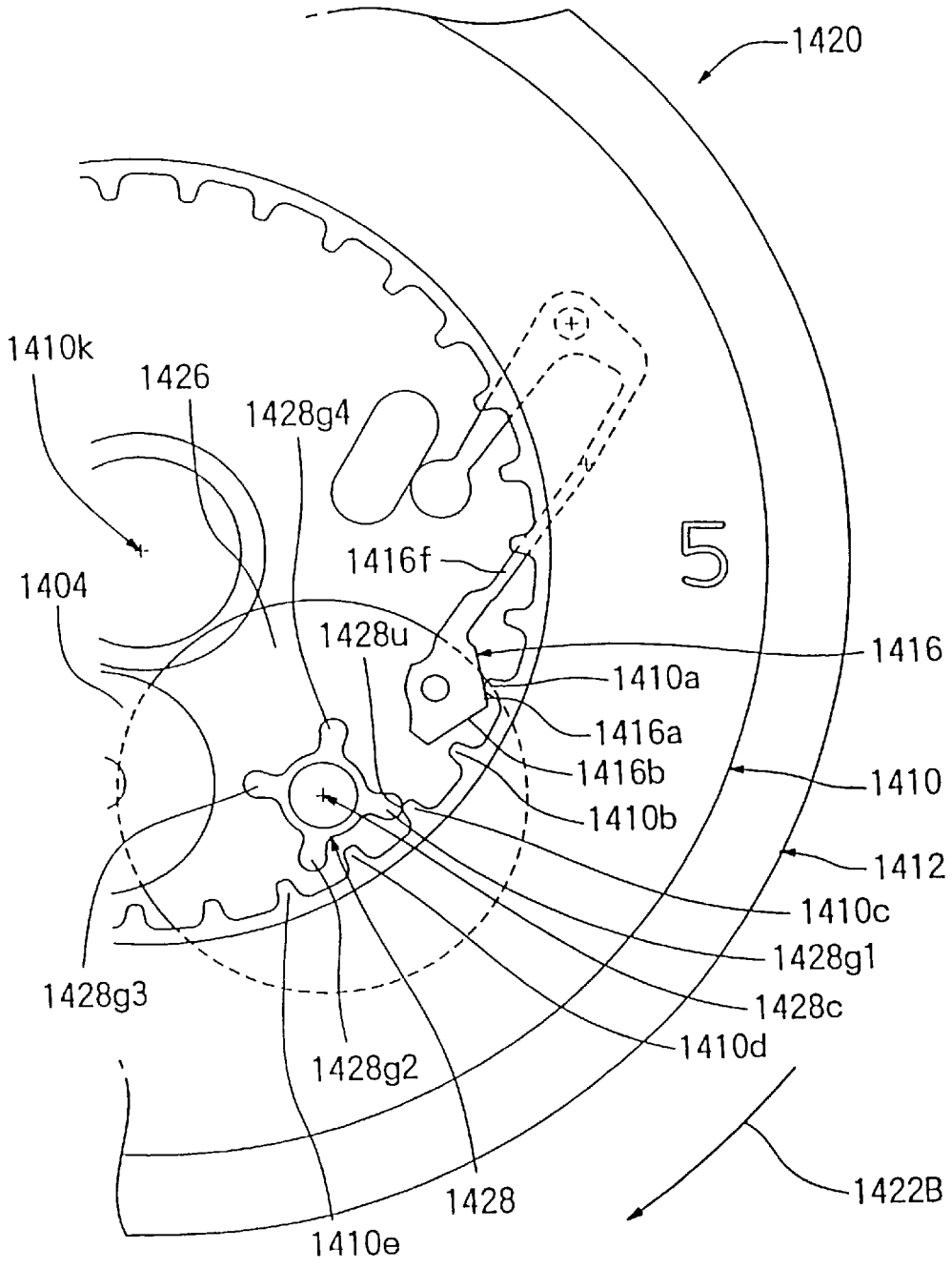
FIG. 52 is a schematic plan view illustrating the calendar mechanism portion of the eighth embodiment of the electronic timepiece according to the present invention equipped with the date finger of the second configuration, in a state where the date dial has been rotated clockwise by an external force.

Next, referring to FIG. 52, when the date dial 1410 has been rotated clockwise as indicated by an arrow 1422B, the date dial tooth 1410*c* of the date dial 1410 contacts with the outer-peripheral portion 1428*u* of the date finger portion 1428*g*1. Accordingly, the date finger 1428 cannot be rotated by the date dail tooth 1410*c* being contacted therewith.

And, in a state illustrated in FIG. 52, since the regulating portion 1416*a*of the date jumper 1416 is being contacted with the date dial tooth 1410*a*, the date dial 1410 can be rotated counterclockwise by the spring force of the date jumper spring portion 1416*f* and can thereby be returned to the state illustrated in FIG. 50.

Figure 53:
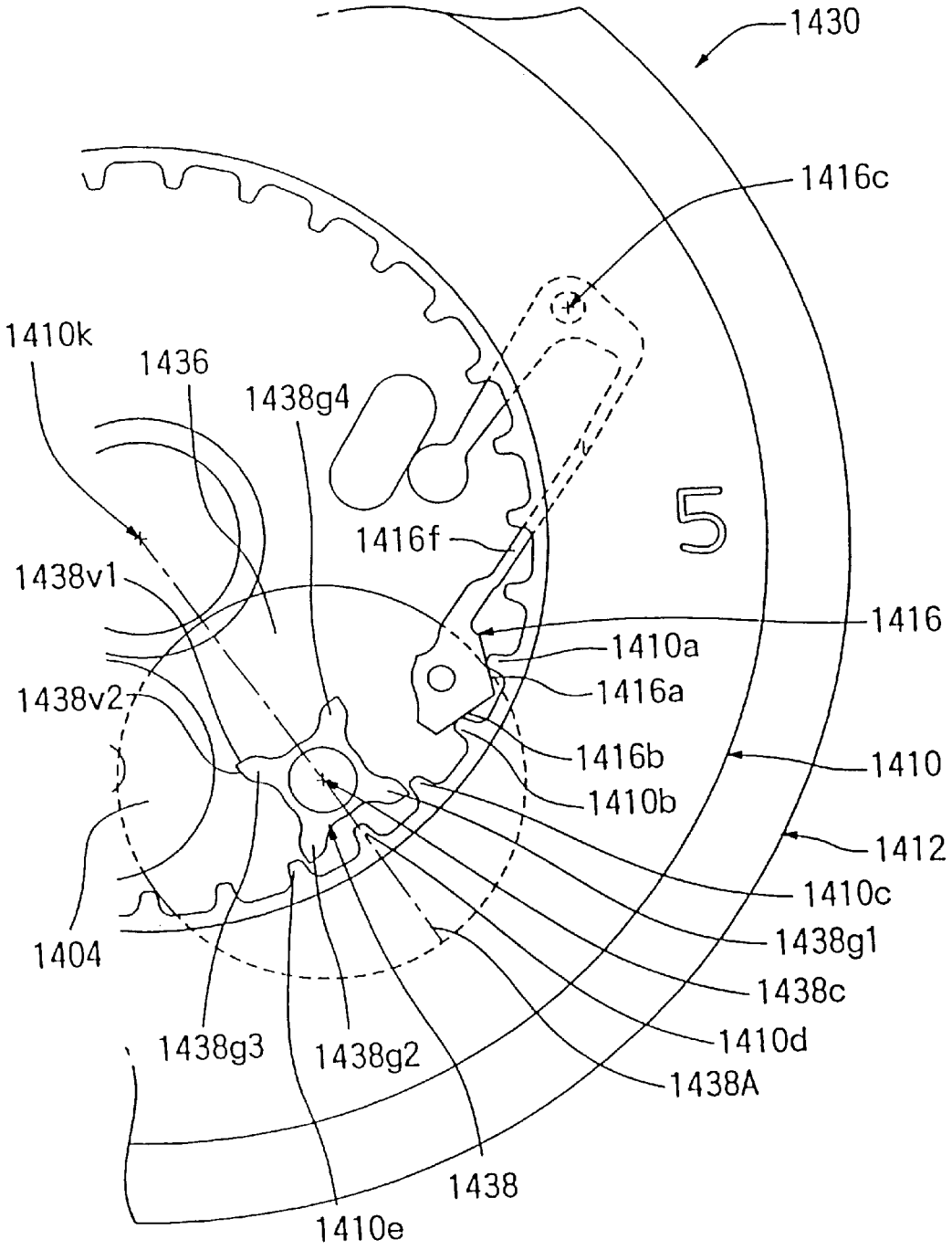
FIG. 53 is a schematic plan view illustrating the calendar mechanism portion of the eighth embodiment of the electronic timepiece according to the present invention that is equipped with a date finger of a third configuration.

Next, referring to FIG. 53, each of the date finger portions 1438*g*1, 1438*g*2, 1438*g*3 and 1438*g*4 of the date finger 1438 is formed into the same configuration and has side surface portions 1438*v*1 and 1438*v*2 that define an acute angle between their forward ends. Although in FIG. 53 illustration is made of the side surface portions 1438*v*1 and 1438*v*2 with regard to only the date finger 1438*g*3 alone, the configuration of the side surface portions 1438*v*1 and 1438*v*2 is the same, also, with regard to the other date fingers 1438*g*1, 1438*g*2 and 1438*g*4.

The side surface portions 1438*v*1 and 1438*v*2 and the circular arc like side surface portions that thereafter succeed the same are formed so as to enable the reliable rotation of the date dial 1410 with the rotation of the date finger 1438. The side surface portions 1438*v*1 and 1438*v*2 are each formed into such a configuration as, when the date dial 1410 rotates and has thereby contacted with the side surface portions 1438*v*1 and 1438*v*2, to stop the rotation of the date dial 1410.

Namely, in the FIG. 50 illustrated embodiment of the electronic timepiece of the present invention, the date finger 1438 is so constructed as to have lock tooth configurations at respective forward end portions of its date finger portions 1438*g*1, 1438*g*2, 1438*g*3 and 1438*g*4.

Figure 54:
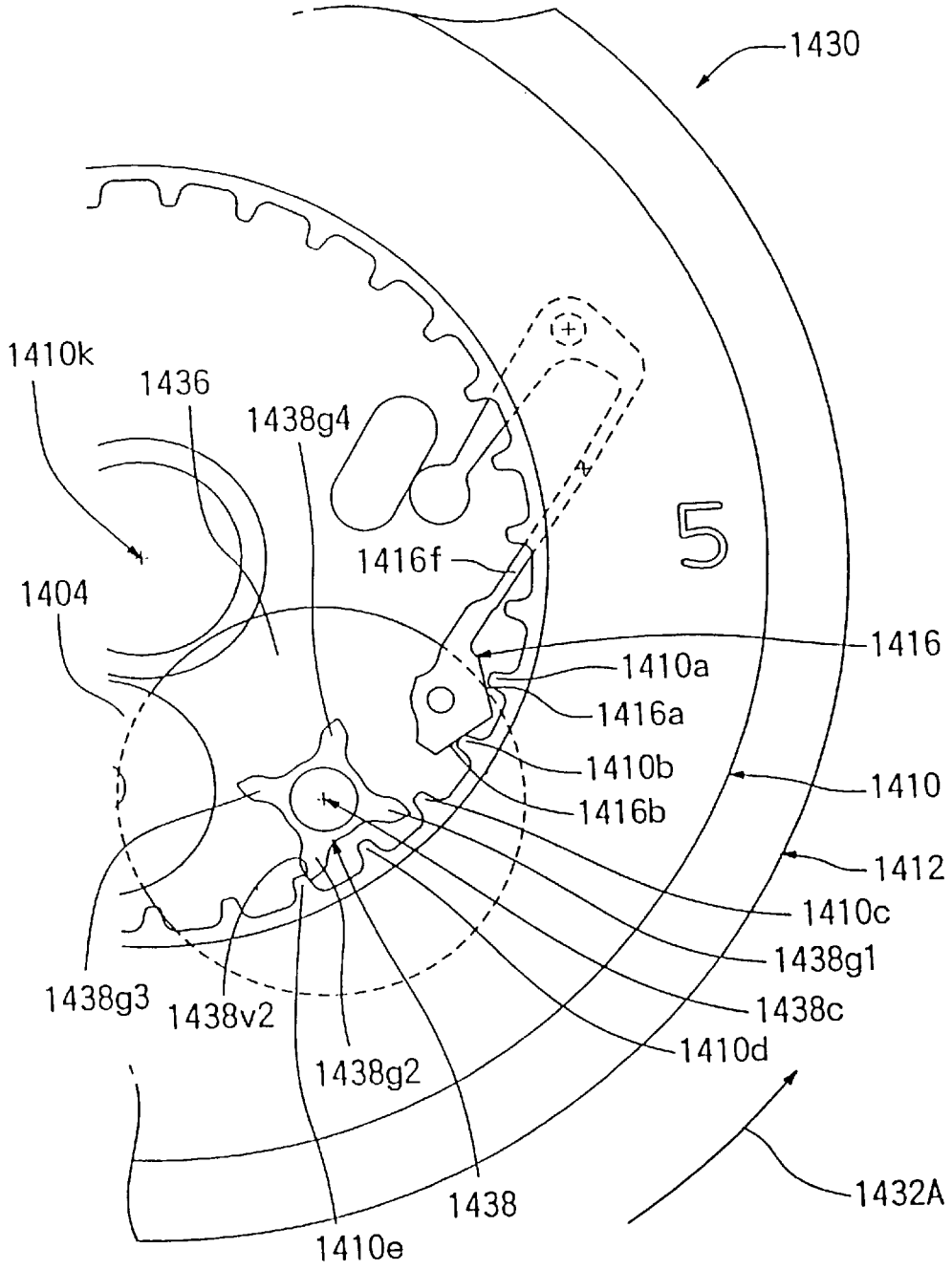
FIG. 54 is a schematic plan view illustrating the calendar mechanism portion of the eighth embodiment of the electronic timepiece according to the present invention equipped with the date finger of the third configuration, in a state where the date dial has been rotated counterclockwise by an external force. And, FIG. 55 is a schematic plan view illustrating the calendar mechanism portion of the eighth embodiment of the electronic timepiece according to the present invention equipped with the date finger of the third configuration, in a state where the date dial has been rotated clockwise by an external force.

Referring to FIG. 54, when the date dial 1410 has been rotated counterclockwise as indicated by an arrow 1432A, the date dial tooth 1410*e* of the date dial 1410 contacts with the side surface portion 1438*v*2 of the date finger portion 1438*g*2. At this time, the index torque of the ultrasonic motor is transmitted to the date finger 1438. Accordingly, the date finger 1438 cannot be rotated by the date dail tooth 1410*e* being contacted therewith.

And, in a state illustrated in FIG. 54, since the regulating portion 1416*b* of the date jumper 1416 is being contacted with the date dial tooth 1410*b*, the date dial 1410 can be rotated clockwise by the spring force of the date jumper spring portion 1416*f* and can thereby be returned to the state illustrated in FIG. 53.

Figure 55:
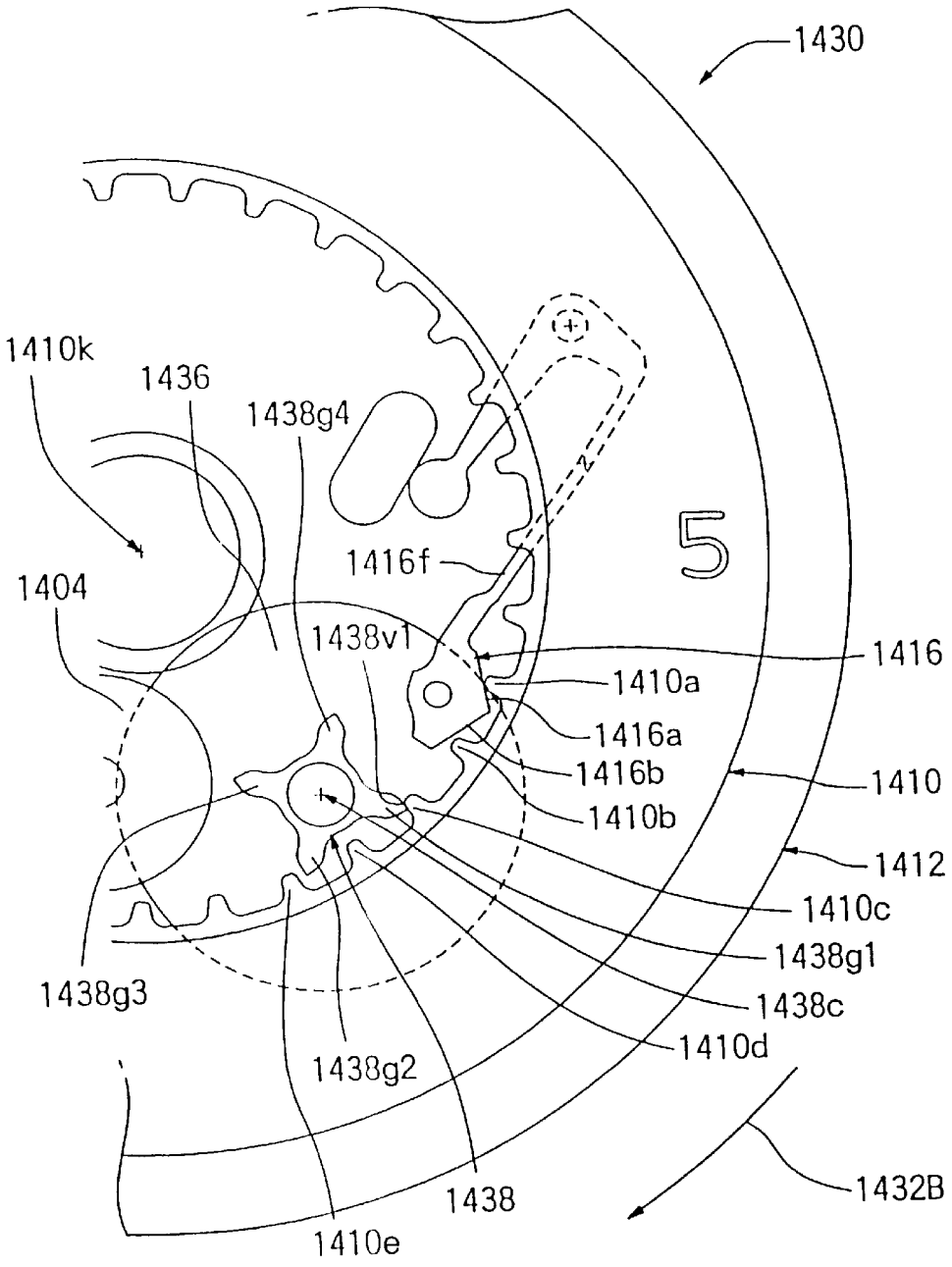

Next, referring to FIG. 55, when the date dial 1410 has been rotated clockwise as indicated by an arrow 1432B, the date dial tooth 1410*c* of the date dial 1410 contacts with the side surface portion 1438*v*1 of the date finger portion 1438*g*1. At this time, also, the index torque of the ultrasonic motor is transmitted to the date finger 1438. Accordingly, the date finger 1438 cannot be rotated by the date dail tooth 1410*c* being contacted therewith.

And, in a state illustrated in FIG. 55, since the regulating portion 1416*a* of the date jumper 1416 is being contacted with the date dial tooth 1410*a*, the date dial 1410 can be rotated counterclockwise by the spring force of the date jumper spring portion 1416*f* and can thereby be returned to the state illustrated in FIG. 53.

In the electronic timepiece of the present invention, as a result of the above-described construction, there exists almost no possibility that when an external force such as an impact has been applied to the electronic timepiece, the date dial will be rotated.

(11) Further, the electronic timepiece of the present invention may be constructed as described below.

[1] An electronic timepiece, the electronic timepiece having the function of indicating data regarding a calendar, characterized by comprising:

a control circuit (130) having a calendar signal generating circuit for generating a calendar signal by counting data regarding a calendar such as a day, month and year and having an ultrasonic motor driving circuit for outputting an ultrasonic motor driving signal for rotating an ultrasonic motor (132) according to the calendar signal output from the calendar signal generating circuit;

the ultrasonic motor (132) having an ultrasonic stator (122) having a piezoelectric element bonded thereto and having an ultrasonic rotor (102) which upon input of the ultrasonic motor driving signal is friction driven by the oscillatory waves generating in the ultrasonic stator due to the expansion and contraction of the piezoelectric element;

a calendar indication wheel for indicating data regarding a calendar by operating according to the rotation of the ultrasonic rotor (102);

a date drive termination detecting contact point member for detecting the point in time at which date drive is terminated according to the rotation of the ultrasonic rotor (102); and a date drive control circuit for inputting a signal regarding the start of date drive that is output from a date drive start detecting contact point member and inputting a signal regarding the end of date drive that is output from a date drive end detecting contact point member to thereby control the operation of a date indication driving circuit for outputting a date indication motor driving signal.

[2] An electronic timepiece as described under the above item [1], characterized in that the calendar indication wheel is a date dial (110) for indicating data regarding a day;

the calendar signal generating circuit counts data regarding a day of a leap year and a day of January to December; and the ultrasonic motor driving circuit that is constructed so that on the first day of each month the indication of a day may become 1, by outputting according to the counted result of the calendar signal generating circuit when a month changes from the end day of an even month to the next month an ultrasonic motor driving signal that is different from that which is output therefrom when a month changes from the end day of an odd month to the next month.

[3] An electronic timepiece as described under the above item [2] or [2], comprising:

a calendar wheel train that operates according to the rotation of the ultrasonic rotor (102), characterized in that a construction is so made as to operate the calendar indication wheel by the calendar wheel train.

[4] An electronic timepiece as described under one of the above items [1] to [3], comprising:

a date finger that operates according to the rotation of the ultrasonic rotor (102), characterized in that a construction is so made as to operate the calendar indication wheel by the date finger.

[5] An electronic timepiece as described under one of the above items [1] to [4], characterized by comprising:

a regulating member for regulating the position along the rotation direction of the calendar indication wheel.

As has been explained above, since having been constructed as having in the electronic timepiece the transmission wheel rotational position detecting unit for detecting the position in the rotation direction of the transmission wheel, the present invention has the effects that are described as follows.

(1) It is possible to realize the electronic timepiece having the transmission wheel rotational position detecting unit that accurately detects the position in the rotation direction of the transmission wheel.

(2) It is possible to realize the small-sized electronic timepiece having the rotational position detecting unit for the transmission wheel.

(3) It is possible to realize the electronic timepiece having the transmission wheel rotational position detecting unit whose contact point has a high durability performance.

(4) In the electronic timepiece having the date dial, it is possible to start the date drive at the same point in time everyday accurately.

(5) In the electronic timepiece having the date dial, it is possible to maintain the position of the date dial accurately. Accordingly, there is almost no possibility that the position of a day character on the date dial will be deviated.

(6) When an external force such as an impact has been applied to the electronic timepiece, there is no possibility that the indication wheel or date dial will be rotated.

(7) Since the stationary torque of the motor for rotating the date dial can be reduced, it is possible to reduce the power consumption of the motor. Namely, with the present invention, it is possible to realize the electronic timepiece whose battery life is long.

What is claimed is:

1. An electronic timepiece comprising:

a time signal generating circuit for generating a time signal by counting data with respect to time information;

a time indication motor;

a time indication motor driving circuit for outputting a time indication motor drive signal to rotate the time indication motor in accordance with the time signal generated by the time signal generating circuit;

a time indication wheel train connected to the time indication motor for rotation therewith;

a time data indicating member for indicating time data in accordance with the rotation of the time indication wheel train;

a date signal generating circuit for generating a date signal with respect to date information;

a date indication motor;

a date indication motor driving circuit for outputting a date indication motor drive signal for rotating the date indication motor in accordance with the date signal generated by the date signal generating circuit;

a date indication wheel train connected to the date indication motor for rotation therewith;

a date data indicating member for indicating date data in accordance with the rotation of the date indication wheel train;

a date drive start detecting contact point member for detecting a point in time at which date drive is started in accordance with rotation of the time indication wheel train;

a date drive termination detecting contact point member for detecting a point in time at which date drive is terminated in accordance with rotation of the date indication wheel train; and a date drive control circuit for controlling the date indication motor driving circuit to output the date indication motor drive signal by inputting a signal from the date drive start detecting contact point member corresponding to the start of the date drive and by inputting a signal from the date drive termination detecting contact point member corresponding to the termination of the date drive.

2. An electronic timepiece according to claim 1; wherein the date indication motor comprises an ultrasonic motor.

3. An electronic timepiece according to claim 2; wherein the time indication wheel train has an hour wheel for undergoing rotation therewith and a 24-hour wheel for undergoing rotation with the hour wheel, the date drive start detecting contact point member being disposed on the 24-hour wheel; and wherein the date indication wheel train has a date driving wheel connected to the date indication motor for rotation therewith, the date drive termination detecting contact point member being disposed on the date driving wheel.

4. An electronic timepiece according to claim 1; wherein the time indication wheel train has an hour wheel for undergoing rotation therewith and a 24-hour wheel for undergoing rotation with the hour wheel, the date drive start detecting contact point member being disposed on the 24-hour wheel; and wherein the date indication wheel train has a date driving wheel connected to the date indication motor for rotation therewith, the date drive termination detecting contact point member being disposed on the date driving wheel.

5. An electronic timepiece comprising:

a date indicator for indicating a date and having a plurality of internal teeth;

a date driving wheel having a plurality of date fingers for rotationally driving the date indicator to indicate a date;

an intermediate date driving wheel for rotationally driving the date driving wheel;

an ultrasonic motor for rotating the intermediate driving wheel;

a contact point spring disposed on the date driving wheel;

a printed circuit board having a contact point pattern for detecting a state of rotation of the date driving wheel by mutual contact between the contact point pattern and the contact point spring;

a motor driving circuit for controlling the ultrasonic motor in accordance with a rotational signal from the contact point pattern of the printed circuit board; and a date jumper having a spring portion for regulating a position of the date indicator along a rotational direction thereof by engagement with the internal teeth of the date indicator;

wherein the date jumper regulates a position of the date indicator along a rotational direction thereof so that one of the internal teeth of the date indicator is disposed on a straight line passing through a rotational center of the date indicator and through a rotational center of the date fingers of date driving wheel;

wherein in a state in which the ultrasonic motor is stopped, two of the date fingers of the date driving wheel are disposed at symmetrical positions with respect to the straight line; and wherein the date fingers of the date driving wheel cannot be rotated when the date indicator is rotated by intermeshing between the internal teeth of the date dial and the date fingers and by an index torque of the ultrasonic motor.

6. An electronic timepiece according to claim 5; wherein the plurality of internal teeth of the date indicator comprise 31 internal teeth.

7. An electronic timepiece according to claim 6; wherein the spring portion of the date jumper regulates a position of the date indicator by engagement with two of the internal teeth of the date indicator.

8. An electronic timepiece according to claim 7; wherein the plurality of date fingers of the date driving wheel comprise four date fingers.

9. An electronic timepiece according to claim 8; wherein each of the date fingers of the date driving wheel has a lock tooth configuration at a front end portion thereof.

10. An electronic timepiece according to claim 5; wherein the spring portion of the date jumper regulates a position of the date indicator by engagement with two of the internal teeth of the date indicator.

11. An electronic timepiece according to claim 5; wherein the plurality of date fingers of the date driving wheel comprise four date fingers.

12. An electronic timepiece according to claim 5; wherein each of the date fingers of the date driving wheel has a lock tooth configuration at a front end portion thereof.

* * * * *